US007109156B1

(12) United States Patent
Dykstra et al.

(10) Patent No.: US 7,109,156 B1
(45) Date of Patent: Sep. 19, 2006

(54) CONTROLLED AVAILABILITY OF FORMULATION COMPONENTS, COMPOSITIONS AND LAUNDRY METHODS EMPLOYING SAME

(75) Inventors: Robert Richard Dykstra, Cleves, OH (US); Gregory Scot Miracle, Hamilton, OH (US)

(73) Assignee: Procter & Gamble Company, Cincinnati, OH (US)

( * ) Notice: Subject to any disclaimer, the term of this patent is extended or adjusted under 35 U.S.C. 154(b) by 667 days.

(21) Appl. No.: 10/069,635

(22) PCT Filed: Aug. 25, 2000

(86) PCT No.: PCT/US00/23323

§ 371 (c)(1),
(2), (4) Date: Feb. 26, 2002

(87) PCT Pub. No.: WO01/16263

PCT Pub. Date: Mar. 8, 2001

Related U.S. Application Data

(60) Provisional application No. 60/151,004, filed on Aug. 27, 1999, provisional application No. 60/151,002, filed on Aug. 27, 1999.

(51) Int. Cl.
*C11D 3/26* (2006.01)
*C11D 3/395* (2006.01)
*C11D 3/39* (2006.01)

(52) U.S. Cl. ..... 510/314; 510/303; 510/305; 510/310; 510/336; 510/337; 510/372; 510/376; 510/504

(58) Field of Classification Search ..... 510/303, 510/305, 310, 314, 336, 337, 372, 376, 504; 502/200; 8/111, 137; 564/271
See application file for complete search history.

(56) References Cited

U.S. PATENT DOCUMENTS

| | | | |
|---|---|---|---|
| 4,096,141 | A | 6/1978 | Milkowski et al. |
| 4,194,987 | A | 3/1980 | Brubaker |
| 4,325,957 | A | 4/1982 | Zeugner et al. |
| 4,505,908 | A | 3/1985 | Zeugner et al. |
| 4,595,531 | A | 6/1986 | Milkowski et al. |
| 5,041,232 | A | 8/1991 | Batal et al. |
| 5,045,223 | A | 9/1991 | Batal et al. |
| 5,047,163 | A | 9/1991 | Batal et al. |
| 5,310,925 | A | 5/1994 | Batal et al. |
| 5,360,568 | A | 11/1994 | Madison et al. |
| 5,360,569 | A | 11/1994 | Madison et al. |
| 5,370,826 | A | 12/1994 | Madison et al. |
| 5,413,733 | A | 5/1995 | Nicholson et al. |
| 5,442,066 | A | 8/1995 | Madison et al. |
| 5,478,357 | A | 12/1995 | Madison et al. |
| 5,482,515 | A | 1/1996 | Madison et al. |
| 5,550,256 | A | 8/1996 | Madison et al. |
| 5,576,282 | A | 11/1996 | Miracle et al. |
| 5,652,207 | A | 7/1997 | Ghatlia |
| 5,693,603 | A | 12/1997 | Ghatlia |
| 5,710,116 | A | 1/1998 | Miracle et al. |
| 5,753,599 | A | 5/1998 | Coope et al. |
| 5,760,222 | A | 6/1998 | Coope |
| 5,817,614 | A | 10/1998 | Miracle et al. |
| 5,952,282 | A | 9/1999 | Löffler et al. |
| 6,007,583 | A | 12/1999 | Nestler |
| 6,120,557 | A | 9/2000 | Nestler |

FOREIGN PATENT DOCUMENTS

| | | |
|---|---|---|
| CA | 1122980 | 5/1982 |
| WO | WO 95/13351 | 5/1995 |
| WO | WO 95/13352 | 5/1995 |
| WO | WO 95/13353 | 5/1995 |
| WO | WO 95/28399 | 10/1995 |
| WO | WO 97/06147 | 2/1997 |
| WO | WO 98/07825 | 2/1998 |
| WO | WO 98/15535 | 4/1998 |
| WO | WO 98/23602 | 6/1998 |
| WO | WO 98/23717 | 6/1998 |

OTHER PUBLICATIONS

H. Böhme et al., *Uber Derivate des 1,2,3,4,5-Pentahydro-2-benzazepins*, Arch. Pharm, vol. 306 (4), 1972, pp. 271-274.
U.S. Appl. No. 10/069,634, filed Feb. 26, 2002, Dykstra et al.
U.S. Appl. No. 10/069,632, filed Feb. 26, 2002, Dykstra et al.
U.S. Appl. No. 10/069,633, filed Feb. 26, 2002, Dykstra et al.
U.S. Appl. No. 10/069,628, filed Feb. 26, 2002, Dykstra et al.
U.S. Appl. No. 10/069,631, filed Feb. 26, 2002, Dykstra et al.
U.S. Appl. No. 10/083,948, filed Feb. 27, 2002, Dykstra et al.
U.S. Appl. No. 10/069,630, filed Feb. 26, 2002, Dykstra et al.
U.S. Appl. No. 10/069,629, filed Feb. 26, 2002, Dykstra et al.

*Primary Examiner*—Gregory R. Del Cotto
(74) *Attorney, Agent, or Firm*—James F. McBride; Kim W. Zerby; Steve W. Miller

(57) ABSTRACT

The present invention relates to a method for the controlled availability formulation components, such as organic catalysts, into a wash solution. More particularly, the present invention relates to products and bleaching compositions containing such formulation components and laundry methods employing such formulation components.

13 Claims, 4 Drawing Sheets

| $t$ | $t_C$ | $A_{max}$ | $A_{t(C)}$ | $\delta A_{t(C)}$ | % dye |
|---|---|---|---|---|---|
| 0 | 0 | 1.20 | | | 100 |
| 0.5 | 2 | 1.20 | 1.00 | 0.20 | 83 |
| 1.5 | 3 | 1.20 | 0.84 | 0.36 | 71 |
| 2.5 | 4 | 1.20 | 0.70 | 0.50 | 58 |
| 3.5 | 5 | 1.20 | 0.67 | 0.53 | 56 |
| 5 | 6.5 | 1.20 | 0.72 | 0.48 | 60 |
| 10 | 11.5 | 1.20 | 0.78 | 0.42 | 65 |
| 15 | 16.5 | 1.20 | 0.83 | 0.37 | 69 |

Fig. 1

CONTROLLED AVAILABILITY OF FORMULATION COMPONENTS, COMPOSITIONS AND LAUNDRY METHODS EMPLOYING SAME

This application claims priority under 35 USC 119(e) to provisional application 60/151,002, filed Aug. 27, 1999 and provisional application 60/151,004, filed Aug. 27, 1999.

FIELD OF THE INVENTION

The present invention relates to a method for the controlled availability of formulation components, such as organic catalysts, into a wash solution. More particularly, the present invention relates to products and bleaching compositions containing such formulation components and laundry methods employing such formulation components.

BACKGROUND OF THE INVENTION

Oxygen bleaching agents have become increasingly popular in recent years in household and personal care products to facilitate stain and soil removal. Bleaches are particularly desirable for their stain-removing, dingy fabric cleanup, whitening and sanitization properties, as well as for dye transfer inhibition. Oxygen bleaching agents have found particular acceptance in laundry products such as detergents, in automatic dishwashing products and in hard surface cleansers. Oxygen bleaching agents, however, are somewhat limited in their effectiveness. Some frequently encountered disadvantages include color damage on fabrics and damage to laundry appliances. In addition, oxygen bleaching agents tend to be extremely temperature rate dependent. Thus, the colder the solution in which they are employed, the less effective the bleaching action. Temperatures in excess of 60° C. are typically required for effectiveness of an oxygen bleaching agent in solution.

To solve the aforementioned temperature rate dependency, a class of compounds known as "bleach activators" has been developed. Bleach activators, typically perhydrolyzable acyl compounds having a leaving group such as oxybenzenesulfonate, react with the active oxygen group, typically hydrogen peroxide or its anion, to form a more effective peroxyacid oxidant. It is the peroxyacid compound which then oxidizes the stained or soiled substrate material. However, bleach activators are also somewhat temperature dependent. Bleach activators are more effective at warm water temperatures of from about 40° C. to about 60° C. In water temperatures of less than about 40° C., the peroxyacid compound loses some of its bleaching effectiveness.

Attempts have been made as disclosed in U.S. Pat. Nos. 5,360,568, 5,360,569 and 5,370,826 all to Madison et al. to develop a bleach system which is effective in lower temperature water conditions. However, the dihydroisoquinolinium bleach boosters disclosed in these references, when combined with peroxygen compounds, undergo undesired decomposition, particularly when in the presence of wash solution components.

U.S. Pat. Nos. 5,576,282 and 5,817,614 both to Miracle et al. disclose additional attempts at developing a bleach system comprising organic catalysts which is effective in lower temperature water conditions and is safe on colors.

However, the prior art has failed to teach or disclose the delayed (controlled) addition of formulation components, such as organic catalysts, in accordance with the present invention.

In light of the foregoing, researchers have been pursuing a method to mitigate (or control) the decomposition of the organic catalyst, particularly prior to contact with the oxidizable stain.

Accordingly, the need remains for an effective method to deliver organic catalysts and compositions containing organic catalysts which provide effective bleaching even in lower water temperatures, provides improved stability toward unwanted organic catalyst decomposition, and maximizes peracid performance early in the wash cycle.

SUMMARY OF THE INVENTION

This need is met by the present invention wherein methods to deliver organic catalysts, specifically bleach boosting compounds, bleaching species, modified amines, modified amine oxides, sulfonimines, phosphonimines, N-acylimines and/or thiodiazole dioxides are provided.

Nonlimiting examples of the benefits provided by the methods for delivering organic catalysts of the present invention include: superior bleaching effectiveness even in lower water temperatures; avoidance of decomposition of organic catalysts which typically occurs during the premix period prior to addition of fabrics in need of cleaning (i.e., stained fabrics); permitting peracid to perform bleaching on stained fabrics in need of cleaning prior to delivery of organic catalysts in order to maximize peracid concentration with stains on fabrics; and decrease of peracid concentration via bleaching, thus reducing the rate of organic catalyst decomposition by excess peracid present in the wash solution.

In one aspect of the present invention, a method for laundering a fabric in need of cleaning comprising delivering an organic catalyst by a controlled availability method as defined by Test Protocols I, II and/or III, disclosed hereinafter, in conjunction with or without, preferably with, a peroxygen source to a wash solution containing the fabric, is provided.

In another aspect of the present invention, a bleaching composition comprising an organic catalyst capable of becoming available (chemically available to interact with other compounds) by a controlled availability method as defined by Test Protocols I, II and/or III, disclosed hereinafter, to perform bleaching when delivered to a wash solution, in conjunction with or without, preferably with, a peroxygen source, is provided.

In still yet another aspect of the present invention, a product comprising an organic catalyst capable of becoming available (chemically available to interact with other compounds) by a controlled availability method as defined by Test Protocols I, II and/or III, disclosed hereinafter, to perform bleaching in the form of dye transfer inhibition when delivered to a wash solution, in conjunction with or without, preferably with, a peroxygen source is provided.

In yet another aspect of the present invention, a product comprising an organic catalyst capable of becoming available (chemically available to interact with other compounds)

by a controlled availability method as defined by Test Protocols I, II and/or III, disclosed hereinafter, to perform bleaching when delivered to a wash solution, in conjunction with or without, preferably with, a peroxygen source, the product further including instructions for using the organic catalyst to clean a fabric in need of cleaning, the instructions including the step of delivering an amount of the product comprising the organic catalyst, in conjunction with or without a peroxygen source, to a wash solution containing the fabric such that at least a majority of said organic catalyst is delivered by a delivery means to the wash solution after the fabric is added to the wash solution is provided.

It has been surprisingly found that an organic catalyst being available (chemically available to interact with other compounds) by a controlled availability method as defined by Test Protocols I, II and/or III, disclosed hereinafter, in a wash solution containing a peroxygen source and a fabric in need of cleaning provides enhanced bleaching performance compared to an organic catalyst being instantaneously available (chemically available to interact with other compounds) in the wash solution.

By controlling the availability of the organic catalysts of the present invention in a wash solution containing a peroxygen source and a fabric by a controlled availability method as defined in Test Protocols I, II and/or III, disclosed hereinafter, the peroxygen source/peracid can bleach during the early part of the wash cycle when its concentration is the highest, and at the same time the exposure of the organic catalysts to the highest peroxygen source/peracid concentration can be avoided thus, reducing organic catalyst decomposition. The organic catalysts can then become available (chemically available to interact with other compounds, i.e., peracid) by a controlled availability method as defined by Test Protocols I, II and/or III, as disclosed hereinafter. Once available in the wash solution, the organic catalysts can react with the remaining available peracid to form the oxygen transfer agents (bleaching species) which can oxidize stains. This results in the added benefits of the peroxygen source/peracid and the organic catalyst being optimized.

Without being bound by theory, the organic catalysts, particularly the bleach boosting compounds react with a peroxygen source, preferably a peracid, to form the oxygen transfer agents (bleaching species). Various decomposition pathways can lead to the decomposition of either the bleach boosting compound or the oxygen transfer agent, leading to decomposition products which can also react with the peroxygen source/peracid.

Accordingly, controlling the availability of the organic catalysts, and thus controlling the timing of the contact between the organic catalysts and any peroxygen sources/peracids in a wash solution allows such peroxygen sources/peracids present in the wash solution to perform maximum bleaching on select stains of a fabric prior to coming into contact with the organic catalysts.

Under typical wash conditions, since the peracid reacts with stain slower than the oxygen transfer agent, there is often available oxygen in the form of peracid present at the end of the wash cycle. The available oxygen at the end of the wash cycle is at a lower concentration, which results in a lower bleaching rate, and upon completion of the wash, it results in the wasting of the remaining peracid. Actually, as the wash cycle proceeds, the concentration (after perhydrolysis is complete) begins to decrease due to the peracid bleaching stains and soils. The bleaching done by the peracid is relatively slow (from a kinetic point of view, especially at lower wash bath temperatures), and it is necessary to maximize the wash time and maximize the concentration of the peracid to maximize stain removal. It is important and necessary to allow a high peracid concentration to work on certain oxidizable stains, and then allow the organic catalyst to work on a complimentary set of oxidizable stains. It is known that peracids react rapidly with the organic catalysts which forms a bleaching species, which then reacts rapidly with oxidizable stains.

Accordingly, it is an object of the present invention to provide: a method for delivering an organic catalyst by a controlled availability method as defined in Test Protocols I, II and/or III, which demonstrates improved performance even in lower temperature solutions as well as being able to mitigate (or control) unwanted decomposition and to maximize peracid performance early in the wash cycle; a method for laundering a fabric in need of cleaning by delivering an organic catalyst in a controlled availability method as defined in Test Protocols I, II and/or III, disclosed hereinafter, to a wash solution containing the fabric; a bleaching composition comprising an organic catalyst capable of becoming available by a controlled availability method as defined by Test Protocols I, II and/or III, disclosed hereinafter; and a product comprising an organic catalyst capable of becoming available by a controlled availability method as defined by Test Protocols I, II and/or III, disclosed hereinafter, to a wash solution already containing a fabric in need of cleaning. These, and other objects, features and advantages of the present invention will be recognized by one of ordinary skill in the art from the following description and the appended claims.

All percentages, ratios and proportions herein are on a weight basis unless otherwise indicated. All documents cited herein are hereby incorporated by reference.

BRIEF DESCRIPTION OF THE DRAWINGS

FIG. 1 is an example of Case $I_1$ for a 20 minute wash cycle.

DETAILED DESCRIPTION OF THE INVENTION

Figure 2:
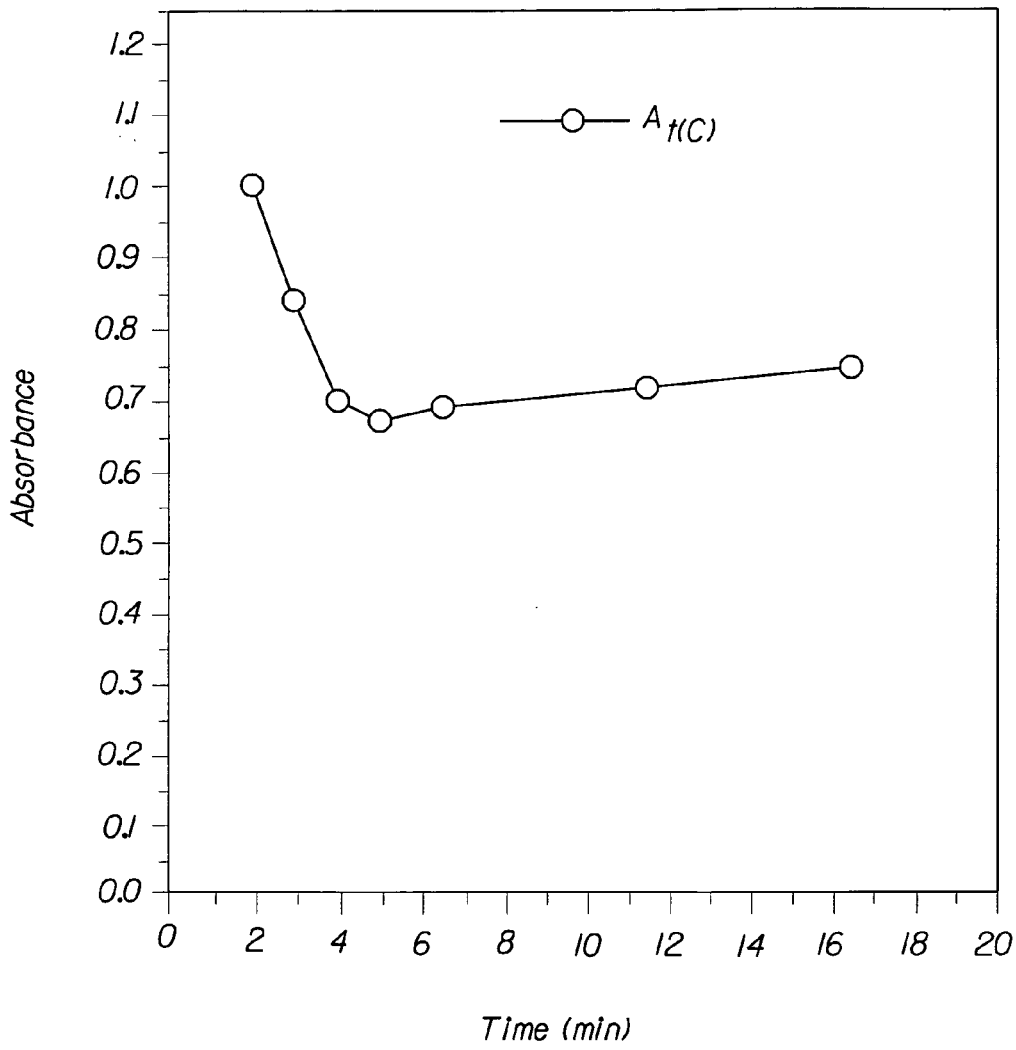
FIG. 2 is an example of Case $I_1$ for a 20 minute wash cycle.

The present invention discloses novel and highly useful methods for delivering organic catalyst compounds, also referred to as organic catalysts ("bleach boosting compounds", "bleaching species", "modified amines", "modified amine oxides", sulfonimines, phosphinimines, thiodiazole dioxides and mixtures thereof), by a controlled availability method as defined in Test Protocols I, II and/or III, disclosed hereinafter, to a wash solution containing a fabric in need of cleaning (i.e., stained/soiled fabric).

The controlled availability methods for delivering organic catalysts of the present invention provide increased bleaching effectiveness even in lower temperature applications while being able to mitigate (or control) unwanted decomposition. As a result, the organic catalysts and methods of using same in accordance with the present invention result in superior mitigation of unwanted decomposition, which leads to increased catalytic efficiency, which leads to increased bleaching, and thus enhanced performance. Further, the organic catalysts and methods of using same in accordance with the present invention maximize peracid performance early in the wash cycle, resulting in improved overall performance. The controlled availability methods as defined in Test Protocols I, II and/or III, disclosed hereinafter, permit the organic catalysts to become chemically available to interact with other compounds in a wash solution in a controlled (less than total amount of organic catalyst becoming available at one time) rather than a lump sum (total amount of organic catalyst becoming available at one time) manner.

DEFINITIONS

"Becoming Available" means herein, becoming chemically available to interact with other compounds.

"Peroxygen source" as used herein means materials that generate peroxygen compounds, which can include the peroxygen compounds themselves. Examples include, but are not limited to, bleach activators, peracids, percarbonate, perborate, hydrogen peroxide, bleach boosting compounds, and/or bleaching species (e.g., oxaziridiniums).

"Peroxygen compounds" as used herein includes peracids and peroxides (e.g., hydrogen peroxide, alkyl hydroperoxides, etc.

"Peracid" as used herein means a peroxyacid such as peroxycarboxylic acid and/or peroxymonosulfuric acid (tradname OXONE) and their salts.

The methods for delivering organic catalysts of the present invention act in conjunction with or without, preferably with conventional peroxygen bleaching sources, to provide the above-mentioned increased bleaching effectiveness and superior mitigation of unwanted decomposition.

Organic Catalyst Compounds

Nonlimiting examples of organic catalyst compounds, such as bleach boosting and bleaching species compounds are described in U.S. Pat. Nos. 5,041,232, 5,045,223, 5,047,163, 5,310,925, 5,413,733, 5,360,568, 5,482,515, 5,550,256, 5,360,569, 5,478,357, 5,370,826, 5,442,066, 5,576,282, 5,760,222, 5,753,599, 5,652,207 and 5,817,614, PCT Published Applications WO 98/23602, WO 95/13352, WO 95/13353, WO 95/13351, WO 97/06147 and WO 98/23717, and EP 728 182.

The organic catalyst compounds of the present invention and bleaching compositions (products) containing such organic catalyst compounds that are particularly useful in the methods of the present invention are the organic catalyst compounds and compositions containing same that satisfy the conditions outlined in Test Protocols I, II and/or III, disclosed hereinafter.

Preferably, the organic catalyst compounds of the present invention, more preferably the iminium-based organic catalyst compounds of the present invention, include, but are not limited to, bleach boosting compounds, modified amines, modified amine oxides, sulfonimines, phosphinimes, thiodiazole dioxides and mixtures thereof.

I. Bleach Boosting Compounds—The bleach boosting compounds, preferably iminium-based bleach boosting compounds, of the present invention include, but are not limited to, aryliminium cations, aryliminium polyions, which have a net charge of from about +3 to about −3, and aryliminium zwitterions, which have a net charge of from about +3 to about −3.

A preferred organic catalyst in accordance with the present invention and for use in the bleaching compositions of the present invention is a bleach boosting compound selected from aryliminium zwitterions or its oxaziridinium bleaching species because unlike aryliminium cations and/or oxaziridinium cations, the zwitterions provide effective bleaching without resulting in unacceptable level of color damage on fabrics.

a. Aryliminium Cations and Polyions—The aryliminium cations and aryliminium polyions, which have a net charge of from about +3 to about −3, are represented by the formula [I]:

[I]

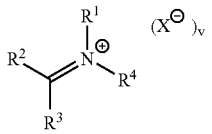

where $R^2$ and $R^3$ are independently selected from substituted or unsubstituted, saturated or unsaturated radicals selected from the group consisting of H, alkyl, cycloalkyl, aryl, alkaryl, aralkyl, heterocyclic ring, silyl, nitro, halo, cyano, sulfonato, alkoxy, keto, carboxylic, and carboalkoxy radicals; $R^1$ and $R^4$ are selected from substituted or unsubstituted, saturated or unsaturated radicals selected from the group consisting of H, alkyl, cycloalkyl, aryl, alkaryl, aralkyl, heterocyclic ring, silyl, nitro, halo, cyano, alkoxy, keto and carboalkoxy radicals; and $X^-$ is a suitable charge-balancing, preferably bleach-compatible counterion; and v is an integer from 1 to 3.

Preferably, the aryliminium cations and aryliminium polyions, which have a net charge of from about +3 to about −3, are represented by the formula [XI]:

[XI]

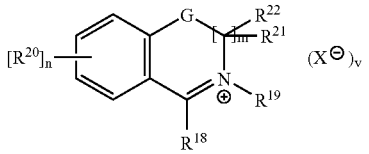

where m is 1 to 3 when G is present and m is 1 to 4 when G is not present; and n is an integer from 0 to 4; each $R^{20}$ is independently selected from a substituted or unsubstituted radical selected from the group consisting of H, alkyl, cycloalkyl, aryl, fused aryl, heterocyclic ring, fused heterocyclic ring, nitro, halo, cyano, sulfonato, alkoxy, keto, carboxylic, and carboalkoxy radicals, and any two vicinal $R^{20}$ substituents may combine to form a fused aryl, fused carbocyclic or fused heterocyclic ring; $R^{18}$ may be a substituted or unsubstituted radical selected from the group consisting of H, alkyl, cycloalkyl, alkaryl, aryl, aralkyl, heterocyclic ring, silyl, nitro, halo, cyano, sulfonato, alkoxy, keto, carboxylic, and carboalkoxy radicals; $R^{19}$ is a radical selected from the group consisting of substituted or unsubstituted, saturated or unsaturated, H, alkyl, cycloalkyl, alkaryl, aryl, aralkyl and heterocyclic ring; G is selected from the group consisting of: (1) —O—; (2) —N($R^{23}$)—; and (3) —N($R^{23}R^{24}$)—; $R^{21}$–$R^{24}$ are substituted or unsubstituted radicals independently selected from the group consisting of H, oxygen, linear or branched $C_1$–$C_{12}$ alkyls, alkylenes, alkoxys, aryls, alkaryls, aralkyls, cycloalkyls, and heterocyclic rings; provided that any of $R^{18}$, $R^{19}$, $R^{20}$, $R^{21}$–$R^{24}$ may be joined together with any other of $R^{18}$, $R^{19}$, $R^{20}$, $R^{21}$–$R^{24}$ to form part of a common ring; any geminal $R^{21}$–$R^{22}$ may combine to form a carbonyl; any vicinal $R^{21}$–$R^{24}$ may join to form unsaturation; and wherein any one group of substituents $R^{21}$–$R^{24}$ may combine to form a substituted or unsubstituted fused unsaturated moiety; $X^-$ is a suitable charge-balancing counterion, preferably a bleach-compatible counterion; and v is an integer from 1 to 3.

More preferred, aryliminium cations and aryliminium polyions, which have a net charge of from about +3 to about −3, as represented by the formula [XI], include those of formula [XI] where $R^{18}$ is H or methyl and $R^{19}$ is H or substituted or unsubstituted, saturated or unsaturated $C_1$–$C_{14}$ alkyl.

b. Aryliminium Zwitterions—The aryliminium zwitterions, which have a net charge of from about +3 to about −3, are represented by the formula [II]:

[II]

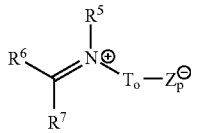

where $R^5$–$R^7$ are independently selected from substituted or unsubstituted radicals selected from the group consisting of H, alkyl, cycloalkyl, aryl, alkaryl, aralkyl, heterocyclic ring, silyl, nitro, halo, cyano, sulfonato, alkoxy, keto, carboxylic, and carboalkoxy radicals; also present in this formula is the radical represented by the formula:

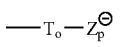

where $Z_p^-$ is covalently bonded to $T_o$, and $Z_p^-$ is selected from the group consisting of —$CO_2^-$, —$SO_3^-$, —$OSO_3^-$, —$SO_2^-$ and —$OSO_2^-$ and p is either 1, 2 or 3; $T_o$ is selected from the group consisting of substituted or unsubstituted, saturated or unsaturated alkyl, cycloalkyl, aryl, alkaryl, aralkyl, and heterocyclic ring.

Preferably, the aryliminium zwitterions, which have a net charge of from about +3 to about −3, are represented by the formula [XII]:

[XII]

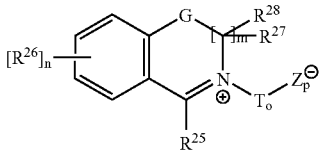

where m is 1 to 3 when G is present and m is 1 to 4 when G is not present; and n is an integer from 0 to 4; each $R^{26}$ is independently selected from a substituted or unsubstituted radical selected from the group consisting of H, alkyl, cycloalkyl, aryl, fused aryl, heterocyclic ring, fused heterocyclic ring, nitro, halo, cyano, sulfonato, alkoxy, keto, carboxylic, and carboalkoxy radicals, and any two vicinal $R^{26}$ substituents may combine to form a fused aryl, fused carbocyclic or fused heterocyclic ring; $R^{25}$ may be a substituted or unsubstituted radical selected from the group consisting of H, alkyl, cycloalkyl, alkaryl, aryl, aralkyl, heterocyclic ring, silyl, nitro, halo, cyano, sulfonato, alkoxy, keto, carboxylic, and carboalkoxy radicals; also present in this formula is the radical represented by the formula:

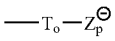

where $Z_p^-$ is covalently bonded to $T_o$, and $Z_p^-$ is selected from the group consisting of —$CO_2^-$, —$SO_3^-$, —$OSO_3^-$, —$SO_2^-$ and —$OSO_2^-$ and p is either 1, 2 or 3; $T_o$ is selected from the group consisting of:

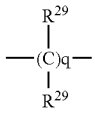

wherein q is an integer from 1 to 8; $R^{29}$ is independently selected from substituted or unsubstituted radicals selected from the group consisting of linear or branched H, alkyl, cycloalkyl, alkaryl, aryl, aralkyl, alkylene, heterocyclic ring, alkoxy, arylcarbonyl, carboxyalkyl and amide groups; G is selected from the group consisting of: (1) —O—; (2) —N($R^{30}$)—; and (3) —N($R^{30}R^{31}$)—; $R^{27}$, $R^{28}$, $R^{30}$ and $R^{31}$ are substituted or unsubstituted radicals independently selected from the group consisting of H, oxygen, alkyl, cycloalkyl, alkaryl, aryl, aralkyl, alkylenes, heterocyclic ring, alkoxys, arylcarbonyl groups, carboxyalkyl groups and amide groups; any of $R^{25}$, $R^{26}$, $R^{27}$, $R^{28}$, $R^{30}$ and $R^{31}$ may be joined together with any other of $R^{25}$, $R^{26}$, $R^{27}$, $R^{28}$, $R^{30}$ and $R^{31}$ to form part of a common ring; any geminal $R^{27}$–$R^{28}$ may combine to form a carbonyl; any vicinal $R^{27}$–$R^{31}$ may join to form unsaturation; and wherein any one group of substituents $R^{27}$–$R^{31}$ may combine to form a substituted or unsubstituted fused unsaturated moiety.

More preferred aryliminium zwitterions, which have a net charge of from about +3 to about −3, as represented by the formula [XII], include those of formula [XII] where $R^{25}$ is H or methyl, and for the radical represented by the formula:

$$—T_o—Z_p^{\ominus}$$

$Z_p^-$ is $—CO_2^-$, $—SO_3^-$ or $—OSO_3^-$, and p is 1 or 2, even more preferably $Z_p^-$ is $—SO_3^-$ or $—OSO_3^-$ and p is 1.

II. Modified Amine/Amine Oxide Compounds—The modified amine and/or amine oxide compounds of the present invention include, but are not limited to, modified amines and modified amine oxides having a net charge of from about +3 to about −3.

a. Modified Amines—The modified amines are represented by formulas [V] and [VI]:

[V]

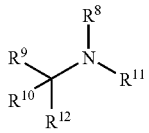

[VI]

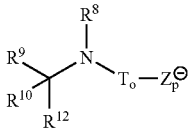

where $R^9$–$R^{10}$ are independently selected from substituted or unsubstituted radicals selected from the group consisting of H, alkyl, cycloalkyl, aryl, alkaryl, aralkyl, heterocyclic ring, silyl, nitro, halo, cyano, sulfonato, alkoxy, keto, carboxylic, and carboalkoxy radicals and anionic and/or cationic charge carrying radicals; $R^8$ and $R^{11}$, when present, are radicals selected from the group consisting of substituted or unsubstituted, saturated or unsaturated H, alkyl, cycloalkyl, aryl, alkaryl, aralkyl, heterocyclic ring, silyl, nitro, halo, cyano, alkoxy, keto and carboalkoxy radicals and anionic and/or cationic charge carrying radicals; $R^{12}$ is a leaving group, the protonated form of which has a $pK_\alpha$ value ($H_2O$ reference) that falls within the following range: $37>pK_\alpha>-2$; with the proviso that any $R^8$–$R^{12}$, when present, may combine to form a fused aryl, fused carbocyclic or fused heterocyclic ring; and also present in this formula is the radical represented by the formula:

$$—T_o—Z_p^{\ominus}$$

where $Z_p^-$ is covalently bonded to $T_o$, and $Z_p^-$ is selected from the group consisting of $—CO_2^-$, $—SO_3^-$, $—OSO_3^-$, $—SO_2^-$ and $—OSO_2^-$ and p is either 1, 2 or 3; $T_o$ is selected from the group consisting of substituted or unsubstituted, saturated or unsaturated alkyl, cycloalkyl, aryl, alkaryl, aralkyl, and heterocyclic ring.

Preferably, the modified amines are represented by the formulas [XV] and [XVI]:

[XV]

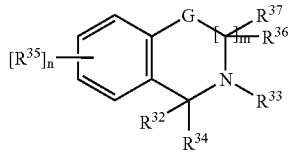

[XVI]

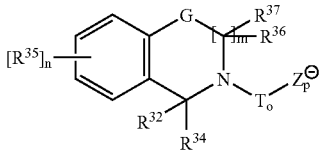

where m is 1 to 3 when G is present and m is 1 to 4 when G is not present; and n is an integer from 0 to 4; $R^{34}$ is a radical selected from the group consisting of substituted or unsubstituted, saturated or unsaturated hydroxy, perhydroxy, alkoxy, peralkoxy, carboxylic, percarboxylic, sulfonato, and persulfonato radicals; each $R^{35}$ is independently selected from a substituted or unsubstituted radical selected from the group consisting of H, alkyl, cycloalkyl, aryl, fused aryl, heterocyclic ring, fused heterocyclic ring, nitro, halo, cyano, sulfonato, alkoxy, keto, carboxylic, and carboalkoxy radicals, and any two vicinal $R^{35}$ substituents may combine to form a fused aryl, fused carbocyclic or fused heterocyclic ring; $R^{32}$ may be a substituted or unsubstituted radical selected from the group consisting of H, alkyl, cycloalkyl, alkaryl, aryl, aralkyl, heterocyclic ring, silyl, nitro, halo, cyano, sulfonato, alkoxy, keto, carboxylic, and carboalkoxy radicals; $R^{33}$ may be a substituted or unsubstituted, saturated or unsaturated, radical selected from the group consisting of H, alkyl, cycloalkyl, alkaryl, aryl, aralkyl, heterocyclic ring, and also present in this formula is the radical represented by the formula:

$$—T_o—Z_p^{\ominus}$$

where $Z_p^-$ is covalently bonded to $T_o$, and $Z_p^-$ is selected from the group consisting of $—CO_2^-$, $—SO_3^-$, $—OSO_3^-$, $—SO_2^-$ and $—OSO_2^-$, and p is either 1, 2 or 3; $T_o$ is selected from the group consisting of:

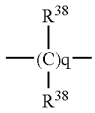

wherein q is an integer from 1 to 8; $R^{38}$ is independently selected from substituted or unsubstituted radicals selected from the group consisting of linear or branched H, alkyl, cycloalkyl, alkaryl, aryl, aralkyl, alkylene, heterocyclic ring, alkoxy, arylcarbonyl, carboxyalkyl and amide groups; G is selected from the group consisting of: (1) —O—; (2) $—N(R^{39})—$; and (3) $—N(R^{39}R^{40})—$; $R^{36}$, $R^{37}$, $R^{39}$ and $R^{40}$ are substituted or unsubstituted radicals independently selected from the group consisting of H, oxygen, alkyl, cycloalkyl, alkaryl, aryl, aralkyl, alkylenes, heterocyclic ring, alkoxys, arylcarbonyl groups, carboxyalkyl groups and amide groups; any of $R^{32}$, $R^{33}$, $R^{34}$, $R^{35}$, $R^{36}$, $R^{37}$, $R^{39}$ and $R^{40}$ may be joined together with any other of $R^{32}$, $R^{33}$, $R^{34}$, $R^{35}$, $R^{36}$, $R^{37}$, $R^{39}$ and $R^{40}$ to form part of a common ring; any geminal $R^{36}$–$R^{37}$ may combine to form a carbonyl; any vicinal $R^{36}$, $R^{37}$, $R^{39}$ and $R^{40}$ may join to form unsaturation; and wherein any one group of substituents $R^{36}$, $R^{37}$, $R^{39}$ and $R^{40}$ may combine to form a substituted or unsubstituted fused unsaturated moiety.

Examples of such modified amines include, but are not limited to those with an $R^{34}$ radical selected from the group consisting of substituted or unsubstituted, saturated or unsaturated hydroxy, perhydroxy, alkoxy, peralkoxy, carboxyl, percarboxyl, sulfonato and persulfonato radicals.

Preferably, the $R^{34}$ radical is selected from the group consisting of substituted or unsubstituted, saturated or unsaturated hydroxy, perhydroxy, alkoxy and peralkoxy radicals. The following examples are meant to exemplify such modified amines of the present invention, but are not necessarily meant to limit or otherwise define the scope of the invention.

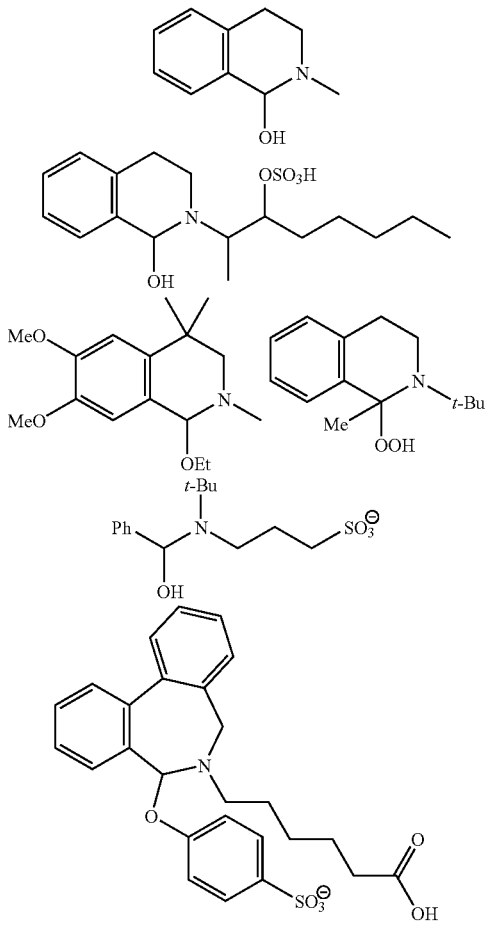

More preferably, for the modified amines represented by the formulas [XV] and [XVI], $R^{34}$ is a leaving group, the protonated form of which has a $pK_\alpha$ value ($H_2O$ reference) that fall within the following range: $30>pK_\alpha>0$; more preferably $23>pK_\alpha>3$; even more preferably $21>pK_\alpha>9$; most preferably $17>pK_\alpha>11$.

Preferably, for the modified amines represented by the formulas [XV] and [XVI], $R^{12}$ is selected from the group consisting of substituted or unsubstituted, saturated or unsaturated hydroxy, perhydroxy, alkoxy and peralkoxy radicals. More preferably, for the modified amines represented by the formulas [XV] and [XVI] wherein said $R^{12}$ is selected from the group consisting of hydroxy or perhydroxy.

Even more preferred modified amines, as represented by the formulas [XV] and [XVI], include those modified amines having a net charge of about +1 to about −1 where $R^{32}$ is H or Me; $R^{34}$ is a radical selected from the group consisting of hydroxy and perhydroxy radicals; $R^{35}$ is independently selected from the group consisting of H, alkyl, nitro, halo, sulfonato, alkoxy, carboxyl and carboalkoxy radicals and/or $Z_p^-$ is $—CO_2^-$, $—SO_3^-$ or $—OSO_3^-$.

For the modified amines, $R^{12}$ is a leaving group (LG), the protonated form of which has a $pK_\alpha$ value ($H_2O$ reference) that fall within the following range: $37>pK_\alpha>-2$; preferably $30>pK_\alpha>0$; more preferably $23>pK_\alpha>3$; even more preferably $17>pK_\alpha>11$; most preferably $R^{12}$ is a leaving group consisting of substituted or unsubstituted, saturated or unsaturated hydroxy, perhydroxy, alkoxy and peralkoxy radicals; and any $R^8$–$R^{12}$ may combine to form a fused aryl, fused carbocyclic or fused heterocyclic ring.

b. Modified Amine Oxides—The modified amine oxides of the present invention are represented by formulas [VII]–[X]:

[VII]

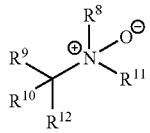

[VIII]

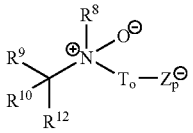

[IX]

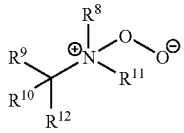

[X]

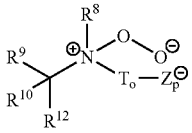

where $R^8$–$R^{10}$ are independently selected from substituted or unsubstituted radicals selected from the group consisting of H, alkyl, cycloalkyl, aryl, alkaryl, aralkyl, heterocyclic ring, silyl, nitro, halo, cyano, sulfonato, alkoxy, keto, carboxyl, and carboalkoxy radicals and anionic and/or cationic charge carrying radicals; $R^{11}$ is a radical selected from the group consisting of substituted or unsubstituted, saturated or unsaturated H, alkyl, cycloalkyl, aryl, alkaryl, aralkyl, heterocyclic ring, silyl, nitro, halo, cyano, sulfonato, alkoxy, keto, carboxyl, and carboalkoxy radicals and anionic and/or cationic charge carrying radicals; $R^{12}$ is a leaving group, the protonated form of which has a $pK_\alpha$ value ($H_2O$ reference) that falls within the following range: $37>pK_\alpha>-2$; with the proviso that any $R^8$–$R^{12}$, when present, may combine to form a fused aryl, fused carbocyclic or fused heterocyclic ring; and also present in this formula is the radical represented by the formula:

$$—T_o—Z_p^{\ominus}$$

where $Z_p^-$ is covalently bonded to $T_o$, and $Z_p^-$ is selected from the group consisting of $—CO_2^-$, $—SO_3^-$, $—OSO_3^-$, $—SO_2^-$ and $—OSO_2^-$ and p is either 1, 2 or 3; $T_o$ is selected from the group consisting of substituted or unsubstituted, saturated or unsaturated alkyl, cycloalkyl, aryl, alkaryl, aralkyl, and heterocyclic ring.

Preferably, for the modified amine oxides represented by the formulas [VII]–[X], $R^{12}$ is a leaving group, the protonated form of which has a $pK_\alpha$ value ($H_2O$ reference) that fall within the following range: $30>pK_\alpha>0$; more preferably $23>pK_\alpha>3$; even more preferably $21>pK_\alpha>9$; most preferably $17>pK_\alpha>11$.

Preferably, for the modified amine oxides represented by the formulas [VII] to [X], $R^{12}$ is selected from the group consisting of substituted or unsubstituted, saturated or unsaturated hydroxy, perhydroxy, alkoxy and peralkoxy radicals. More preferably, for the modified amine oxides represented by the formulas [VII] to [X], $R^{12}$ is selected from the group consisting of hydroxy or perhydroxy.

Also preferably, the modified amine oxides are represented by formulas [XVII]–[XX]:

[XVII]

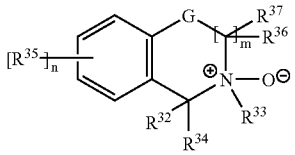

[XVIII]

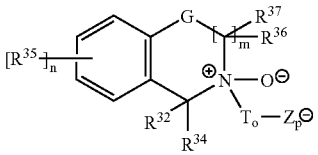

[XIX]

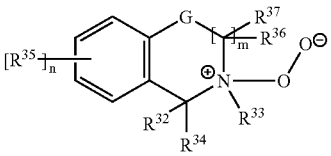

[XX]

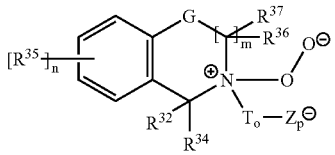

where m is 1 to 3 when G is present and m is 1 to 4 when G is not present; and n is an integer from 0 to 4; $R^{34}$ is a radical selected from the group consisting of substituted or unsubstituted, saturated or unsaturated hydroxy, perhydroxy, alkoxy, peralkoxy, carboxyl, percarboxyl, sulfonato, persulfonato radicals; each $R^{35}$ is independently selected from a substituted or unsubstituted radical selected from the group consisting of H, alkyl, cycloalkyl, aryl, fused aryl, heterocyclic ring, fused heterocyclic ring, nitro, halo, cyano, sulfonato, alkoxy, keto, carboxyl, and carboalkoxy radicals, and any two vicinal $R^{35}$ substituents may combine to form a fused aryl, fused carbocyclic or fused heterocyclic ring; $R^{32}$ may be a substituted or unsubstituted radical selected from the group consisting of H, alkyl, cycloalkyl, alkaryl, aryl, aralkyl, heterocyclic ring, silyl, nitro, halo, cyano, sulfonato, alkoxy, keto, carboxyl, and carboalkoxy radicals; $R^{33}$ may be a substituted or unsubstituted, saturated or unsaturated, radical selected from the group consisting of H, alkyl, cycloalkyl, alkaryl, aryl, aralkyl, heterocyclic ring, and also present in this formula is the radical represented by the formula:

$$—T_o—Z_p^{\ominus}$$

where $Z_p^-$ is covalently bonded to $T_o$, and $Z_p^-$ is selected from the group consisting of $—CO_2^-$, $—SO_3^-$, $—OSO_3^-$, $—SO_2^-$ and $—OSO_2^-$, and p is either 1, 2 or 3; $T_o$ is selected from the group consisting of:

$$—\underset{\underset{R^{38}}{|}}{\overset{\overset{R^{38}}{|}}{(C)q}}—$$

wherein q is an integer from 1 to 8; $R^{38}$ is independently selected from substituted or unsubstituted radicals selected from the group consisting of linear or branched H, alkyl, cycloalkyl, alkaryl, aryl, aralkyl, alkylene, heterocyclic ring, alkoxy, arylcarbonyl, carboxyalkyl and amide groups; G is selected from the group consisting of: (1) —O—; (2) $—N(R^{39})—$; and (3) $—N(R^{39}R^{40})—$; $R^{36}$, $R^{37}$, $R^{39}$ and $R^{40}$ are substituted or unsubstituted radicals independently selected from the group consisting of H, oxygen, alkyl, cycloalkyl, alkaryl, aryl, aralkyl, alkylenes, heterocyclic ring, alkoxys, arylcarbonyl groups, carboxyalkyl groups and amide groups; any of $R^{32}$, $R^{33}$, $R^{34}$, $R^{35}$, $R^{36}$, $R^{37}$, $R^{39}$ and $R^{40}$ may be joined together with any other of $R^{32}$, $R^{33}$, $R^{34}$, $R^{35}$, $R^{36}$, $R^{37}$, $R^{39}$ and $R^{40}$ to form part of a common ring; any geminal $R^{36}$–$R^{37}$ may combine to form a carbonyl; any vicinal $R^{36}$, $R^{37}$, $R^{39}$ and $R^{40}$ may join to form unsaturation; and wherein any one group of substituents $R^{36}$, $R^{37}$, $R^{39}$ and $R^{40}$ may combine to form a substituted or unsubstituted fused unsaturated moiety;

Examples of such modified amine oxides include, but are not limited to those with an $R^{34}$ radical selected from the group consisting of substituted or unsubstituted, saturated or unsaturated hydroxy, perhydroxy, alkoxy, peralkoxy, carboxyl, percarboxyl, sulfonato and persulfonato radicals.

Preferably, the $R^{34}$ radical is selected from the group consisting of substituted or unsubstituted, saturated or unsaturated hydroxy, perhydroxy, alkoxy and peralkoxy radicals.

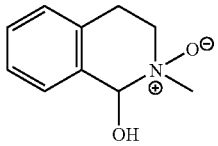

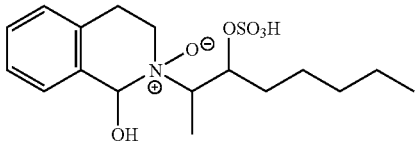

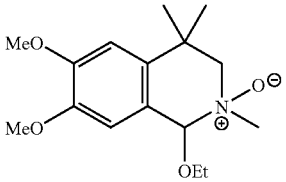

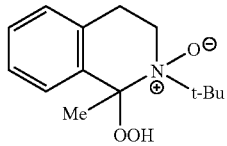

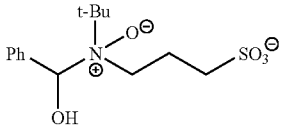

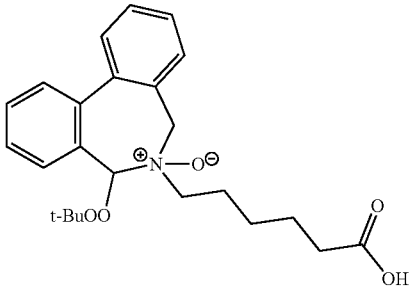

More preferably, for the modified amine oxides represented by the formulas [XVII] and [XX], $R^{34}$ is a leaving group, the protonated form of which has a $pK_\alpha$ value ($H_2O$ reference) that fall within the following range: $30>pK_\alpha>0$; more preferably $23>pK_\alpha>3$; even more preferably $21>pK_\alpha>9$; most preferably $17>pK_\alpha>11$.

Preferably, for the modified amine oxides represented by the formulas [XVII] to [XX], $R^{34}$ is selected from the group consisting of substituted or unsubstituted, saturated or unsaturated hydroxy, perhydroxy, alkoxy and peralkoxy radicals. More preferably, for the modified amine oxides represented by the formulas [XVII] to [XX], $R^{34}$ is selected from the group consisting of hydroxy or perhydroxy.

Even more preferred modified amine oxides, as represented by the formulas [XVII] and [XX], include those modified amine oxides having a net charge of about +1 to about −1 where $R^{32}$ is H or Me; $R^{34}$ is a radical selected from the group consisting of hydroxy and perhydroxy radicals; $R^{35}$ is independently selected from the group consisting of H, alkyl, nitro, halo, sulfonato, alkoxy, carboxyl and carboalkoxy radicals and/or $Z_p^-$ is $—CO_2^-$, $—SO_3^-$ or $—OSO_3^-$.

For the modified amine oxides, $R^{12}$ is a leaving group (LG), the protonated form of which has a $pK_\alpha$ value ($H_2O$ reference) that fall within the following range: $37>pK_\alpha>-2$; preferably $30>pK_\alpha>0$; more preferably $23>pK_\alpha>3$; even more preferably $17>pK_\alpha>11$; most preferably $R^{12}$ is a leaving group consisting of substituted or unsubstituted, saturated or unsaturated hydroxy, perhydroxy, alkoxy and peralkoxy radicals; and any $R^8$–$R^{12}$ may combine to form a fused aryl, fused carbocyclic or fused heterocyclic ring.

Nonlimiting examples of suitable modified amine compounds (modified amines and/or modified amine oxides) (and the $pK_\alpha$ ($H_2O$ reference) value of the protonated form of $R^{12}$) in accordance with the present invention include, but are not limited to:

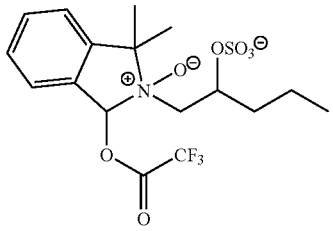

$pK_a = -0.25$

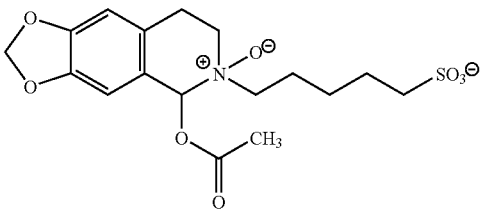

$pK_a = 4.76$

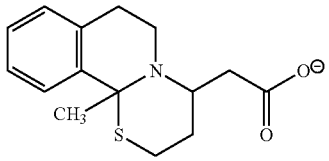

$pK_a \sim 10.5$

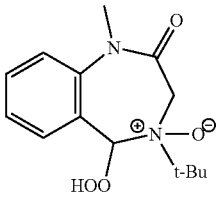

$pK_a \sim 11.6$

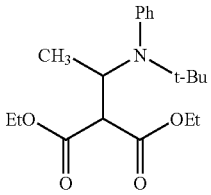

$pK_a \sim 13$

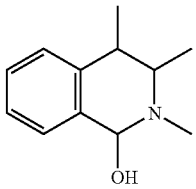

$pK_a \sim 15.7$

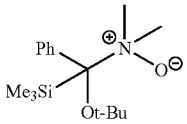

$pK_a \sim 20$

-continued

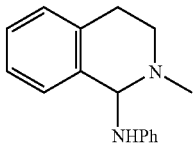

$pK_a \sim 28$

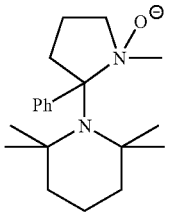

$pK_a \sim 37$

The modified amine compounds of the present invention act in conjunction with the peroxygen source to provide a more effective bleaching system. Peroxygen sources are well-known in the art and the peroxygen source employed in the present invention may comprise any of these well known sources, including peroxygen compounds as well as compounds which under consumer use conditions provide an effective amount of peroxygen in situ. The peroxygen source may include a hydrogen peroxide source, the in situ formation of a peracid anion through the reaction of a hydrogen peroxide source and a bleach activator, preformed peracid compounds or mixtures of suitable peroxygen sources. Of course, one of ordinary skill in the art will recognize that other sources of peroxygen may be employed without departing from the scope of the invention. Preferably, the peroxygen source is an organic and/or an inorganic peracid.

IV. Sulfonimines, Phosphonimines, N-Acylimines, Thiodiazole Dioxides—The sulfonimines, phosphonimines, N-acylimines and thiodiazole dioxides of the present invention are represented by the formulas [XXIa], [XXIb], [XXIII] and [XXIII], respectively:

[XXIa]

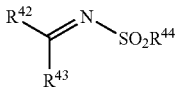

[XXIb]

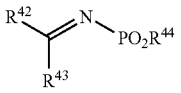

[XXII]

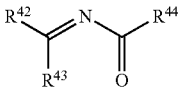

[XXIII]

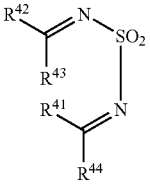

where $R^{41}$–$R^{44}$, when present, are independently selected from substituted or unsubstituted, saturated or unsaturated radicals selected from the group consisting of H, alkyl, cycloalkyl, aryl, alkaryl, aralkyl, heterocyclic ring, silyl, nitro, halo, cyano, sulfonato, alkoxy, keto, carboxylic, and carboalkoxy radicals; provided that any of $R^{41}$–$R^{44}$ may be joined together with any other $R^{41}$–$R^{44}$ to form part of a common ring, including a fused aryl, fused carbocyclic or fused heterocyclic ring.

II. Bleaching Species—The bleaching species (oxaziridiniums, oxaziridines) may also be used directly in accordance with the present invention. The bleaching species of the present invention include, but are not limited to, oxaziridinium cations, oxaziridinium polyions, which have a net charge of from about +3 to about −3, oxaziridinium zwitterions, which have a net charge of from about +3 to about −3, oxaziridine sulfonimines, oxaziridine phosphonimines, oxaziridine thiodiazole dioxides, and mixtures thereof.

The organic catalysts, especially the aryliminium cations, aryliminium polyions, aryliminium zwitterions, sulfonimines, phosphonimines, thiodiazole dioxides of the present invention act in conjunction with a peroxygen source, when present to increase bleaching effectiveness. Without being bound by theory, it is believed that the organic catalysts react with the peroxygen source to form a more active bleaching species, a quaternary oxaziridinium and/or oxaziridine compounds, as represented by the following reaction by way of example:

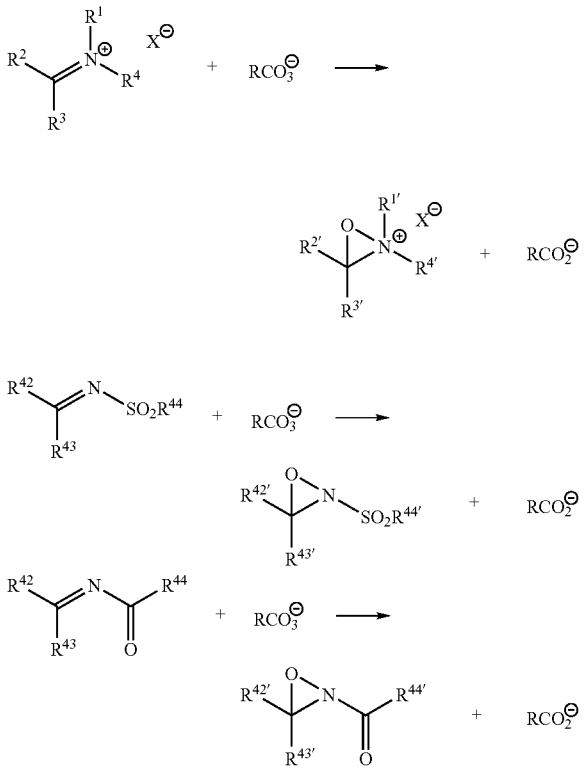

The oxaziridinium and/or oxaziridine compounds can have an increased or preferred activity at lower temperatures relative to the peroxygen compound.

a. Oxaziridinium Cations and Polyions—The oxaziridinium cations and polyions, which have a net charge of from about +3 to about −3, are represented by the formula [III]:

[III]

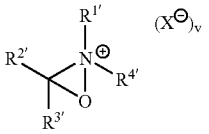

where $R^{2'}$–$R^{3'}$ are independently selected from substituted or unsubstituted radicals selected from the group consisting of H, alkyl, cycloalkyl, aryl, alkaryl, aralkyl, heterocyclic ring, silyl, nitro, halo, cyano, sulfonato, alkoxy, keto, carboxylic, and carboalkoxy radicals; $R^{1'}$ and $R^{4'}$ are radicals selected from the group consisting of substituted or unsubstituted, saturated or unsaturated, H, alkyl, cycloalkyl, aryl, alkaryl, aralkyl, heterocyclic ring, silyl, nitro, halo, cyano, alkoxy, keto and carboalkoxy radicals; and $X^-$ is a suitable charge-balancing counterion, preferably a bleach-compatible counterion; and v is an integer from 1 to 3.

Preferably, the oxaziridinium cations and polyions, which have a net charge of from about +3 to about −3, are represented by formula [XIII]:

[XIII]

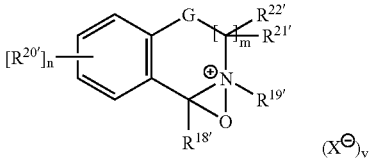

wherein m is 1 to 3 when G is present and m is 1 to 4 when G is not present; and n is an integer from 0 to 4; each $R^{20'}$ is independently selected from a substituted or unsubstituted radical selected from the group consisting of H, alkyl, cycloalkyl, aryl, fused aryl, heterocyclic ring, fused heterocyclic ring, nitro, halo, cyano, sulfonato, alkoxy, keto, carboxylic, and carboalkoxy radicals, and any two vicinal $R^{20'}$ substituents may combine to form a fused aryl, fused carbocyclic or fused heterocyclic ring; $R^{18'}$ may be a substituted or unsubstituted radical selected from the group consisting of H, alkyl, cycloalkyl, alkaryl, aryl, aralkyl, heterocyclic ring, silyl, nitro, halo, cyano, sulfonato, alkoxy, keto, carboxylic, and carboalkoxy radicals; $R^{19'}$ may be a substituted or unsubstituted, saturated or unsaturated, radical selected from the group consisting of H, alkyl, cycloalkyl, alkaryl, aryl, aralkyl and heterocyclic ring. G is selected from the group consisting of: (1) —O—; (2) —N($R^{23'}$)—; and (3) —N($R^{23'}R^{24'}$)—; $R^{2'}$–$R^{24'}$ are substituted or unsubstituted radicals independently selected from the group consisting of H, oxygen, linear or branched $C_1$–$C_{12}$ alkyls, alkylenes, alkoxys, aryls, alkaryls, aralkyls, cycloalkyls, and heterocyclic rings; provided that any of $R^{18'}$, $R^{19'}$, $R^{21'}$–$R^{24'}$ may be joined together with any other of $R^{18'}$, $R^{19'}$, $R^{21'}$–$R^{24'}$ to form part of a common ring; any geminal $R^{21'}$–$R^{22'}$ may combine to form a carbonyl; any vicinal $R^{21'}$–$R^{24'}$ may join to form unsaturation; and wherein any one group of substituents $R^{21'}$–$R^{24'}$ may combine to form a substituted or unsubstituted fused unsaturated moiety; and wherein any one group of substituents $R^{2'}$–$R^{24'}$ may combine to form a substituted or unsubstituted fused unsaturated moiety; $X^-$ is a suitable charge-balancing counterion, preferably a bleach-compatible counterion; and v is an integer from 1 to 3.

More preferred oxaziridinium cations and oxaziridinium polyions, which have a net charge of from about +3 to about −3, as represented by the formula [XIII], include those of formula [XIII] where $R^{18'}$ is H or methyl, and $R^{19'}$ is H or substituted or unsubstituted, saturated or unsaturated, $C_1$–$C_{14}$ alkyl and cycloalkyl.

b. Oxaziridinium Zwitterions—The oxaziridinium zwitterions, which have a net charge of from about +3 to about −3, are represented by formula [IV]:

[IV]

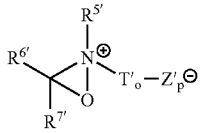

where $R^{5'}$–$R^{7'}$ are independently selected from substituted or unsubstituted radicals selected from the group consisting of H, alkyl, cycloalkyl, aryl, alkaryl, aralkyl, heterocyclic ring, silyl, nitro, halo, cyano, sulfonato, alkoxy, keto, carboxylic, and carboalkoxy radicals; also present in this formula is the radical represented by the formula:

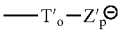

where $Z'_p^-$ is covalently bonded to $T'_o$, and $Z'_p^-$ is selected from the group consisting of —$CO_2^-$, —$SO_3^-$, —$OSO_3^-$, —$SO_2^-$ and —$OSO_2^-$ and p is either 1, 2 or 3; $T_o$ is selected from the group consisting of substituted or unsubstituted, saturated or unsaturated alkyl, cycloalkyl, aryl, alkaryl, aralkyl, and heterocyclic ring.

Preferably, the oxaziridinium zwitterions, which have a net charge of from about +3 to about −3, are represented by formula [XIV]:

[XIV]

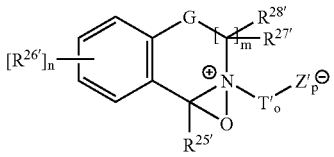

wherein m is 1 to 3 when G is present and m is 1 to 4 when G is not present; and n is an integer from 0 to 4; each $R^{26'}$ is independently selected from a substituted or unsubstituted radical selected from the group consisting of H, alkyl, cycloalkyl, aryl, fused aryl, heterocyclic ring, fused heterocyclic ring, nitro, halo, cyano, sulfonato, alkoxy, keto, carboxylic, and carboalkoxy radicals, and any two vicinal $R^{26'}$ substituents may combine to form a fused aryl, fused carbocyclic or fused heterocyclic ring; $R^{25'}$ may be a substituted or unsubstituted radical selected from the group consisting of H, alkyl, cycloalkyl, alkaryl, aryl, aralkyl, heterocyclic ring, silyl, nitro, halo, cyano, sulfonato, alkoxy, keto, carboxylic, and carboalkoxy radicals; and also present in this formula is the radical represented by the formula:

$$—T'_o—Z'^{\ominus}_p$$

where $Z'^{-}_p$ is covalently bonded to $T_o$, and $Z'^{-}_p$ is selected from the group consisting of $—CO_2^-$, $—SO_3^-$, $—OSO_3^-$, $—SO_2^-$ and $—OSO_2^-$, and a is either 1 or 2; $T'_o$ is selected from the group consisting of:

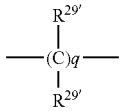

wherein q is an integer from 1 to 8; $R^{29'}$ is independently selected from substituted or unsubstituted radicals selected from the group consisting of linear or branched H, alkyl, cycloalkyl, alkaryl, aryl, aralkyl, alkylene, heterocyclic ring, alkoxy, arylcarbonyl, carboxyalkyl and amide groups; G is selected from the group consisting of: (1) —O—; (2) $—N(R^{30'})—$; and (3) $—N(R^{30'}R^{31'})—$; $R^{27'}$, $R^{28'}$, $R^{30'}$ and $R^{31'}$ are substituted or unsubstituted radicals independently selected from the group consisting of H, oxygen, alkyl, cycloalkyl, alkaryl, aryl, aralkyl, alkylenes, heterocyclic ring, alkoxys, arylcarbonyl groups, carboxyalkyl groups and amide groups; any of $R^{25'}$, $R^{26'}$, $R^{27'}$, $R^{28'}$, $R^{30'}$ and $R^{31'}$ may be joined together with any other of $R^{25'}$, $R^{26'}$, $R^{27'}$, $R^{28'}$, $R^{30'}$ and $R^{31'}$ to form part of a common ring; any geminal $R^{27'}$–$R^{28'}$ may combine to form a carbonyl; any vicinal $R^{27'}$–$R^{31'}$ may join to form unsaturation; and wherein any one group of substituents $R^{27'}$–$R^{31'}$ may combine to form a substituted or unsubstituted fused unsaturated moiety.

More preferred aryliminium zwitterions, which have a net charge of from about +3 to about −3, as represented by the formula [XIV], include those of formula [XIV] where $R^{25'}$ is H or methyl, and for the radical represented by the formula:

$$—T'_o—Z'^{\ominus}_p$$

$Z'^{-}_p$ is $—CO_2^-$, $—SO_3^-$ or $—OSO_3^-$, and p is 1 or 2.

c) Oxaziridine Sulfonimines, Phosphonimines, N-Acylimines, Thiodiazole Dioxides—The oxaziridine sulfonimines [XXIVa], phosphonimines [XXIVb], N-acylimines [XXV] and thiodiazole dioxides [XXVI] and [XXVII] are represented as follows:

[XXIVa]

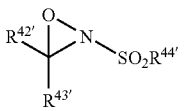

[XXIVb]

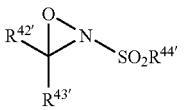

-continued

[XXV]

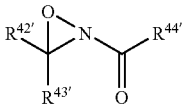

[XXVI]

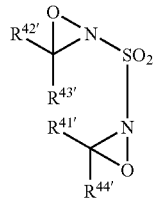

[XXVII]

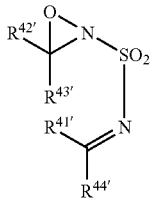

where $R^{41'}$–$R^{44'}$, when present, are independently selected from substituted or unsubstituted radicals selected from the group consisting of H, alkyl, cycloalkyl, aryl, alkaryl, aralkyl, heterocyclic ring, silyl, nitro, halo, cyano, sulfonato, alkoxy, keto, carboxylic, carboalkoxy radicals, provided that any of $R^{41'}$–$R^{44'}$ may be joined together with any other $R^{41'}$–$R^{44'}$ to form part of a common ring, including a fused aryl, fused carbocyclic or fused heterocyclic ring.

Suitable examples of $X^-$, an anionic counterion, include, but are not limited to: $BF_4^-$, $OTS^-$, and other anionic counterions disclosed in WO 97/06147, WO 95/13352, WO 95/13353, WO 95/13351, WO 98/23717, U.S. Pat. Nos. 5,360,568, 5,360,569, 5,482,515, 5,550,256, 5,478,357, 5,370,826, 5,442,066, EP 728 182 B1 and UK 1 215 656. Preferably, the anionic counterion is bleach-compatible.

For any structures that carry no net charge, no counterions are associated with the compound.

For any structures that carry a net negative charge, suitable examples of $X^+$, a cationic counterion include, but are not limited to $Na^+$, $K^+$, $H^+$.

For any structures that carry a net multiple charge, suitable examples of anionic and cationic counterions include, but are not limited to those described above.

Other Organic Catalyst Compounds—In addition to the bleach boosting compounds, bleaching species and modified amines and amine oxides disclosed above, organic catalyst compounds can be any compound known in the art that is capable of reacting with a peracid to form an oxygen transfer agent (a bleach).

Concentration of Organic Catalyst Compounds—The organic catalyst compounds of the present invention may be added to a wash solution in levels of from about 0.00001% (0.0001 ppm) to about 10% (100 ppm) by weight of the composition, and preferably from about 0.0001% (0.001 ppm) to about 2% (20 ppm) by weight of the composition, more preferably from about 0.005% (0.05 ppm) to about 0.5% (5 ppm), even more preferably from about 0.01% (0.1 ppm) to about 0.2% (2 ppm). Most preferably from about 0.02% (0.2 ppm) to about 0.1% (1 ppm).

Preferably, the bleaching compositions of the present invention bleach composition comprise an amount of organic catalyst compound such that the resulting concentration of the bleach boosting compound in a wash solution is from about 0.001 ppm to about 5 ppm.

Further, preferably the bleach compositions of the present invention comprise an amount of peroxygen compound, when present, and an amound of organic catalyst compound, such that the resulting molar ratio of said peroxygen compound to organic catalyst compound in a wash solution is preferably greater than 1:1, more preferably greater than 10:1, even more preferably greater than 50:1. The preferred molar ratio ranges of peroxygen compound to cationic organic catalyst compound range from about 30,000:1 to about 10:1, even more preferably from about 10,000:1 to about 50:1, yet even more preferably from about 5,000:1 to about 100:1, still even more preferably from about 3,500:1 to about 150:1.

The conversion values (in ppm) are provided for exemplary purposes, based on an in-use product concentration of 1000 ppm. A 1000 ppm wash solution of a product containing 0.2% organic catalyst compound by weight results in a organic catalyst compound concentration of 2 ppm. Similarly, a 3500 ppm wash solution of a product containing 0.2% organic catalyst compound by weight results in a organic catalyst compound concentration of 6.5 ppm.

The method for delivering organic catalyst compounds of the present invention and the method for delivering bleaching compositions (products) containing such organic catalyst compounds that are particularly useful in the methods of the present invention are the organic catalyst compounds and compositions containing same that satisfy the preferred method for bleaching a stained substrate in an aqueous medium with a peroxygen source and with an organic catalyst compound whose structures is defined herein and wherein said medium contains active oxygen from the peroxygen compound from about 0.05 to about 250 ppm per liter of medium, and said organic catalyst compound from 0.001 ppm to about 5 ppm, preferably from about 0.01 ppm to about 3 ppm, more preferably from about 0.1 ppm to about 2 ppm, and most preferably from about 0.2 ppm to about 1 ppm.

Such a preferred method for bleaching a stained substrate in an aqueous medium with a peroxygen source and with an organic catalyst compound is of particular value for those applications in which the color safety of the stained substrate in need of cleaning is a concern. In such applications the preferred embodiment (e.g., 0.01 ppm to about 3 ppm) is of particular importance in terms of achieving acceptable fabric color safety. For other applications in which color safety of the stained substrate in need of cleaning is of less concern, a higher in-use concentration may be preferred.

Decomposition of Organic Catalysts

The organic catalysts, specifically the bleach boosting compounds of the present invention are susceptible to decomposition by various decomposition pathways including, but not limited to, the aromatization pathway. The aromatization (decomposition) reaction: of 6-membered ring bleach boosting compounds is well known in the art, as exemplified, without being limited by theory, in Hanquet et al., *Tetrahedron* 1993, 49, pp. 423–438 and as set forth below:

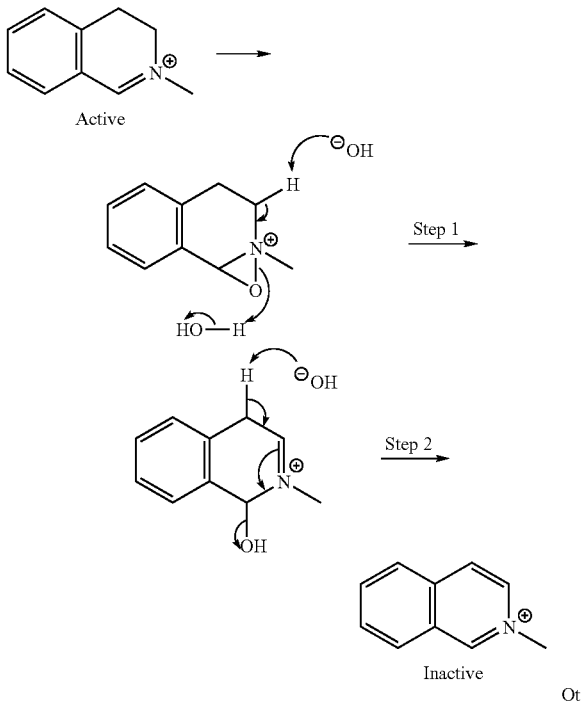

her means of decomposition include, but are not limited to, attack on the bleach boosting compound and/or on the bleaching species by nucleophiles, including but not limited to attack by hydroxide anion, perhydroxide anion, carboxylate anion, percarboxylate anion and other nucleophiles present under in-wash conditions. For example, and without intending to be bound by theory, the decomposition reaction of a 6-membered ring oxaziridinium, the overall process of which can lead to reduced bleaching efficiency, is exemplified as set forth below:

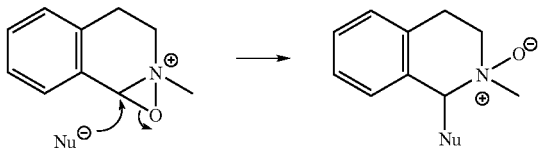

Methods for Controlled Availability of Organic Catalysts

It has been surprisingly found that an organic catalyst being available under a controlled availability method as defined in Test Protocols I, II and/or III, as disclosed hereinafter, provides enhanced bleaching performance compared to an organic catalyst being available in a non-controlled availability method as defined in Test Protocols I, II and/or III, as disclosed hereinafter, in the wash solution containing the fabric. Furthermore, it has been found that an organic catalyst being available under a controlled availability method as defined in Test Protocols I, II and/or III, as disclosed hereinafter, in a wash solution containing a peracid and a fabric in need of cleaning provides enhanced bleaching performance compared to an organic catalyst being available in a non-controlled availability method as defined in Test Protocols I, II and/or III, as disclosed hereinafter in the wash solution containing the fabric.

Any suitable means and/or method for delivering the organic catalysts of the present invention by a controlled availability method as defined in Test Protocols I, II and/or III, as disclosed hereinafter, can be used in accordance with the present invention.

Nonlimiting examples of delivery means and/or methods that fall within the scope of the present invention follow.

Delivery Means—A delivery means in accordance with the present invention can be any means that is capable of controlling the availability of an organic catalyst of the present invention such that the organic catalyst is made available in the wash solution by a controlled availability method as defined in Test Protocols I, II and/or III, as disclosed hereinafter.

Suitable delivery means include, but are not limited to, adding a controlled release material, such as an encapsulate or agglomerate or other type of controlled release material, containing an organic catalyst of the present invention wherein the controlled release material controls the availability of the organic catalyst such that the organic catalyst is made available in the wash solution by a controlled availability method as defined in Test Protocols I, II and/or III, as disclosed hereinafter. Preferably, the controlled release material controls the availability of the organic catalyst until after a peroxygen source, if any, has been released and preferably, has had time to perform bleaching and/or after the fabric has been added to the wash solution.

Adding Encapsulated Organic Catalyst—As discussed above, another suitable delivery means in accordance with the present invention is to add encapsulated organic catalysts, with or without detergent components, to a wash solution, prior to or after a peroxygen source, if any, has been added to the wash solution and/or prior to or after a fabric in need of cleaning has been added to the wash solution. Encapsulated organic catalysts can include, but are not limited to, bleaching compositions that contain the organic catalyst of the present invention, wherein the bleaching compositions resist the release of a majority of the amount of organic catalyst to a wash solution until after a peroxygen source, if any, has been released and preferably, has had time to perform bleaching and/or until after a fabric in need of cleaning has been added to the wash solution. For example, if the encapsulated organic catalyst are added to a wash solution prior to the addition of a fabric in need of cleaning to the wash solution, then the encapsulated organic catalyst resists release of the organic catalyst until after the fabric is added to the wash solution. Typically, this time period ranges from about 2 minutes, more preferably 1 minute, more preferably 1 second to about 10 minutes, preferably 7 minutes, more preferably 5 minutes. However, in rare occasions this time period can range up to 24 hours or more.

On the other hand, if the encapsulated organic catalysts are added to a wash solution containing a fabric in need of cleaning, then the encapsulated organic catalysts preferably resist release of the organic catalysts until after any peracid present in the wash solution has performed bleaching of the fabric. Typically, this time period ranges from about 2 minutes, more preferably 1 minute, more preferably 1 second to about 10 minutes, preferably 7 minutes, more preferably 5 minutes.

Any suitable encapsulation material known to those of ordinary skill in the art can be used. Examples of such suitable encapsulating materials for encapsulating the organic catalyst of the present invention include, but are not limited to, microspheres made from plastics, such as thermoplastics, acrylonitrile, methacrylonitrile, polyacrylonitrile, polymethacrylonitrile and mixtures thereof; and/or silicaceous materials such as glass. Commercially available microspheres are available from Expancel of Sweden (an Akzo Nobel company) under the trademark EXPANCEL®; PQ Corp. under the trade names PM 6545, PM 6550, PM 7220, PM 7228, EXTENDOSPHERES®, LUXSIL®, Q-CEL®, SPHERICEL®; and Malinckrodt under the trademark ALBUMEX®.

Other suitable encapsulating materials include biopolymers, such as starch, and polyethylene glycols and paraffin waxes as described in U.S. Pat. No. 5,703,034 to Offshack et al. owned by The Procter & Gamble Company.

The encapsulated organic catalysts comprise one or more of the organic catalysts of the present invention and can optionally comprise one or more of the following detergent components: filler salts, surfactants, other bleaching agents, enzymes, preferably bleach-stable enzymes, chelants, builders, dye transfer inhibiting agents, perfumes, fabric softening agents, soil release agents, and brighteners.

A nonlimiting example of a suitable form for the encapsulated organic catalyst is a gelcap.

Agglomerates Containing Organic Catalyst—As discussed above, yet another suitable delivery means in accordance with the present invention is to add an agglomerate containing the organic catalyst of the present invention to a wash solution prior to or after a peroxygen source, if any, has been added to the wash solution and/or prior to or after a fabric in need of cleaning has been added to the wash solution. Agglomerated organic catalysts can include, but are not limited to, bleaching compositions that contain the organic catalyst of the present invention, wherein the bleaching compositions resist the release of a majority of the amount of organic catalyst to a wash solution until after a peroxygen source, if any, has been released and preferably, has had time to perform bleaching and/or until after a fabric in need of cleaning has been added to the wash solution.

For example, if the agglomerate containing an amount of an organic catalyst is added to a wash solution prior to the addition of a fabric in need of cleaning to the wash solution, then the agglomerate resists release of the organic catalyst until after the fabric is added to the wash solution. Typically, this time period ranges from about 2 minutes, more preferably 1 minute, more preferably 1 second to about 10 minutes, preferably 7 minutes, more preferably 5 minutes. However, in rare occasions this time period can range up to 24 hours or more.

On the other hand, if the agglomerate containing an amount of an organic catalyst is added to a wash solution after a fabric in need of cleaning has been added to the wash solution, then the agglomerate preferably resists release of the organic catalyst until after any peracid present in the wash solution has performed bleaching of any stains on the fabric. Typically, this time period ranges from about 2 minutes, more preferably 1 minute, more preferably 1 second to about 10 minutes, preferably 7 minutes, more preferably 5 minutes.

Any suitable agglomerating material known to those of ordinary skill in the art can be used. Examples of suitable agglomerating materials for agglomerating the organic catalyst of the present invention include, but are not limited to, solid, water-soluble ionizable materials such as organic acids, organic and inorganic acid salts and mixtures thereof. Examples of such agglomerating materials are described in U.S. Pat. No. 5,540,855 to Baillely et al. and U.S. Pat. No. 5,482,642 to Agar et al., both owned by The Procter & Gamble Company.

The agglomerate containing the organic catalyst comprise one or more of the organic catalyst of the present invention and can optionally comprise one or more of the following detergent components: filler salts, surfactants, other bleaching agents, enzymes, preferably bleach-stable enzymes, chelants, builders, dye transfer inhibiting agents, perfumes, fabric softening agents, soil release agents, and brighteners.

Bleaching Compositions Comprising Organic Catalyst

In addition to the encapsulates and agglomerates discussed above, the organic catalysts of the present invention may be employed in conjunction with a peroxygen source in other bleaching compositions, regardless of their form. For example, the organic catalysts may be employed in a laundry additive product.

The bleach boosting compounds of the present invention may be employed in conjunction with or without, preferably with a peroxygen source in a bleaching composition. In the bleaching compositions of the present invention, the peroxygen source may be present in levels of from about 0.1% (1 ppm) to about 60% (600 ppm) by weight of the composition, and preferably from about 1% (10 ppm) to about 40% (400 ppm) by weight of the composition, and the organic catalyst compound may be present from about 0.00001% (0.0001 ppm) to about 10% (100 ppm) by weight of the composition, and preferably from about 0.0001% (0.001 ppm) to about 2% (20 ppm) by weight of the composition, more preferably from about 0.005% (0.05 ppm) to about 0.5% (5 ppm), even more preferably from about 0.01% (0.1 ppm) to about 0.2% (2 ppm). Most preferably from about 0.02% (0.2 ppm) to about 0.1% (1 ppm).

The conversion values (in ppm) are provided for exemplary purposes, based on an in-use product concentration of 1000 ppm. A 1000 ppm wash solution of a product containing 0.2% organic catalyst compound by weight results in a organic catalyst compound concentration of 2 ppm. Similarly, a 3500 ppm wash solution of a product containing 0.2% organic catalyst compound by weight results in a organic catalyst compound concentration of 6.5 ppm.

The preferred bleach boosting compound concentration is based on a bleach boosting compound molecular weight of about 300 grams/mole, although bleach boosting compounds can preferably have molecular weights of from about 150 to 1000 grams/mole, or even higher for oligomeric or polymeric bleach boosting compounds. For example, in the bleaching compositions of the present invention, when the bleach boosting compound is present more preferably from about 0.005% (0.05 ppm) to about 0.5% (5 ppm), the molar (M) concentration of bleach boosting compound will range from $1.7\times10^{-8}$ M to $1.7\times10^{-5}$M). Should an organic catalyst compound of higher m.w. be used in the bleaching compositions of the present invention, the preferred molar concentration will remain unchanged, whereas the preferred weight concentration (in ppm) will increase accordingly. For example, a bleach boosting compound with a molecular weight of about 600 grams/mole would be present more preferably from about 0.01% (0.1 ppm) to about 1.0% (10 ppm). For oligomeric or polymeric bleach boosting compounds, the more preferred molar concentration will be based on the monomeric unit associated with the iminium or oxaziridinium active site.

The method for delivering organic catalyst compounds of the present invention and the method for delivering bleaching compositions (products) containing such organic catalyst compounds that are particularly useful in the methods of the present invention are the organic catalyst compounds and compositions containing same that satisfy the preferred method for bleaching a stained substrate in an aqueous medium with a peroxygen source and with an organic catalyst compound whose structures is defined herein and wherein said medium contains active oxygen from the peroxygen compound from about 0.05 to about 250 ppm per liter of medium, and said organic catalyst compound from 0.001 ppm to about 5 ppm, preferably from about 0.01 ppm to about 3 ppm, more preferably from about 0.1 ppm to about 2 ppm, and most preferably from about 0.2 ppm to about 1 ppm.

Such a preferred method for bleaching a stained substrate in an aqueous medium with a peroxygen source and with an organic catalyst compound is of particular value for those applications in which the color safety of the stained substrate in need of cleaning is a concern. In such applications the preferred embodiment (e.g., 0.01 ppm to about 3 ppm) is of particular importance in terms of achieving acceptable fabric color safety. For other applications in which color safety of the stained substrate in need of cleaning is of less concern, a higher in-use concentration may be preferred.

The organic catalysts of the present invention particularly useful in the bleaching compositions of the present invention preferably are capable of becoming available in a wash solution comprising the bleaching compositions containing the organic catalyst by a controlled availability method as defined in Test Protocols I, II and/or III, disclosed hereinafter. The organic catalysts can inherently be capable of becoming available in a wash solution containing the organic catalysts by a controlled availability method as defined in Test Protocols I, II and/or III, disclosed hereinafter. Alternatively, the bleaching compositions containing the organic catalysts may be prepared in such a way that the organic catalysts become available in a wash solution containing the bleaching compositions by a controlled availability method as defined in Test Protocols I, II and/or III, disclosed hereinafter.

The bleaching compositions of the present invention may be advantageously employed in laundry applications, hard surface cleaning, automatic dishwashing applications, whitening and/or bleaching applications associated with wood pulp and/or textiles, antimicrobial and/or disinfectant applications, as well as cosmetic applications such as dentures, teeth, hair and skin. However, due to the unique advantages of both increased effectiveness in lower temperature solutions and the superior mitigation of unwanted decomposition of the organic catalysts, the organic catalysts of the present invention are ideally suited for laundry applications such as the bleaching of fabrics and/or the bleaching of dyes (e.g., dye transfer inhibition) through the use of bleach containing detergents or laundry bleach additives. Furthermore, the organic catalyst of the present invention may be employed in granular, powder, bar, paste, foam, gel and liquid compositions.

Accordingly, the bleaching compositions of the present invention may include various additional detergent components which are desirable in laundry applications. Such components include, but are not limited to, detersive surfactants, other bleaching agents including other bleach catalysts, builders, chelating agents, enzymes, polymeric soil release agents, brighteners and various other detergent components. Compositions including any of these various additional detergent components preferably have a pH of from about 6 to about 12, more preferably from about 8 to about 10.5 in a 1% solution of the bleaching composition.

The bleaching compositions preferably include at least one detersive surfactant, at least one chelating agent, at least one detersive enzyme and preferably have a pH of from about 6 to about 12, more preferably from about 8 to about 10.5 in a 1% solution of the bleaching composition.

It is desirable that the bleaching composition further includes a peroxygen source, as fully described below. The bleaching composition can also include powdered or liquid compositions containing a hydrogen peroxide source or a peroxygen source as fully defined below.

If the bleaching composition includes a hydrogen peroxide source, it is desirable that the laundry additive product further includes a bleach activator, as fully described below.

In another embodiment of the present invention, a method for laundering a fabric in need of laundering is provided. The preferred method comprises contacting the fabric with a laundry solution. The fabric may comprise most any fabric capable of being laundered in normal consumer use conditions. The laundry solution comprises a bleaching composition, as fully described herein. The water temperatures preferably range from about 0° C. to about 50° C. or higher. The water to fabric ratio is preferably from about 1:1 to about 15:1.

The laundry solution may further include at least one additional detergent component selected from the group consisting of detersive surfactants, other bleaching agents, chelating agents, detersive enzymes and mixtures thereof. Preferably, the laundry solution has a pH of about 8 to about 10.5 in a 1% solution of the bleaching composition.

In accordance with another aspect of the present invention, a laundry additive product is provided. The laundry additive product comprises an organic catalyst, as fully described above. Such a laundry additive product would be ideally suited for inclusion in a wash process when additional bleaching effectiveness is desired. Such instances may include, but are not limited to, low-temperature solution laundry application.

The organic catalysts of the present invention particularly useful in the laundry additive products of the present invention preferably are capable of becoming available in a wash solution comprising the laundry additive products containing the organic catalysts by a controlled availability method as defined in Test Protocols I, II and/or III, disclosed hereinafter. The organic catalysts can inherently be capable of becoming available in a wash solution containing the organic catalysts by a controlled availability method as defined in Test Protocols I, II and/or III, disclosed hereinafter. Alternatively, the laundry additive products containing the organic catalysts may be prepared in such a way that the organic catalysts become available in a wash solution containing the laundry additive products by a controlled availability method as defined in Test Protocols I, II and/or III, disclosed hereinafter.

It is desirable that the laundry additive product further includes a peroxygen source, as fully described below. The laundry additive product can also include powdered or liquid compositions containing a hydrogen peroxide source or a peroxygen source as fully defined below.

Furthermore, if the laundry additive product includes a hydrogen peroxide source, it is desirable that the laundry additive product further includes a bleach activator, as fully described below.

Preferably, the laundry additive product is packaged in dosage form for addition to a laundry process where a source of peroxygen is employed and increased bleaching effectiveness is desired. Such single dosage form may comprise a pill, tablet, gelcap or other single dosage unit such as pre-measured powders or liquids. A filler or carrier material may be included to increase the volume of composition if desired. Suitable filler or carrier materials may be selected from but not limited to various salts of sulfate, carbonate and silicate as well as talc, clay and the like. Filler or carrier materials for liquid compositions may be water or low molecular weight primary and secondary alcohols including polyols and diols. Examples include methanol, ethanol, propanol and isopropanol. Monohydric alcohols may also be employed. The compositions may contain from about 5% to about 90% of such materials. Acidic fillers can be used to reduce pH.

A preferred bleaching composition is a bleaching composition comprising:

(a) a bleaching system comprising a peroxygen source; and (b) an organic catalyst;

wherein the organic catalyst becomes available in a wash solution containing said bleaching composition by a controlled availability method as defined in Test Protocols I, II and/or III.

Bleaching System—In addition to the organic catalyst of the present invention, the bleaching compositions of the present invention preferably comprise a bleaching system. Bleaching systems typically comprise a peroxygen source. Peroxygen sources are well-known in the art and the peroxygen source employed in the present invention may comprise any of these well known sources, including peroxygen compounds as well as compounds which under consumer use conditions provide an effective amount of peroxygen in situ. The peroxygen source may include a hydrogen peroxide source, the in situ formation of a peracid anion through the reaction of a hydrogen peroxide source and a bleach activator, preformed peracid compounds or mixtures of suitable peroxygen sources. Of course, one of ordinary skill in the art will recognize that other sources of peroxygen may be employed without departing from the scope of the invention. Preferably, the peroxygen source is selected from the group consisting of:

(i) preformed peracid compounds selected from the group consisting of percarboxylic acids and salts, percarbonic acids and salts, perimidic acids and salts, peroxymonosulfuric acids and salts, and mixtures thereof, and (ii) hydrogen peroxide sources selected from the group consisting of perborate compounds, percarbonate compounds, perphosphate compounds and mixtures thereof, and a bleach activator.

When present, peroxygen sources (peracids and/or hydrogen peroxide sources) will typically be at levels of from about 1%, preferably from about 5% to about 30%, preferably to about 20% by weight of the composition. If present, the amount of bleach activator will typically be from about 0.1%, preferably from about 0.5% to about 60%, preferably to about 40% by weight, of the bleaching composition comprising the bleaching agent-plus-bleach activator.

a. Preformed Peracids—The preformed peracid compound as used herein is any convenient compound which is stable and which under consumer use conditions provides an effective amount of peracid anion. The organic catalysts of the present invention may of course be used in conjunction with a preformed peracid compound selected from the group consisting of percarboxylic acids and salts, percarbonic acids and salts, perimidic acids and salts, peroxymonosulfuric acids and salts, and mixtures thereof, examples of which are described in U.S. Pat. No. 5,576,282 to Miracle et al.

One class of suitable organic peroxycarboxylic acids have the general formula:

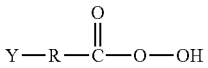

wherein R is an alkylene or substituted alkylene group containing from 1 to about 22 carbon atoms or a phenylene or substituted phenylene group, and Y is hydrogen, halogen, alkyl, aryl, —C(O)OH or —C(O)OOH.

Organic peroxyacids suitable for use in the present invention can contain either one or two peroxy groups and can be either aliphatic or aromatic. When the organic peroxycarboxylic acid is aliphatic, the unsubstituted peracid has the general formula:

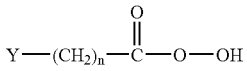

where Y can be, for example, H, $CH_3$, $CH_2Cl$, C(O)OH, or C(O)OOH; and n is an integer from 0 to 20. When the organic peroxycarboxylic acid is aromatic, the unsubstituted peracid has the general formula:

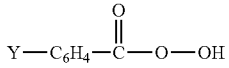

wherein Y can be, for example, hydrogen, alkyl, alkylhalogen, halogen, C(O)OH or C(O)OOH.

Typical monoperoxy acids useful herein include alkyl and aryl peroxyacids such as:

(i) peroxybenzoic acid and ring-substituted peroxybenzoic acid, e.g. peroxy-a-naphthoic acid, monoperoxyphthalic acid (magnesium salt hexahydrate), and o-carboxybenzamidoperoxyhexanoic acid (sodium salt);

(ii) aliphatic, substituted aliphatic and arylalkyl monoperoxy acids, e.g. peroxylauric acid, peroxystearic acid, N-nonanoylaminoperoxycaproic acid (NAPCA), N,N-(3-octylsuccinoyl)aminoperoxycaproic acid (SAPA) and N,N-phthaloylaminoperoxycaproic acid (PAP);

(iii) amidoperoxyacids, e.g. monononylamide of either peroxysuccinic acid (NAPSA) or of peroxyadipic acid (NAPAA).

Typical diperoxyacids useful herein include alkyl diperoxyacids and aryldiperoxyacids, such as:

(iv) 1,12-diperoxydodecanedioic acid;

(v) 1,9-diperoxyazelaic acid;

(vi) diperoxybrassylic acid; diperoxysebacic acid and diperoxyisophthalic acid;

(vii) 2-decyldiperoxybutane-1,4-dioic acid;

(viii) 4,4'-sulfonylbisperoxybenzoic acid.

Such bleaching agents are disclosed in U.S. Pat. No. 4,483,781, Hartman, issued Nov. 20, 1984, U.S. Pat. No. 4,634,551 to Burns et al., European Patent Application 0,133,354, Banks et al. published Feb. 20, 1985, and U.S. Pat. No. 4,412,934, Chung et al. issued Nov. 1, 1983. Sources also include 6-nonylamino-6-oxoperoxycaproic acid as fully described in U.S. Pat. No. 4,634,551, issued Jan. 6, 1987 to Burns et al. Persulfate compounds such as for example OXONE, manufactured commercially by E.I. DuPont de Nemours of Wilmington, Del. can also be employed as a suitable source of peroxymonosulfuric acid.

b. Hydrogen Peroxide Sources—The hydrogen peroxide source may be any suitable hydrogen peroxide source and present at such levels as fully described in U.S. Pat. No. 5,576,282. For example, the hydrogen peroxide source may be selected from the group consisting of perborate compounds, percarbonate compounds, perphosphate compounds and mixtures thereof.

Hydrogen peroxide sources are described in detail in the herein incorporated Kirk Othmer's Encyclopedia of Chemical Technology, 4th Ed (1992, John Wiley & Sons), Vol. 4, pp. 271–300 "Bleaching Agents (Survey)", and include the various forms of sodium perborate and sodium percarbonate, including various coated and modified forms.

The preferred source of hydrogen peroxide used herein can be any convenient source, including hydrogen peroxide itself. For example, perborate, e.g., sodium perborate (any hydrate but preferably the mono- or tetra-hydrate), sodium carbonate peroxyhydrate or equivalent percarbonate salts, sodium pyrophosphate peroxyhydrate, urea peroxyhydrate, or sodium peroxide can be used herein. Also useful are sources of available oxygen such as persulfate bleach (e.g., OXONE, manufactured by DuPont). Sodium perborate monohydrate and sodium percarbonate are particularly preferred. Mixtures of any convenient hydrogen peroxide sources can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with a silicate, borate or water-soluble surfactants. Percarbonate is available from various commercial sources such as FMC, Solvay and Tokai Denka.

Compositions of the present invention may also comprise as the bleaching agent a chlorine-type bleaching material. Such agents are well known in the art, and include for example sodium dichloroisocyanurate ("NaDCC"). However, chlorine-type bleaches are less preferred for compositions which comprise enzymes.

b. Bleach Activators—Preferably, the peroxygen source in the composition is formulated with an activator (peracid precursor). The activator is present at levels of from about 0.01%, preferably from about 0.5%, more preferably from about 1% to about 15%, preferably to about 10%, more preferably to about 8%, by weight of the composition. A bleach activator as used herein is any compound which when used in conjunction with a hydrogen peroxide source leads to the in situ production of the peracid corresponding to the bleach activator. Various non limiting examples of activators are fully disclosed in U.S. Pat. No. 5,576,282, U.S. Pat. No. 4,915,854 and U.S. Pat. No. 4,412,934. See also U.S. Pat. No. 4,634,551 for other typical bleaches and activators useful herein.

Preferred activators are selected from the group consisting of tetraacetyl ethylene diamine (TAED), benzoylcaprolactam (BzCL), 4-nitrobenzoylcaprolactam, 3-chlorobenzoylcaprolactam, benzoyloxybenzenesulphonate (BOBS), nonanoyloxybenzenesulphonate (NOBS), phenyl benzoate (PhBz), decanoyloxybenzenesulphonate ($C_{10}$-OBS), benzoylvalerolactam (BZVL), octanoyloxybenzenesulphonate ($C_8$-OBS), perhydrolyzable esters and mixtures thereof, most preferably benzoylcaprolactam and benzoylvalerolactam. Particularly preferred bleach activators in the pH range from about 8 to about 9.5 are those selected having an OBS or VL leaving group.

Preferred hydrophobic bleach activators include, but are not limited to, nonanoyloxybenzenesulphonate (NOBS), 4-[N-(nonanoyl) amino hexanoyloxy]-benzene sulfonate sodium salt (NACA-OBS) an example of which is described in U.S. Pat. No. 5,523,434, lauroyloxybenzenesulphonate (LOBS or $C_{12}$-OBS), 10-undecenoyloxybenzenesulfonate (UDOBS or $C_{11}$-OBS with unsaturation in the 10 position), and decanoyloxybenzoic acid (DOBA).

Preferred bleach activators are those described in U.S. Pat. No. 5,698,504 Christie et al., issued Dec. 16, 1997; U.S. Pat. No. 5,695,679 Christie et al. issued Dec. 9, 1997; U.S. Pat. No. 5,686,401 Willey et al., issued Nov. 11, 1997; U.S. Pat. No. 5,686,014 Hartshorn et al., issued Nov. 11, 1997; U.S. Pat. No. 5,405,412 Willey et al., issued Apr. 11, 1995; U.S. Pat. No. 5,405,413 Willey et al., issued Apr. 11, 1995; U.S. Pat. No. 5,130,045 Mitchel et al., issued Jul. 14, 1992; and U.S. Pat. No. 4,412,934 Chung et al., issued Nov. 1, 1983, and copending patent applications U.S. Ser. Nos. 08/709,072, 08/064,564, all of which are incorporated herein by reference.

The mole ratio of peroxygen bleaching compound (as AvO) to bleach activator in the present invention generally ranges from at least 1:1, preferably from about 20:1, more preferably from about 10:1 to about 1:1, preferably to about 3:1.

Quaternary substituted bleach activators may also be included. The present bleaching compositions preferably comprise a quaternary substituted bleach activator (QSBA) or a quaternary substituted peracid (QSP); more preferably, the former. Preferred QSBA structures are further described in U.S. Pat. No. 5,686,015 Willey et al., issued Nov. 11, 1997; U.S. Pat. No. 5,654,421 Taylor et al., issued Aug. 5, 1997; U.S. Pat. No. 5,460,747 Gosselink et al., issued Oct. 24, 1995; U.S. Pat. No. 5,584,888 Miracle et al., issued Dec. 17, 1996; and U.S. Pat. No. 5,578,136 Taylor et al., issued Nov. 26, 1996; all of which are incorporated herein by reference.

Highly preferred bleach activators useful herein are amide-substituted as described in U.S. Pat. No. 5,698,504, U.S. Pat. No. 5,695,679, and U.S. Pat. No. 5,686,014 each of which are cited herein above. Preferred examples of such bleach activators include: (6-octanamidocaproyl) oxybenzenesulfonate, (6-nonanamidocaproyl)oxybenzenesulfonate, (6-decanamido caproyl)oxybenzenesulfonate and mixtures thereof.

Other useful activators, disclosed in U.S. Pat. No. 5,698,504, U.S. Pat. No. 5,695,679, U.S. Pat. No. 5,686,014 each of which is cited herein above and U.S. Pat. No. 4,966,723 Hodge et al., issued Oct. 30, 1990, include benzoxazin-type activators, such as a $C_6H_4$ ring to which is fused in the 1,2-positions a moiety —C(O)OC($R^1$)═N—.

Depending on the activator and precise application, good bleaching results can be obtained from bleaching systems having with in-use pH of from about 6 to about 13, preferably from about 9.0 to about 10.5. Typically, for example, activators with electron-withdrawing moieties are used for near-neutral or sub-neutral pH ranges. Alkalis and buffering agents can be used to secure such pH.

Acyl lactam activators, as described in U.S. Pat. No. 5,698,504, U.S. Pat. No. 5,695,679 and U.S. Pat. No. 5,686,014, each of which is cited herein above, are very useful herein, especially the acyl caprolactams (see for example WO 94-28102 A) and acyl valerolactams (see U.S. Pat. No. 5,503,639 Willey et al., issued Apr. 2, 1996 incorporated herein by reference).

d. Organic Peroxides, especially Diacyl Peroxides—In addition to the bleaching agents described above, the bleaching compositions of the present invention can optionally include organic peroxides. Organic peroxides are extensively illustrated in Kirk Othmer, Encyclopedia of Chemical Technology, Vol. 17, John Wiley and Sons, 1982 at pages 27–90 and especially at pages 63–72, all incorporated herein by reference. If a diacyl peroxide is used, it will preferably be one which exerts minimal adverse impact on spotting/filming.

e. Metal-containing Bleach Catalysts—The bleaching compositions can also optionally include metal-containing bleach catalysts, preferably manganese and cobalt-containing bleach catalysts.

One type of metal-containing bleach catalyst is a catalyst system comprising a transition metal cation of defined bleach catalytic activity, such as copper, iron, titanium, ruthenium tungsten, molybdenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, ethylenediaminetetra (methylenephosphonic acid) and water-soluble salts thereof. Such catalysts are disclosed in U.S. Pat. No. 4,430,243 Bragg, issued Feb. 2, 1982.

i. Manganese Metal Complexes—If desired, the compositions herein can be catalyzed by means of a manganese compound. Such compounds and levels of use are well known in the art and include, for example, the manganese-based catalysts disclosed in U.S. Pat. No. 5,576,282 Miracle et al., issued Nov. 19, 1996; U.S. Pat. No. 5,246,621 Favre et al., issued Sep. 21, 1993; U.S. Pat. No. 5,244,594 Favre et al., issued Sep. 14, 1993; U.S. Pat. No. 5,194,416 Jureller et al., issued Mar. 16, 1993; U.S. Pat. No. 5,114,606 van Vliet et al., issued May 19, 1992; and European Pat. App. Pub. Nos. 549,271 A1, 549,272 A1, 544,440 A2, and 544,490 A1; Preferred examples of these catalysts include $Mn^{IV}_2(u\text{-}O)_3$(1,4,7-trimethyl-1,4,7-triazacyclononane)$_2$-$(PF_6)_2$, $Mn^{III}_2(u\text{-}O)_1(u\text{-}OAc)_2$(1,4,7-trimethyl-1,4,7-triazacyclononane)$_2(ClO_4)_2$, $Mn^{IV}_4(u\text{-}O)_6$(1,4,7-triazacyclononane)$_4$ $(ClO_4)_4$, $Mn^{III}Mn^{IV}_4(u\text{-}O)_1(u\text{-}OAc)_2$-(1,4,7-trimethyl-1,4,7-triazacyclononane)$_2(ClO_4)_3$, $Mn^{IV}$(1,4,7-trimethyl-1,4,7-triazacyclononane)-$(OCH_3)_3(PF_6)$, and mixtures thereof. Other metal-based bleach catalysts include those disclosed in U.S. Pat. No. 4,430,243 included by reference herein above and U.S. Pat. No. 5,114,611 van Kralingen, issued May 19, 1992. The use of manganese with various complex ligands to enhance bleaching is also reported in the following: U.S. Pat. No. 4,728,455 Rerek, issued Mar. 1, 1988; U.S. Pat. No. 5,284,944 Madison, issued Feb. 8, 1994; U.S. Pat. No. 5,246,612 van Dijk et al., issued Sep. 21, 1993; U.S. Pat. No. 5,256,779 Kerschner et al., issued Oct. 26, 2993; U.S. Pat. No. 5,280,117 Kerschner et al., issued Jan. 18, 1994; U.S. Pat. No. 5,274,147 Kerschner et al., issued Dec. 28, 1993; U.S. Pat. No. 5,153,161 Kerschner et al., issued Oct. 6, 1992; and U.S. Pat. No. 5,227,084 Martens et al., issued Jul. 13, 1993.

ii. Cobalt Metal Complexes—Cobalt bleach catalysts useful herein are known, and are described, for example, in U.S. Pat. No. 5,597,936 Perkins et al., issued Jan. 28, 1997; U.S. Pat. No. 5,595,967 Miracle et al., Jan. 21, 1997; U.S. Pat. No. 5,703,030 Perkins et al., issued Dec. 30, 1997; and M. L. To be, "Base Hydrolysis of Transition-Metal Complexes", *Adv. Inorg. Bioinorg. Mech.*, (1983), 2, pages 1–94. The most preferred cobalt catalyst useful herein are cobalt pentaamine acetate salts having the formula $[Co(NH_3)_5OAc]\ T_y$, wherein "OAc" represents an acetate moiety and "$T_y$" is an anion, and especially cobalt pentaamine acetate chloride, $[Co(NH_3)_5OAc]Cl_2$; as well as $[Co(NH_3)_5OAc](OAc)_2$; $[Co(NH_3)_5OAc](PF_6)_2$; $[Co(NH_3)_5OAc](SO_4)$; $[Co(NH_3)_5OAc](BF_4)_2$; and $[Co(NH_3)_5OAc](NO_3)_2$ (herein "PAC").

These cobalt catalysts are readily prepared by known procedures, such as taught for example in U.S. Pat. No. 5,597,936, U.S. Pat. No. 5,595,967, U.S. Pat. No. 5,703,030, cited herein above, the To be article and the references cited therein, and in U.S. Pat. No. 4,810,410, to Diakun et al, issued Mar. 7, 1989, *J. Chem. Ed.* (1989), 66 (12), 1043–45; The Synthesis and Characterization of Inorganic Compounds, W. L. Jolly (Prentice-Hall; 1970), pp. 461–3; *Inorg. Chem.*, 18, 1497–1502 (1979); *Inorg. Chem.*, 21, 2881–2885 (1982); *Inorg. Chem.*, 18, 2023–2025 (1979); Inorg. Synthesis, 173–176 (1960); and *Journal of Physical Chemistry*, 56, 22–25 (1952).

iii. Transition Metal Complexes of Macropolycyclic Rigid Ligands—Compositions herein may also suitably include as bleach catalyst a transition metal complex of a macropolycyclic rigid ligand. The phrase "macropolycyclic rigid ligand" is sometimes abbreviated as "MRL" in discussion below. The amount used is a catalytically effective amount, suitably about 1 ppb or more, for example up to about 99.9%, more typically about 0.001 ppm or more, preferably from about 0.05 ppm to about 500 ppm (wherein "ppb" denotes parts per billion by weight and "ppm" denotes parts per million by weight).

Suitable transition metals e.g., Mn are illustrated hereinafter. "Macropolycyclic" means a MRL is both a macrocycle and is polycyclic. "Polycyclic" means at least bicyclic. The term "rigid" as used herein herein includes "having a superstructure" and "cross-bridged". "Rigid" has been defined as the constrained converse of flexibility: see D. H. Busch., *Chemical Reviews*. (1993), 93, 847–860, incorporated by reference. More particularly, "rigid" as used herein means that the MRL must be determinably more rigid than a macrocycle ("parent macrocycle") which is otherwise identical (having the same ring size and type and number of atoms in the main ring) but lacking a superstructure (especially linking moieties or, preferably cross-bridging moieties) found in the MRL's. In determining the comparative rigidity of macrocycles with and without superstructures, the practitioner will use the free form (not the metal-bound form) of the macrocycles. Rigidity is well-known to be useful in comparing macrocycles; suitable tools for determining, measuring or comparing rigidity include computational methods (see, for example, Zimmer, *Chemical Reviews*. (1995), 95(38), 2629–2648 or Hancock et al., *Inorganica Chimica Acta*. (1989), 164, 73–84.

Preferred MRL's herein are a special type of ultra-rigid ligand which is cross-bridged. A "cross-bridge" is nonlimitingly illustrated in 1.11 hereinbelow. In 1.11, the cross-bridge is a —$CH_2CH_2$— moiety. It bridges $N^1$ and $N^8$ in the illustrative structure. By comparison, a "same-side" bridge, for example if one were to be introduced across $N^1$ and $N^{12}$ in 1.11, would not be sufficient to constitute a "cross-bridge" and accordingly would not be preferred.

Suitable metals in the rigid ligand complexes include Mn(II), Mn(III), Mn(IV), Mn(V), Fe(II), Fe(III), Fe(IV), Co(I), Co(II), Co(III), Ni(I), Ni(II), Ni(III), Cu(I), Cu(II), Cu(III), Cr(II), Cr(III), Cr(IV), Cr(V), Cr(VI), V(III), V(IV), V(V), Mo(IV), Mo(V), Mo(VI), W(IV), W(V), W(VI), Pd(II), Ru(II), Ru(III), and Ru(IV). Preferred transition-metals in the instant transition-metal bleach catalyst include manganese, iron and chromium.

More generally, the MRL's (and the corresponding transition-metal catalysts) herein suitably comprise:

(a) at least one macrocycle main ring comprising four or more heteroatoms; and (b) a covalently connected non-metal superstructure capable of increasing the rigidity of the macrocycle, preferably selected from (i) a bridging superstructure, such as a linking moiety;

(ii) a cross-bridging superstructure, such as a cross-bridging linking moiety; and (iii) combinations thereof.

The term "superstructure" is used herein as defined in the literature by Busch et al., see, for example, articles by Busch in "Chemical Reviews".

Preferred superstructures herein not only enhance the rigidity of the parent macrocycle, but also favor folding of the macrocycle so that it coordinates to a metal in a cleft. Suitable superstructures can be remarkably simple, for example a linking moiety such as any of those illustrated in FIG. 1 and FIG. 2 below, can be used.

FIG. 1

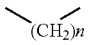

wherein n is an integer, for example from 2 to 8, preferably less than 6, typically 2 to 4, or

FIG. 2

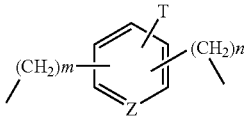

wherein m and n are integers from about 1 to 8, more preferably from 1 to 3; Z is N or CH; and T is a compatible substituent, for example H, alkyl, trialkylammonium, halogen, nitro, sulfonate, or the like. The aromatic ring in 1.10 can be replaced by a saturated ring, in which the atom in Z connecting into the ring can contain N, O, S or C.

Suitable MRL's are further nonlimitingly illustrated by the following compound:

FIG. 3

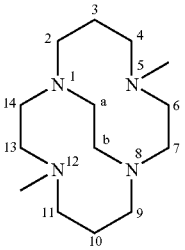

This is a MRL in accordance with the invention which is a highly preferred, cross-bridged, methyl-substituted (all nitrogen atoms tertiary) derivative of cyclam. Formally, this ligand is named 5,12-dimethyl-1,5,8,12-tetraazabicyclo[6.6.2]hexadecane using the extended von Baeyer system. See "A Guide to IUPAC Nomenclature of Organic Compounds: Recommendations 1993", R. Panico, W. H. Powell and J-C Richer (Eds.), Blackwell Scientific Publications, Boston, 1993; see especially section R-2.4.2.1.

Transition-metal bleach catalysts of Macrocyclic Rigid Ligands which are suitable for use in the invention compositions can in general include known compounds where they conform with the definition herein, as well as, more preferably, any of a large number of novel compounds expressly designed for the present laundry or cleaning uses, and non-limitingly illustrated by any of the following:

Dichloro-5,12-dimethyl-1,5,8,12-tetraazabicyclo[6.6.2]hexadecane Manganese(II)

Diaquo-5,12-dimethyl-1,5,8,12-tetraazabicyclo[6.6.2]hexadecane Manganese(II) Hexafluorophosphate Aquo-hydroxy-5,12-dimethyl-1,5,8,12-tetraazabicyclo[6.6.2]hexadecane Manganese(III) Hexafluorophosphate Diaquo-5,12-dimethyl-1,5,8,12-tetraazabicyclo[6.6.2]hexadecane Manganese(II) Tetrafluoroborate Dichloro-5,12-dimethyl-1,5,8,12-tetraazabicyclo[6.6.2]hexadecane Manganese(II) Hexafluorophosphate Dichloro-5,12-di-n-butyl-1,5,8,12-tetraaza bicyclo[6.6.2]hexadecane Manganese(II)

Dichloro-5,12-dibenzyl-1,5,8,12-tetraazabicyclo[6.6.2]hexadecane Manganese(II)

Dichloro-5-n-butyl-12-methyl-1,5,8,12-tetraaza-bicyclo[6.6.2]hexadecane Manganese(II)

Dichloro-5-n-octyl-12-methyl-1,5,8,12-tetraaza-bicyclo[6.6.2]hexadecane Manganese(II)

Dichloro-5-n-butyl-12-methyl-1,5,8,12-tetraaza-bicyclo[6.6.2]hexadecane Manganese(II).

As a practical matter, and not by way of limitation, the compositions and cleaning processes herein can be adjusted to provide on the order of at least one part per hundred million of the active bleach catalyst species in the aqueous washing medium, and will preferably provide from about 0.01 ppm to about 25 ppm, more preferably from about 0.05 ppm to about 10 ppm, and most preferably from about 0.1 ppm to about 5 ppm, of the bleach catalyst species in the wash liquor. In order to obtain such levels in the wash liquor of an automatic washing process, typical compositions herein will comprise from about 0.0005% to about 0.2%, more preferably from about 0.004% to about 0.08%, of bleach catalyst, especially manganese or cobalt catalysts, by weight of the cleaning compositions.

Preferably, the peroxygen source is selected from hydrogen peroxide sources selected from the group consisting of perborate compounds, percarbonate compounds, perphosphate compounds and mixtures thereof, and a bleach activator. Preferably, the bleach activator is selected from the group consisting of hydrophobic bleach activators as disclosed herein.

The purpose of such a bleaching composition is to mitigate unwanted decomposition of the organic catalyst, and to allow the peracid to achieve bleaching performance on a fabric in need of cleaning, such as a stained fabric, in a wash solution prior to the availability of the organic catalyst.

Detergent Components

While not essential for the purposes of the present invention, several conventional adjuncts illustrated hereinafter are suitable for use in the instant bleaching compositions and may be desirably incorporated in preferred embodiments of the invention, for example to assist or enhance cleaning performance, for treatment of the substrate to be cleaned, or to modify the aesthetics of the bleaching composition as is the case with perfumes, colorants, dyes or the like. The precise nature of these additional components, and levels of incorporation thereof, will depend on the physical form of the composition and the nature of the cleaning operation for which it is to be used. Unless otherwise indicated, the bleaching compositions of the invention may for example, be formulated as granular or powder-form all-purpose or "heavy-duty" washing agents, especially laundry detergents; liquid, gel or paste-form all-purpose washing agents, especially the so-called heavy-duty liquid types; liquid fine-fabric detergents; hand dishwashing agents or light duty dishwashing agents, especially those of the high-foaming type; machine dishwashing agents, including the various tablet, granular, liquid and rinse-aid types for household and institutional use; liquid cleaning and disinfecting agents, including antibacterial hand-wash types, laundry bars, mouthwashes, denture cleaners, car or carpet shampoos, bathroom cleaners; hair shampoos and hair-rinses; shower gels and foam baths and metal cleaners; as well as cleaning auxiliaries such as bleach additives and "stain-stick" or pre-treat types.

Surfactants—Preferably, the bleaching compositions according to the present invention comprise a surfactant or surfactant system wherein the surfactant can be selected from nonionic and/or anionic and/or cationic surfactants and/or ampholytic and/or zwitterionic and/or semi-polar nonionic surfactants.

The surfactant is typically present at a level of from about 0.1%, preferably about 1%, more preferably about 5% by weight of the bleaching compositions to about 99.9%, preferably about 80%, more preferably about 35%, most preferably 30% about by weight of the bleaching compositions.

The surfactant can be nonionic, anionic, ampholytic, zwitterionic, or cationic. Mixtures of these surfactants can also be used. Preferred bleaching compositions comprise anionic surfactants or mixtures of anionic surfactants with other surfactants, especially nonionic surfactants.

The surfactant is preferably formulated to be compatible with enzyme components present in the composition. In liquid or gel compositions the surfactant is most preferably formulated such that it promotes, or at least does not degrade, the stability of any enzyme in these compositions.

Nonlimiting examples of suitable nonionic, anionic, cationic, ampholytic, zwitterionic and semi-polar nonionic surfactants are disclosed in U.S. Pat. Nos. 5,707,950 and 5,576,282. Additional examples of suitable surfactants can be found in McCutcheon's EMULSIFIERS AND DETERGENTS, North American Edition, 1997, McCutcheon Division, MC Publishing Company, in U.S. Pat. Nos. 3,929,678 and 4,259,217; in the series "Surfactant Science", Marcel Dekker, Inc., New York and Basel; in "Handbook of Surfactants", M. R. Porter, Chapman and Hall, 2nd Ed., 1994; in "Surfactants in Consumer Products", Ed. J. Falbe, Springer-Verlag, 1987; and "Surface Active Agents and Detergents" (Vol. I and II by Schwartz, Perry and Berch).

Highly preferred nonionic surfactants are polyhydroxy fatty acid amide surfactants of the formula:

$$R^2—C(O)—N(R^1)—Z,$$

wherein $R^1$ is H, or $R^1$ is $C_{1-4}$ hydrocarbyl, 2-hydroxy ethyl, 2-hydroxy propyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{11-15}$ alkyl or $C_{16-18}$ alkyl or alkenyl chain such as coconut alkyl or mixtures thereof, and Z is derived from a reducing sugar such as glucose, fructose, maltose, lactose, in a reductive amination reaction.

Highly preferred anionic surfactants include alkyl alkoxylated sulfate surfactants hereof are water soluble salts or acids of the formula $RO(A)_mSO3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein.

When included therein, the bleaching compositions, especially laundry detergent compositions, of the present invention typically comprise from about 1%, more preferably about 3% by weight of such anionic surfactants to about 40%, more preferably about 20% by weight of such anionic surfactants.

Highly preferred cationic surfactants are the water-soluble quaternary ammonium compounds useful in the present composition having the formula:

$$R_1R_2R_3R_4N^+X^-$$

wherein $R_1$ is $C_8$–$C_{16}$ alkyl, each of $R_2$, $R_3$ and $R_4$ is independently $C_1$–$C_4$ alkyl, $C_1$–$C_4$ hydroxy alkyl, benzyl, and $—(C_2H_{40})_xH$ where x has a value from 2 to 5, and X is an anion. Not more than one of $R_2$, $R_3$ or $R_4$ should be benzyl.

When included therein, the bleaching compositions of the present invention typically comprise from about 0.2%, more preferably about 1% by weight of such cationic surfactants to about 25%, more preferably about 8% by weight of such cationic surfactants.

When included therein, the bleaching compositions of the present invention typically comprise from about 0.2%, more preferably about 1% by weight of such ampholytic surfactants to about 15%, more preferably about 10% by weight of such ampholytic surfactants.

When included therein, the bleaching compositions of the present invention typically comprise from about 0.2%, more preferably about 1% by weight of such zwitterionic surfactants to about 15%, more preferably about 10% by weight of such zwitterionic surfactants.

When included therein, the bleaching compositions of the present invention typically comprise from about 0.2%, more preferably 1% by weight of such semi-polar nonionic surfactants to about 15%, more preferably about 10% by weight of such semi-polar nonionic surfactants.

The bleaching compositions of the present invention can also comprise from about 0.001% to about 100% of one or more (preferably a mixture of two or more) mid-chain branched surfactants, preferably mid-chain branched alkyl alkoxy alcohols having the formula:

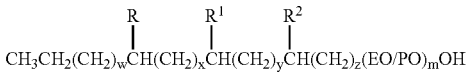

mid-chain branched alkyl sulfates having the formula:

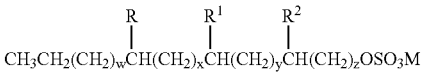

and mid-chain branched alkyl alkoxy sulfates having the formula:

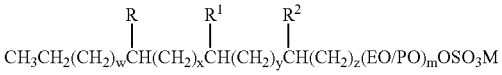

wherein the total number of carbon atoms in the branched primary alkyl moiety of these formulae (including the R, $R^1$, and $R^2$ branching, but not including the carbon atoms which comprise any EO/PO alkoxy moiety) is from 14 to 20, and wherein further for this surfactant mixture the average total number of carbon atoms in the branched primary alkyl moieties having the above formula is within the range of greater than 14.5 to about 17.5 (preferably from about 15 to about 17); R, $R^1$, and $R^2$ are each independently selected from hydrogen, $C_1$–$C_3$ alkyl, and mixtures thereof, preferably methyl; provided R, $R^1$, and $R^2$ are not all hydrogen and, when z is 1, at least R or $R^1$ is not hydrogen. M is a water soluble cation and may comprises more than one type of cation, for example, a mixture of sodium and potassium. The index w is an integer from 0 to 13; x is an integer from 0 to 13; y is an integer from 0 to 13; z is an integer of at least 1; provided w+x+y+z is from 8 to 14. EO and PO represent ethyleneoxy units and propyleneoxy units having the formula:

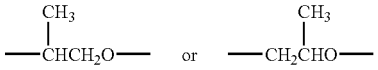

respectively, however, other alkoxy units inter alia 1,3-propyleneoxy, butoxy, and mixtures thereof are suitable as alkoxy units appended to the mid-chain branched alkyl moieties.

The mid-chain branched surfactants are preferably mixtures which comprise a surfactant system. Therefore, when the surfactant system comprises an alkoxylated surfactant, the index m indicates the average degree of alkoxylation within the mixture of surfactants. As such, the index m is at least about 0.01, preferably within the range of from about 0.1, more preferably from about 0.5, most preferably from about 1 to about 30, preferably to about 10, more preferably to about 5. When considering a mid-chain branched surfactant system which comprises only alkoxylated surfactants, the value of the index m represents a distribution of the average degree of alkoxylation corresponding to m, or it may be a single specific chain with alkoxylation (e.g., ethoxylation and/or propoxylation) of exactly the number of units corresponding to m.

The preferred mid-chain branched surfactants of the present invention which are suitable for use in the surfactant systems of the present invention have the formula:

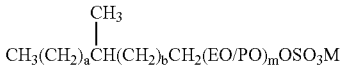

or the formula:

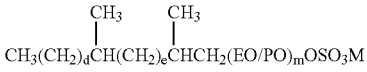

wherein a, b, d, and e are integers such that a+b is from 10 to 16 and d+e is from 8 to 14; M is selected from sodium, potassium, magnesium, ammonium and substituted ammonium, and mixtures thereof.

The surfactant systems of the present invention which comprise mid-chain branched surfactants are preferably formulated in two embodiments. A first preferred embodiment comprises mid-chain branched surfactants which are formed from a feedstock which comprises 25% or less of mid-chain branched alkyl units. Therefore, prior to admixture with any other conventional surfactants, the mid-chain branched surfactant component will comprise 25% or less of surfactant molecules which are non-linear surfactants.

A second preferred embodiment comprises mid-chain branched surfactants which are formed from a feedstock which comprises from about 25% to about 70% of mid-chain branched alkyl units. Therefore, prior to admixture with any other conventional surfactants, the mid-chain branched surfactant component will comprise from about 25% to about 70% surfactant molecules which are non-linear surfactants.

The surfactant systems of the bleaching compositions of the present invention can also comprise from about 0.001%, preferably from about 1%, more preferably from about 5%, most preferably from about 10% to about 100%, preferably to about 60%, more preferably to about 30% by weight, of the surfactant system, of one or more (preferably a mixture of two or more) mid-chain branched alkyl arylsulfonate surfactants, preferably surfactants wherein the aryl unit is a benzene ring having the formula:

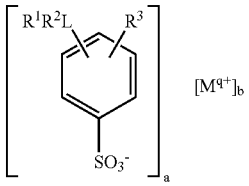

wherein L is an acyclic hydrocarbyl moiety comprising from 6 to 18 carbon atoms; $R^1$, $R^2$, and $R^3$ are each independently hydrogen or $C_1$–$C_3$ alkyl, provided $R^1$ and $R^2$ are not attached at the terminus of the L unit; M is a water soluble cation having charge q wherein a and b are taken together to satisfy charge neutrality.

Additional Detergent Components

The following are non-limiting examples of additional detergent components (adjunct ingredients) useful in the bleaching compositions, especially laundry detergent compositions, of the present invention, said adjunct ingredients include builders, optical brighteners, soil release polymers, dye transfer agents, dispersants, enzymes, suds suppressers, dyes, perfumes, colorants, filler salts, hydrotropes, photoactivators, fluorescers, fabric conditioners, hydrolyzable surfactants, preservatives, anti-oxidants, chelants, stabilizers, anti-shrinkage agents, anti-wrinkle agents, germicides, fungicides, anti corrosion agents, and mixtures thereof.

Builders—The bleaching compositions of the present invention preferably comprise one or more detergent builders or builder systems. When present, the compositions will typically comprise at least about 1% builder, preferably from about 5%, more preferably from about 10% to about 80%, preferably to about 50%, more preferably to about 30% by weight, of detergent builder.

The level of builder can vary widely depending upon the end use of the composition and its desired physical form. When present, the compositions will typically comprise at least about 1% builder. Formulations typically comprise from about 5% to about 50%, more typically about 5% to about 30%, by weight, of detergent builder. Granular formulations typically comprise from about 10% to about 80%, more typically from about 15% to about 50% by weight, of the detergent builder. Lower or higher levels of builder, however, are not meant to be excluded.

Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those hhaving a $SiO_2$:$Na_2O$ ratio in the range 1.6:1 to 3.2:1 and layered silicates, such as the layered sodium silicates described in U.S. Pat. No. 4,664,839 Rieck, issued May 12, 1987. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2X+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973.

Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$[M_z(zAlO_2)_y].xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Organic detergent builders suitable for the purposes of the present invention include, but are not restricted to, a wide variety of polycarboxylate compounds. As used herein, "poly-carboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in U.S. Pat. No. 3,128,287 Berg, issued Apr. 7, 1964, U.S. Pat. No. 3,635,830 Lamberti et al., issued Jan. 18, 1972, and U.S. Pat. No. 3,936,448 Lamberti, issued Feb. 3, 1976. See also "TMS/TDS" builders of U.S. Pat. No. 4,663,071 Bush et al., issued May 5, 1987. Suitable ether polycarboxylates also include cyclic compounds, particularly alicyclic compounds, such as those described in U.S. Pat. No. 3,923,679 Rapko, issued Dec. 2, 1975; U.S. Pat. No. 4,158,635 Crutchfield et al., issued Jun. 19, 1979; U.S. Pat. No. 4,120,874 Crutchfield et al., issued Oct. 17, 1978; and U.S. Pat. No. 4,102,903 Crutchfield et al., issued Jul. 25, 1978.

Other useful detergency builders include the ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the bleaching compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al., issued Mar. 13, 1979 and in U.S. Pat. No. 3,308,067, Diehl, issued Mar. 7, 1967. See also Diehl U.S. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used.

Chelating Agents—The bleaching compositions herein may also optionally contain one or more iron and/or manganese chelating agents. Such chelating agents can be selected from the group consisting of amino carboxylates, amino phosphonates, polyfunctionally-substituted aromatic chelating agents and mixtures therein, all as hereinafter defined. Without intending to be bound by theory, it is believed that the benefit of these materials is due in part to their exceptional ability to remove iron and manganese ions from washing solutions by formation of soluble chelates.

Examples of suitable chelating agents and levels of use are described in U.S. Pat. Nos. 5,576,282 and 5,728,671.

A preferred biodegradable chelator for use herein is ethylenediamine disuccinate ("EDDS"), especially the [S,S] isomer as described in U.S. Pat. No. 4,704,233, Nov. 3, 1987, to Hartman and Perkins.

The compositions herein may also contain water-soluble methyl glycine diacetic acid (MGDA) salts (or acid form) as a chelant or co-builder useful with, for example, insoluble builders such as zeolites, layered silicates and the like.

If utilized, these chelating agents will generally comprise from about 0.1% by weight of the bleaching compositions herein to about 15%, more preferably 3.0% by weight of the bleaching compositions herein.

Dye Transfer Inhibiting Agents—The bleaching compositions of the present invention may also include one or more compounds, dye transfer inhibiting agents, for inhibiting dye transfer from one fabric to another of solubilized and suspended dyes encountered during fabric laundering and conditioning operations involving colored fabrics.

Suitable polymeric dye transfer inhibiting agents include, but are not limited to, polyvinylpyrrolidone polymers, polyamine N-oxide polymers, copolymers of N-vinylpyrrolidone and N-vinylimidazole, polyvinyloxazolidones and polyvinylimidazoles or mixtures thereof. Examples of such dye transfer inhibiting agents are disclosed in U.S. Pat. Nos. 5,707,950 and 5,707,951.

Additional suitable dye transfer inhibiting agents include, but are not limited to, cross-linked polymers. Cross-linked polymers are polymers whose backbone are interconnected to a certain degree; these links can be of chemical or physical nature, possibly with active groups on the backbone or on branches. Cross-linked polymers have been described in the Journal of Polymer Science, volume 22, pages 1035–1039.

In one embodiment, the cross-linked polymers are made in such a way that they form a three-dimensional rigid structure, which can entrap dyes in the pores formed by the three-dimensional structure.

In another embodiment, the cross-linked polymers entrap dyes by swelling.

Suitable cross-linked polymers are described in the co-pending European patent application 94870213.9.

Addition of such polymers also enhances the performance of the enzymes within the bleaching compositions herein.

The dye transfer inhibiting agents have the ability to complex or adsorb fugitive dyes wash out of dyed fabrics before the dyes have the opportunity to become attached to other articles in the wash.

When present in the bleaching compositions herein, the dye transfer inhibiting agents are present at levels from about 0.0001%, more preferably about 0.01%, most preferably about 0.05% by weight of the bleaching compositions to about 10%, more preferably about 2%, most preferably about 1% by weight of the bleaching compositions.

Dispersants—The bleaching compositions of the present invention can also contain dispersants. Suitable water-soluble organic salts are the homo- or co-polymeric acids or their salts, in which the polycarboxylic acid comprises at least two carboxyl radicals separated from each other by not more than two carbon atoms.

Polymers of this type are disclosed in GB-A-1,596,756. Examples of such salts are polyacrylates of MW 2000–5000 and their copolymers with maleic anhydride, such copolymers having a molecular weight of from 1,000 to 100,000.

Especially, copolymer of acrylate and methylacrylate such as the 480N having a molecular weight of 4000, at a level from 0.5–20% by weight of composition can be added in the detergent compositions of the present invention.

The compositions of the invention may contain a lime soap peptiser compound, which has a lime soap dispersing power (LSDP), as defined hereinafter of no more than 8, preferably no more than 7, most preferably no more than 6. The lime soap peptiser compound is preferably present at a level from 0% to 20% by weight.

A numerical measure of the effectiveness of a lime soap peptiser is given by the lime soap dispersant power (LSDP) which is determined using the lime soap dispersant test as described in an article by H. C. Borghetty and C. A. Bergman, J. Am. Oil. Chem. Soc., volume 27, pages 88–90, (1950). This lime soap dispersion test method is widely used by practitioners in this art field being referred to, for example, in the following review articles; W. N. Linfield, Surfactant science Series, Volume 7, page 3; W. N. Linfield, Tenside surf. det., volume 27, pages 159–163, (1990); and M. K. Nagarajan, W. F. Masler, Cosmetics and Toiletries, volume 104, pages 71–73, (1989). The LSDP is the % weight ratio of dispersing agent to sodium oleate required to disperse the lime soap deposits formed by 0.025 g of sodium oleate in 30 ml of water of 333 ppm $CaCo_3$ (Ca:Mg=3:2) equivalent hardness.

Surfactants having good lime soap peptiser capability will include certain amine oxides, betaines, sulfobetaines, alkyl ethoxysulfates and ethoxylated alcohols.

Exemplary surfactants having a LSDP of no more than 8 for use in accord with the present invention include $C_{16}$–$C_{18}$ dimethyl amine oxide, $C_{12-C18}$ alkyl ethoxysulfates with an average degree of ethoxylation of from 1–5, particularly $C_{12-C15}$ alkyl ethoxysulfate surfactant with a degree of ethoxylation of amount 3 (LSDP=4), and the $C_{14-C15}$ ethoxylated alcohols with an average degree of ethoxylation of either 12 (LSDP=6) or 30, sold under the tradenames Lutensol A012 and Lutensol A030 respectively, by BASF GmbH.

Polymeric lime soap peptisers suitable for use herein are described in the article by M. K. Nagarajan, W. F. Masler, to be found in Cosmetics and Toiletries, volume 104, pages 71–73, (1989).

Hydrophobic bleaches such as 4-[N-octanoyl-6-aminohexanoyl]benzene sulfonate, 4-[N-nonanoyl-6-aminohexanoyl]benzene sulfonate, 4-[N-decanoyl-6-aminohexanoyl] benzene sulfonate and mixtures thereof; and nonanoyloxy benzene sulfonate together with hydrophilic/hydrophobic bleach formulations can also be used as lime soap peptisers compounds.

Enzymes—The bleaching compositions can comprise in addition to the amylase of the present invention one or more detergent enzymes which provide cleaning performance and/or fabric care benefits. Such enzymes can include proteases, amylases, cellulases and lipases. They may be incorporated into the non-aqueous liquid bleaching compositions herein in the form of suspensions, "marumes" or "prills". Another suitable type of enzyme comprises those in the form of slurries of enzymes in nonionic surfactants, e.g., the enzymes marketed by Novo Nordisk under the tradename "SL" or the microencapsulated enzymes marketed by Novo Nordisk under the tradename "LDP." Suitable enzymes and levels of use are described in U.S. Pat. No. 5,576,282.

Enzymes added to the compositions herein in the form of conventional enzyme prills are especially preferred for use herein. Such prills will generally range in size from about 100 to 1,000 microns, more preferably from about 200 to 800 microns and will be suspended throughout the non-aqueous liquid phase of the composition. Prills in the compositions of the present invention have been found, in comparison with other enzyme forms, to exhibit especially desirable enzyme stability in terms of retention of enzymatic activity over time. Thus, compositions which utilize enzyme prills need not contain conventional enzyme stabilizing such as must frequently be used when enzymes are incorporated into aqueous liquid detergents.

Examples of suitable enzymes include, but are not limited to, hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase, and known amylases, or mixtures thereof. A preferred combination is a bleaching composition having a cocktail of conventional applicable enzymes like protease, lipase, cutinase and/or cellulase in conjunction with the amylase of the present invention.

Examples of such suitable enzymes are disclosed in U.S. Pat. Nos. 5,576,282, 5,728,671 and 5,707,950

Suitable proteases are the subtilisins which are obtained from particular strains of *B. subtilis* and *B. licheniformis* (subtilisin BPN and BPN'). One suitable protease is obtained from a strain of *Bacillus*, having maximum activity throughout the pH range of 8–12, developed and sold as ESPERASE® by Novo Industries A/S of Denmark, hereinafter "Novo". The preparation of this enzyme and analogous enzymes is described in GB 1,243,784 to Novo. Other suitable proteases include ALCALASE®, DURAZYM® and SAVINASE®from Novo and MAXATASE®, MAXACAL®, PROPERASE® and MAXAPEM® (protein engineered Maxacal) from Gist-Brocades. Proteolytic enzymes also encompass modified bacterial serine proteases, such as those described in European Patent Application Serial Number 87 303761.8, filed Apr. 28, 1987 (particularly pages 17, 24 and 98), and which is called herein "Protease B", and in European Patent Application 199,404, Venegas, published Oct. 29, 1986, which refers to a modified bacterial serine protealytic enzyme which is called "Protease A" herein. More preferred is what is called herein "Protease C", which is a variant of an alkaline serine protease from *Bacillus* in which lysine replaced arginine at position 27, tyrosine replaced valine at position 104, serine replaced asparagine at position 123, and alanine replaced threonine at position 274. Protease C is described in EP 90915958:4, corresponding to WO 91/06637, Published May 16, 1991. Genetically modified variants, particularly of Protease C, are also included herein. See also a high pH protease from *Bacillus* sp. NCIMB 40338 described in WO 93/18140 A to Novo. Enzymatic detergents comprising protease, one or more other enzymes, and a reversible protease inhibitor are described in WO 92/03529 A to Novo. When desired, a protease having decreased adsorption and increased hydrolysis is available as described in WO 95/07791 to Procter & Gamble. A recombinant trypsin-like protease for detergents suitable herein is described in WO 94/25583 to Novo.

In more detail, the protease referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166, +195, +197, +204, +206, +210, +216, +217, +218, +222, +260, +265, and/or +274 according to the numbering of *Bacillus amyloliquefaciens* subtilisin, as described in WO 95/10615 published Apr. 20, 1995 by Genencor International. Also suitable for the present invention are proteases described in patent applications EP 251 446 and WO91/06637 and protease BLAP® described in WO91/02792. The proteolytic enzymes are incorporated in the bleaching compositions of the present invention a level of from 0.0001% to 2%, preferably from 0.001% to 0.2%, more preferably from 0.005% to 0.1% pure enzyme by weight of the composition.

Useful proteases are also described in PCT publications: WO 95/30010 published Nov. 9, 1995 by The Procter & Gamble Company; WO 95/30011 published Nov. 9, 1995 by The Procter & Gamble Company; WO 95/29979 published Nov. 9, 1995 by The Procter & Gamble Company.

Other particularly useful proteases are multiply-substituted protease variants comprising a substitution of an amino acid residue with another naturally occurring amino acid residue at an amino acid residue position corresponding to position 103 of *Bacillus amyloliquefaciens* subtilisin in combination with a substitution of an amino acid residue with another naturally occurring amino acid residue at one or more amino acid residue positions corresponding to positions 1, 3, 4, 8, 9, 10, 12, 13, 16, 17, 18, 19, 20, 21, 22, 24, 27, 33, 37, 38, 42, 43, 48, 55, 57, 58, 61, 62, 68, 72, 75, 76, 77, 78, 79, 86, 87, 89, 97, 98, 99, 101, 102, 104, 106, 107, 109, 111, 114, 116, 117, 119, 121, 123, 126, 128, 130, 131, 133, 134, 137, 140, 141, 142, 146, 147, 158, 159, 160, 166, 167, 170, 173, 174, 177, 181, 182, 183, 184, 185, 188, 192, 194, 198, 203, 204, 205, 206, 209, 210, 211, 212, 213, 214, 215, 216, 217, 218, 222, 224, 227, 228, 230, 232, 236, 237, 238, 240, 242, 243, 244, 245, 246, 247, 248, 249, 251, 252, 253, 254, 255, 256, 257, 258, 259, 260, 261, 262, 263, 265, 268, 269, 270, 271, 272, 274 and 275 of *Bacillus amyloliquefaciens* subtilisin; wherein when said protease variant includes a substitution of amino acid residues at positions corresponding to positions 103 and 76, there is also a substitution of an amino acid residue at one or more amino acid residue positions other than amino acid residue positions corresponding to positions 27, 99, 101, 104, 107, 109, 123, 128, 166, 204, 206, 210, 216, 217, 218, 222, 260, 265 or 274 of *Bacillus amyloliquefaciens* subtilisin and/or multiply-substituted protease variants comprising a substitution of an amino acid residue with another naturally occurring amino acid residue at one or more amino acid residue positions corresponding to positions 62, 212, 230, 232, 252 and 257 of *Bacillus amyloliquefaciens* subtilisin as described in PCT Patent Publication Nos. WO 99/20727, WO 99/20726 and WO 99/20723 all filed on Oct. 23, 1998 by The Procter & Gamble Company. More preferably the protease variant includes a substitution set selected from the group consisting of:

12/76/103/104/130/222/245/261;
62/103/104/159/232/236/245/248/252;
62/103/104/159/213/232/236/245/248/252;
62/101/103/104/159/212/213/232/236/245/248/252;
68/103/104/159/232/236/245;
68/103/104/159/230/232/236/245;
68/103/104/159/209/232/236/245;
68/103/104/159/232/236/245/257;
68/76/103/104/159/213/232/236/245/260;
68/103/104/159/213/232/236/245/248/252;
68/103/104/159/183/232/236/245/248/252;
68/103/104/159/185/232/236/245/248/252;
68/103/104/159/185/210/232/236/245/248/252;
68/103/104/159/210/232/236/245/248/252;
68/103/104/159/213/232/236/245;
98/103/104/159/232/236/245/248/252;
98/102/103/104/159/212/232/236/245/248/252;
101/103/104/159/232/236/245/248/252;
102/103/104/159/232/236/245/248/252;
103/104/159/230/236/245;
103/104/159/232/236/245/248/252;
103/104/159/217/232/236/245/248/252;
103/104/130/159/232/236/245/248/252;
103/104/131/159/232/236/245/248/252;
103/104/159/213/232/236/245/248/252; and
103/104/159/232/236/245.

Still even more preferably the protease variant includes a substitution set selected from the group consisting of:

12R/76D/103A/104T/130T/222S/245R/261D;
62D/103A/104I/159D/232V/236H/245R/248D/252K;
62D/103A/104I/159D/213R/232V/236H/245R/248D/252K;
68A/103A/104I/159D/209W/232V/236H/245R;
68A/76D/103A/104I/159D/213R/232V/236H/245R/260A;
68A/103A/104I/159D/213E/232V/236H/245R/248D/252K;
68A/103A/104I/159D/183D/232V/236H/245R/248D/252K;
68A/103A/104I/159D/232V/236H/245R;
68A/103A/104I/159D/230V/232V/236H/245R;
68A/103A/104I/159D/232V/236H/245R/257V;
68A/103A/104I/159D/213G/232V/236H/245R/248D/252K;
68A/103A/104I/159D/185D/232V/236H/245R/248D/252K;
68A/103A/104I/159D/185D/210L/232V/236H/245R/248D/252K;
68A/103A/104I/159D/210L/232V/236H/245R/248D/252K;
68A/103A/104I/159D/213G/232V/236H/245R;
98L/103A/104I/159D/232V/236H/245R/248D/252K;
98L/102A/103A/104I/159D/212G/232V/236H/245R/248D/252K;
101G/103A/104I/159D/232V/236H/245R/248D/252K;
102K/103A/104I/159D/232V/236H/245R/248D/252K;
103A/104I/159D/230V/236H/245R;
103A/104I/159D/232V/236H/245R/248D/252K;
103A/104I/159D/217E/232V/236H/245R/248D/252K;
103A/104I/130G/159D/232V/236H/245R/248D/252K;
103A/104I/131V/159D/232V/236H/245R/248D/252K;
103A/104I/159D/213R/232V/236H/245R/248D/252K; and
103A/104I/159D/232V/236H/245R.

Most preferably the protease variant includes the substitution set 101/103/104/159/232/236/245/248/252, preferably 101 G/103A/104I/159D/232V/236H/245R/248D/252K.

The cellulases usable in the present invention include both bacterial or fungal cellulase. Preferably, they will have a pH optimum of between 5 and 9.5. Suitable cellulases are disclosed in U.S. Pat. No. 4,435,307, Barbesgoard et al, which discloses fungal cellulase produced from *Humicola insolens*. Suitable cellulases are also disclosed in GB-A-2.075.028; GB-A-2.095.275 and DE-OS-2.247.832.

Examples of such cellulases are cellulases produced by a strain of *Humicola insolens* (*Humicola grisea* var. *thermoidea*), particularly the *Humicola* strain DSM 1800.

Other suitable cellulases are cellulases originated from *Humicola insolens* having a molecular weight of about 50 KDa, an isoelectric point of 5.5 and containing 415 amino acids; and a ~43 kD endoglucanase derived from *Humicola insolens*, DSM 1800, exhibiting cellulase activity; a preferred endoglucanase component has the amino acid sequence disclosed in PCT Patent Application No. WO 91/17243. Also suitable cellulases are the EGIII cellulases from *Trichoderma longibrachiatum* described in WO94/21801, Genencor, published Sep. 29, 1994. Especially suitable cellulases are the cellulases having color care benefits. Examples of such cellulases are cellulases described in European patent application No. 91202879.2, filed Nov. 6, 1991 (Novo). Carezyme and Celluzyme (Novo Nordisk A/S) are especially useful. See also WO91/17243.

Peroxidase enzymes are known in the art, and include, for example, horseradish peroxidase, ligninase and haloperoxidase such as chloro- and bromo-peroxidase. Peroxidase-containing bleaching compositions are disclosed, for example, in U.S. Pat. Nos. 5,576,282, 5,728,671 and 5,707,950, PCT International Applications WO 89/099813, WO89/09813 and in European Patent application EP No. 91202882.6, filed on Nov. 6, 1991 and EP No. 96870013.8, filed Feb. 20, 1996. Also suitable is the laccase enzyme.

Preferred enhancers are substituted phenthiazine and phenoxasine 10-Phenothiazinepropionicacid (PPT), 10-ethylphenothiazine-4-carboxylic acid (EPC), 10-phenoxazinepropionic acid (POP) and 10-methylphenoxazine (described in WO 94/12621) and substituted syringates ($C_3$–$C_5$ substituted alkyl syringates) and phenols. Sodium percarbonate or perborate are preferred sources of hydrogen peroxide.

Said peroxidases are normally incorporated in the bleaching composition at levels from 0.0001% to 2% of active enzyme by weight of the bleaching composition.

Other preferred enzymes that can be included in the bleaching compositions of the present invention include lipases. Suitable lipase enzymes for detergent usage include those produced by microorganisms of the *Pseudomonas* group, such as *Pseudomonas stutzeri* ATCC 19.154, as disclosed in British Patent 1,372,034. Suitable lipases include those which show a positive immunological cross-reaction with the antibody of the lipase, produced by the microorganism *Pseudomonas* fluorescent IAM 1057. This lipase is available from Amano Pharmaceutical Co. Ltd., Nagoya, Japan, under the trade name Lipase P "Amano," hereinafter referred to as "Amano-P". Other suitable commercial lipases include Amano-CES, lipases ex *Chromobacter viscosum*, e.g. *Chromobacter viscosum* var. *lipolyticum* NRRLB 3673 from Toyo Jozo Co., Tagata, Japan; *Chromobacter viscosum* lipases from U.S. Biochemical Corp., U.S.A. and Disoynth Co., The Netherlands, and lipases ex *Pseudomonas* gladioli. Especially suitable lipases are lipases such as MI LIPASE® and LIPOMAX® (Gist-Brocades) and LIPOLASE® and LIPOLASE ULTRA® (Novo) which have found to be very effective when used in combination with the compositions of the present invention.

Also suitable are cutinases [EC 3.1.1.50] which can be considered as a special kind of lipase, namely lipases which do not require interfacial activation. Addition of cutinases to bleaching compositions have been described in e.g. WO 88/09367 (Genencor).

The lipases and/or cutinases are normally incorporated in the bleaching composition at levels from 0.0001% to 2% of active enzyme by weight of the bleaching composition.

Known amylases (α and/or β) can be included for removal of carbohydrate-based stains. WO 94/02597, Novo Nordisk A/S published Feb. 3, 1994, describes cleaning compositions which incorporate mutant amylases. See also WO94/18314, Genencor, published Aug. 18, 1994 and WO95/10603, Novo Nordisk A/S, published Apr. 20, 1995. Other amylases known for use in bleaching compositions include both α- and β-amylases. α-Amylases are known in the art and include those disclosed in U.S. Pat. No. 5,003,257; EP 252,666; WO 91/00353; FR 2,676,456; EP 285,123; EP 525,610; EP 368,341; and British Patent Specification No. 1,296,839 (Novo). Other suitable amylase are stability-enhanced amylases including PURAFACT OX AM® described in WO 94/18314, published Aug. 18, 1994 and WO96/05295, Genencor, published Feb. 22, 1996 and amylase variants from Novo Nordisk A/S, disclosed in WO 95/10603, published April 95.

Examples of commercial α-amylases products are TERMAMYL®, BAN®, FUNGAMYL® and DURAMYL®, all available from Novo Nordisk A/S Denmark. WO95/26397 describes other suitable amylases: α-amylases characterized by having a specific activity at least 25% higher than the specific activity of TERMAMYL® at a temperature range of 25° C. to 55° C. and at a pH value in the range of 8 to 10, measured by the Phadebas® α-amylase activity assay. Other amylolytic enzymes with improved properties with respect to the activity level and the combination of thermostability and a higher activity level are described in WO95/35382.

The compositions of the present invention may also comprise a mannanase enzyme. Preferably, the mannanase is selected from the group consisting of: three mannans-degrading enzymes: EC 3.2.1.25: β-mannosidase, EC 3.2.1.78: Endo-1,4-β-mannosidase, referred therein after as "mannanase" and EC 3.2.1.100: 1,4-β-mannobiosidase and mixtures thereof. (IUPAC Classification-Enzyme nomenclature, 1992 ISBN 0-12-227165-3 Academic Press).

More preferably, the treating compositions of the present invention, when a mannanase is present, comprise a β-1,4-Mannosidase (E.C. 3.2.1.78) referred to as Mannanase. The term "mannanase" or "galactomannanase" denotes a mannanase enzyme defined according to the art as officially being named mannan endo-1,4-beta-mannosidase and having the alternative names beta-mannanase and endo-1,4-mannanase and catalysing the reaction: random hydrolysis of 1,4-beta-D-mannosidic linkages in mannans, galactomannans, glucomannans, and galactoglucomannans.

In particular, Mannanases (EC 3.2.1.78) constitute a group of polysaccharases which degrade mannans and denote enzymes which are capable of cleaving polyose chains containing mannose units, i.e. are capable of cleaving glycosidic bonds in mannans, glucomannans, galactomannans and galactogluco-mannans. Mannans are polysaccharides having a backbone composed of β-1,4-linked mannose; glucomannans are polysaccharides having a backbone or more or less regularly alternating β-1,4 linked mannose and glucose; galactomannans and galactoglucomannans are mannans and glucomannans with α-1,6 linked galactose sidebranches. These compounds may be acetylated.

The degradation of galactomannans and galactoglucomannans is facilitated by full or partial removal of the galactose sidebranches. Further the degradation of the acetylated mannans, glucomannans, galactomannans and galactogluco-mannans is facilitated by full or partial deacetylation. Acetyl groups can be removed by alkali or by mannan acetylesterases. The oligomers which are released from the mannanases or by a combination of mannanases and α-galactosidase and/or mannan acetyl esterases can be further degraded to release free maltose by β-mannosidase and/or β-glucosidase.

Mannanases have been identified in several *Bacillus* organisms. For example, Talbot et al., Appl. Environ. Microbiol., Vol. 56, No. 11, pp. 3505–3510 (1990) describes a beta-mannanase derived from *Bacillus stearothermophilus* in dimer form having molecular weight of 162 kDa and an optimum pH of 5.5–7.5. Mendoza et al., World J. Microbiol. Biotech., Vol. 10, No. 5, pp. 551–555 (1994) describes a beta-mannanase derived from *Bacillus subtilis* having a molecular weight of 38 kDa, an optimum activity at pH 5.0 and 55C and a pI of 4.8. JP-03047076 discloses a beta-mannanase derived from *Bacillus* sp., having a molecular weight of 373 kDa measured by gel filtration, an optimum pH of 8–10 and a pI of 5.3–5.4. JP-63056289 describes the production of an alkaline, thermostable beta-mannanase which hydrolyses beta-1,4-D-mannopyranoside bonds of e.g. mannans and produces manno-oligosaccharides. JP-63036774 relates to the *Bacillus* microorganism FERM P-8856 which produces beta-mannanase and beta-mannosidase at an alkaline pH. JP-08051975 discloses alkaline beta-mannanases from alkalophilic *Bacillus* sp. AM-001. A purified mannanase from *Bacillus amyloliquefaciens* useful in the bleaching of pulp and paper and a method of preparation thereof is disclosed in WO 97/11164. WO 91/18974 describes a hemicellulase such as a glucanase, xylanase or mannanase active at an extreme pH and temperature. WO 94/25576 discloses an enzyme from *Aspergillus aculeatus*, CBS 101.43, exhibiting mannanase activity which may be useful for degradation or modification of plant or algae cell wall material. WO 93/24622 discloses a mannanase isolated from *Trichoderma reseei* useful for bleaching lignocellulosic pulps. An hemicellulase capable of degrading mannan-containing hemicellulose is described in WO91/18974 and a purified mannanase from *Bacillus amyloliquefaciens* is described in WO97/11164.

Preferably, the mannanase enzyme will be an alkaline mannanase as defined below, more preferably, a mannanase originating from a bacterial source. Especially, the laundry detergent composition of the present invention will comprise an alkaline mannanase selected from the mannanase from the strain *Bacillus agaradhaerens* NICMB 40482; the mannanase from *Bacillus subtilis* strain 168, gene yght; the mannanase from *Bacillus* sp. 1633 and/or the mannanase from *Bacillus* sp. AAI12. Most preferred mannanase for the inclusion in the detergent compositions of the present invention is the mannanase enzyme originating from *Bacillus* sp. 1633 as described in the co-pending Danish patent application No. PA 1998 01340.

The terms "alkaline mannanase enzyme" is meant to encompass an enzyme having an enzymatic activity of at least 10%, preferably at least 25%, more preferably at least 40% of its maximum activity at a given pH ranging from 7 to 12, preferably 7.5 to 10.5.

The alkaline mannanase from *Bacillus agaradhaerens* NICMB 40482 is described in the co-pending U.S. patent application Ser. No. 09/111,256. More specifically, this mannanase is:

i) a polypeptide produced by *Bacillus agaradhaerens*, NCIMB 40482; or ii) a polypeptide comprising an amino acid sequence as shown in positions 32–343 of SEQ ID NO:2 as shown in U.S. patent application Ser. No. 09/111,256; or iii) an analogue of the polypeptide defined in i) or ii) which is at least 70% homologous with said polypeptide, or is derived from said polypeptide by substitution, deletion or addition of one or several amino acids, or is immunologically reactive with a polyclonal antibody raised against said polypeptide in purified form.

Also encompassed is the corresponding isolated polypeptide having mannanase activity selected from the group consisting of:

(a) polynucleotide molecules encoding a polypeptide having mannanase activity and comprising a sequence of nucleotides as shown in SEQ ID NO: 1 from nucleotide 97 to nucleotide 1029 as shown in U.S. patent application Ser. No. 09/111,256;
(b) species homologs of (a);
(c) polynucleotide molecules that encode a polypeptide having mannanase activity that is at least 70% identical to the amino acid sequence of SEQ ID NO: 2 from amino acid residue 32 to amino acid residue 343 as shown in U.S. patent application Ser. No. 09/111,256;
(d) molecules complementary to (a), (b) or (c); and
(e) degenerate nucleotide sequences of (a), (b), (c) or (d).

The plasmid pSJ1678 comprising the polynucleotide molecule (the DNA sequence) encoding said mannanase has been transformed into a strain of the *Escherichia coli* which was deposited by the inventors according to the Budapest Treaty on the International Recognition of the Deposit of Microorganisms for the Purposes of Patent Procedure at the Deutsche Sammlung von Mikroorganismen und Zellkulturen GmbH, Mascheroder Weg 1b, D-3 8124 Braunschweig, Federal Republic of Germany, on 18 May 1998 under the deposition number DSM 12180.

A second more preferred enzyme is the mannanase from the *Bacillus subtilis* strain 168, which is described in the co-pending U.S. patent application Ser. No. 09/095,163. More specifically, this mannanase is:

i) is encoded by the coding part of the DNA sequence shown in SED ID No. 5 shown in the U.S. patent application Ser. No. 09/095,163 or an analogue of said sequence; and/or
ii) a polypeptide comprising an amino acid sequence as shown SEQ ID NO:6 shown in the U.S. patent application Ser. No. 09/095,163; or
iii) an analogue of the polypeptide defined in ii) which is at least 70% homologous with said polypeptide, or is derived from said polypeptide by substitution, deletion or addition of one or several amino acids, or is immunologically reactive with a polyclonal antibody raised against said polypeptide in purified form.

Also encompassed in the corresponding isolated polypeptide having mannanase activity selected from the group consisting of:

(a) polynucleotide molecules encoding a polypeptide having mannanase activity and comprising a sequence of nucleotides as shown in SEQ ID NO:5 as shown in the U.S. patent application Ser. No. 09/095,163
(b) species homologs of (a);
(c) polynucleotide molecules that encode a polypeptide having mannanase activity that is at least 70% identical to the amino acid sequence of SEQ ID NO: 6 as shown in the U.S. patent application Ser. No. 09/095,163;
(d) molecules complementary to (a), (b) or (c); and
(e) degenerate nucleotide sequences of (a), (b), (c) or (d).

A third more preferred mannanase is described in the co-pending Danish patent application No. PA 1998 01340. More specifically, this mannanase is:

i) a polypeptide produced by *Bacillus* sp. 1633;
ii) a polypeptide comprising an amino acid sequence as shown in positions 33–340 of SEQ ID NO:2 as shown in the Danish application No. PA 1998 01340; or
iii) an analogue of the polypeptide defined in i) or ii) which is at least 65% homologous with said polypeptide, is derived from said polypeptide by substitution, deletion or addition of one or several amino acids, or is immunologically reactive with a polyclonal antibody raised against said polypeptide in purified form.

Also encompassed is the corresponding isolated polynucleotide molecule selected from the group consisting of:

(a) polynucleotide molecules encoding a polypeptide having mannanase activity and comprising a sequence of nucleotides as shown in SEQ ID NO: 1 from nucleotide 317 to nucleotide 1243 the Danish application No. PA 1998 01340;
(b) species homologs of (a);
(c) polynucleotide molecules that encode a polypeptide having mannanase activity that is at least 65% identical to the amino acid sequence of SEQ ID NO: 2 from amino acid residue 33 to amino acid residue 340 the Danish application No. PA 1998 01340;
(d) molecules complementary to (a), (b) or (c); and
(e) degenerate nucleotide sequences of (a), (b), (c) or (d).

The plasmid pBXM3 comprising the polynucleotide molecule (the DNA sequence) encoding a mannanase of the present invention has been transformed into a strain of the *Escherichia coli* which was deposited by the inventors according to the Budapest Treaty on the International Recognition of the Deposit of Microorganisms for the Purposes of Patent Procedure at the Deutsche Sammlung von Mikroorganismen und Zellkulturen GmbH, Mascheroder Weg 1b, D-38124 Braunschweig, Federal Republic of Germany, on 29 May 1998 under the deposition number DSM 12197.

A fourth more preferred mannanase is described in the Danish co-pending patent application No. PA 1998 01341. More specifically, this mannanase is:

i) a polypeptide produced by *Bacillus* sp. AAI 12;
ii) a polypeptide comprising an amino acid sequence as shown in positions 25–362 of SEQ ID NO:2 as shown in the Danish application No. PA 1998 01341; or
iii) an analogue of the polypeptide defined in i) or ii) which is at least 65% homologous with said polypeptide, is derived from said polypeptide by substitution, deletion or addition of one or several amino acids, or is immunologically reactive with a polyclonal antibody raised against said polypeptide in purified form.

Also encompassed is the corresponding isolated polynucleotide molecule selected from the group consisting of (a) polynucleotide molecules encoding a polypeptide having mannanase activity and comprising a sequence of nucleotides as shown in SEQ ID NO: 1 from nucleotide 225 to nucleotide 1236 as shown in the Danish application No. PA 1998 01341;
(b) species homologs of (a);
(c) polynucleotide molecules that encode a polypeptide having mannanase activity that is at least 65% identical to the amino acid sequence of SEQ ID NO: 2 from amino acid residue 25 to amino acid residue 362 as shown in the Danish application No. PA 1998 01341;
(d) molecules complementary to (a), (b) or (c); and
(e) degenerate nucleotide sequences of (a), (b), (c) or (d).

The plasmid pBXM1 comprising the polynucleotide molecule (the DNA sequence) encoding a mannanase of the present invention has been transformed into a strain of the *Escherichia coli* which was deposited by the inventors according to the Budapest Treaty on the International Recognition of the Deposit of Microorganisms for the Purposes of Patent Procedure at the Deutsche Sammlung von Mikroorganismen und Zellkulturen GmbH, Mascheroder Weg 1b, D-38124 Braunschweig, Federal Republic of Germany, on 7 Oct. 1998 under the deposition number DSM 12433.

The mannanase, when present, is incorporated into the treating compositions of the present invention preferably at a level of from 0.0001% to 2%, more preferably from 0.0005% to 0.1%, most preferred from 0.001% to 0.02% pure enzyme by weight of the composition.

The compositions of the present invention may also comprise a xyloglucanase enzyme. Suitable xyloglucanases for the purpose of the present invention are enzymes exhibiting endoglucanase activity specific for xyloglucan, preferably at a level of from about 0.001% to about 1%, more preferably from about 0.01% to about 0.5%, by weight of the composition. As used herein, the term "endoglucanase activity" means the capability of the enzyme to hydrolyze 1,4-β-D-glycosidic linkages present in any cellulosic material, such as cellulose, cellulose derivatives, lichenin, β-D-glucan, or xyloglucan. The endoglucanase activity may be determined in accordance with methods known in the art, examples of which are described in WO 94/14953 and hereinafter. One unit of endoglucanase activity (e.g. CMCU, AVIU, XGU or BGU) is defined as the production of 1 μmol reducing sugar/min from a glucan substrate, the glucan substrate being, e.g., CMC (CMCU), acid swollen Avicell (AVIU), xyloglucan (XGU) or cereal β-glucan (BGU). The reducing sugars are determined as described in WO 94/14953 and hereinafter. The specific activity of an endoglucanase towards a substrate is defined as units/mg of protein.

Suitable are enzymes exhibiting as its highest activity XGU endoglucanase activity (hereinafter "specific for xyloglucan"), which enzyme:

i) is encoded by a DNA sequence comprising or included in at least one of the following partial sequences (a) ATTCATTTGT GGACAGTGGA C (SEQ ID No: 1)

(b) GTTGATCGCA CATTGAACCA (SEQ ID NO: 2)

(c) ACCCCAGCCG ACCGATTGTC (SEQ ID NO: 3)

(d) CTTCCTTACC TCACCATCAT (SEQ ID NO: 4)

(e) TTAACATCTT TTCACCATGA (SEQ ID NO: 5)

(f) AGCTTTCCCT TCTCTCCCTT (SEQ ID NO: 6)

(g) GCCACCCTGG CTTCCGCTGC CAGCCTCC (SEQ ID NO: 7)

(h) GACAGTAGCA ATCCAGCATT (SEQ ID NO: 8)

(i) AGCATCAGCC GCTTTGTACA (SEQ ID NO: 9)

(j) CCATGAAGTT CACCGTATTG (SEQ ID NO: 10)

(k) GCACTGCTTC TCTCCCAGGT (SEQ ID NO: 11)

(l) GTGGGCGGCC CCTCAGGCAA (SEQ ID NO: 12)

(m) ACGCTCCTCC AATTTTCTCT (SEQ ID NO: 13)

(n) GGCTGGTAG TAATGAGTCT (SEQ ID NO: 14)

(o) GGCGCAGAGT TTGGCCAGGC (SEQ ID NO: 15)

(p) CAACATCCCC GGTGTTCTGG G (SEQ ID NO: 16)

(q) AAAGATTCAT TTGTGGACAG TGGACGTTGA TCGCACATTG (SEQ ID NO: 17)

AACCAACCCC AGCCGACCGA

TTGTCCTTCC TTACCTCACC ATCATTTAAC ATCTTTTCAC CATGAAGCTT

TCCCTTCTCT

CCCTTGCCAC CCTGGCTTCC GCTGCCAGCC TCCAGCGCCG CACACTTCTG

CGGTCAGTGG

GATACCGCCA CCGCCGGTGA CTTCACCCTG TACAACGACC TTTGGGGCGA

GACGGCCGGC

ACCGGCTCCC AGTGCACTGG AGTCGACTCC TACAGCGGCG ACACCATCGC

TTGTCACACC

AGCAGGTCCT GGTCGGAGTA GCAGCAGCGT CAAGAGCTAT GCCAACG or

-continued (r) CAGCATCTCC ATTGAGTAAT CACGTTGGTG TTCGGTGGCC CGCCGTGTTG (SEQ ID NO: 18)

CGTGGCGGAG

GCTGCCGGGA GACGGGTGGG GATGGTGGTG GGAGAGAATG TAGGGCGCCG

TGTTTCAGTC

CCTAGGCAGG ATACCGGAAA ACCGTGTGGT AGGAGGTTTA TAGGTTTCCA

GGAGACGCTG

TATAGGGGAT AAATGAGATT GAATGGTGGC CACACTCAAA CCAACCAGGT

CCTGTACATA

CAATGCATAT ACCAATTATA CCTACCAAAA AAAAAAAAAA AAAAAAAAAA

AAAA or a sequence homologous thereto encoding a polypeptide specific for xyloglucan with endoglucanase activity, ii) is immunologically reactive with an antibody raised against a highly purified endoglucanase encoded by the DNA sequence defined in i) and derived from *Aspergillus aculeatus*, CBS 101.43, and is specific for xyloglucan.

More specifically, as used herein the term "specific for xyloglucan" means that the endoglucanse enzyme exhibits its highest endoglucanase activity on a xyloglucan substrate, and preferably less than 75% activity, more preferably less than 50% activity, most preferably less than about 25% activity, on other cellulose-containing substrates such as carboxymethyl cellulose, cellulose, or other glucans.

Preferably, the specificity of an endoglucanase towards xyloglucan is further defined as a relative activity determined as the release of reducing sugars at optimal conditions obtained by incubation of the enzyme with xyloglucan and the other substrate to be tested, respectively. For instance, the specificity may be defined as the xyloglucan to β-glucan activity (XGU/BGU), xyloglucan to carboxy methyl cellulose activity (XGU/CMCU), or xyloglucan to acid swollen Avicell activity (XGU/AVIU), which is preferably greater than about 50, such as 75, 90 or 100.

The term "derived from" as used herein refers not only to an endoglucanase produced by strain CBS 101.43, but also an endoglucanase encoded by a DNA sequence isolated from strain CBS 101.43 and produced in a host organism transformed with said DNA sequence. The term "homologue" as used herein indicates a polypeptide encoded by DNA which hybridizes to the same probe as the DNA coding for an endoglucanase enzyme specific for xyloglucan under certain specified conditions (such as presoaking in 5×SSC and prehybridizing for 1 h at −40° C. in a solution of 5×SSC, 5×Denhardt's solution, and 50 μg of denatured sonicated calf thymus DNA, followed by hybridization in the same solution supplemented with 50 μCi 32-P-dCTP labeled probe for 18 h at −40° C. and washing three times in 2×SSC, 0.2% SDS at 40° C. for 30 minutes). More specifically, the term is intended to refer to a DNA sequence which is at least 70% homologous to any of the sequences shown above encoding an endoglucanase specific for xyloglucan, including at least 75%, at least 80%, at least 85%, at least 90% or even at least 95% with any of the sequences shown above. The term is intended to include modifications of any of the DNA sequences shown above, such as nucleotide substitutions which do not give rise to another amino acid sequence of the polypeptide encoded by the sequence, but which correspond to the codon usage of the host organism into which a DNA construct comprising any of the DNA sequences is introduced or nucleotide substitutions which do give rise to a different amino acid sequence and therefore, possibly, a different amino acid sequence and therefore, possibly, a different protein structure which might give rise to an endoglucanase mutant with different properties than the native enzyme. Other examples of possible modifications are insertion of one or more nucleotides into the sequence, addition of one or more nucleotides at either end of the sequence, or deletion of one or more nucleotides at either end or within the sequence.

Endoglucanase specific for xyloglucan useful in the present invention preferably is one which has a XGU/BGU, XGU/CMU and/or XGU/AVIU ratio (as defined above) of more than 50, such as 75, 90 or 100.

Furthermore, the endoglucanase specific for xyloglucan is preferably substantially devoid of activity towards β-glucan and/or exhibits at the most 25% such as at the most 10% or about 5%, activity towards carboxymethyl cellulose and/or Avicell when the activity towards xyloglucan is 100%. In addition, endoglucanase specific for xyloglucan of the invention is preferably substantially devoid of transferase activity, an activity which has been observed for most endoglucanases specific for xyloglucan of plant origin.

Endoglucanase specific for xyloglucan may be obtained from the fungal species *A. aculeatus*, as described in WO 94/14953. Microbial endoglucanases specific for xyloglucan has also been described in WO 94/14953. Endoglucanases specific for xyloglucan from plants have been described, but these enzymes have transferase activity and therefore must be considered inferior to microbial endoglucanses specific for xyloglucan whenever extensive degradation of xyloglucan is desirable. An additional advantage of a microbial enzyme is that it, in general, may be produced in higher amounts in a microbial host, than enzymes of other origins.

The xyloglucanase, when present, is incorporated into the treating compositions of the invention preferably at a level of from 0.0001% to 2%, more preferably from 0.0005% to 0.1%, most preferred from 0.001% to 0.02% pure enzyme by weight of the composition.

The above-mentioned enzymes may be of any suitable origin, such as vegetable, animal, bacterial, fungal and yeast origin. Purified or non-purified forms of these enzymes may be used. Also included by definition, are mutants of native enzymes. Mutants can be obtained e.g. by protein and/or genetic engineering, chemical and/or physical modifications of native enzymes. Common practice as well is the expression of the enzyme via host organisms in which the genetic material responsible for the production of the enzyme has been cloned.

Said enzymes are normally incorporated in the bleaching composition at levels from 0.0001% to 2% of active enzyme by weight of the bleaching composition. The enzymes can be added as separate single ingredients (prills, granulates, stabilized liquids, etc. containing one enzyme) or as mixtures of two or more enzymes (e.g. cogranulates).

Other suitable detergent ingredients that can be added are enzyme oxidation scavengers. Examples of such enzyme oxidation scavengers are ethoxylated tetraethylene polyamines.

A range of enzyme materials and means for their incorporation into synthetic bleaching compositions is also disclosed in WO 93/07263 and WO 93/07260 to Genencor International, WO 89/08694 to Novo, and U.S. Pat. No. 3,553,139, Jan. 5, 1971 to McCarty et al. Enzymes are further disclosed in U.S. Pat. No. 4,101,457, Place et al, Jul. 18, 1978, and in U.S. Pat. No. 4,507,219, Hughes, Mar. 26, 1985. Enzyme materials useful for liquid detergent formulations, and their incorporation into such formulations, are disclosed in U.S. Pat. No. 4,261,868, Hora et al, Apr. 14, 1981.

Enzyme Stabilizers—Enzymes for use in detergents can be stabilized by various techniques. Enzyme stabilization techniques are disclosed and exemplified in U.S. Pat. No. 3,600,319, Aug. 17, 1971, Gedge et al, EP 199,405 and EP 200,586, Oct. 29, 1986, Venegas. Enzyme stabilization systems are also described, for example, in U.S. Pat. No. 3,519,570. A useful *Bacillus*, sp. AC13 giving proteases, xylanases and cellulases, is described in WO 9401532 to Novo. The enzymes employed herein can be stabilized by the presence of water-soluble sources of calcium and/or magnesium ions in the finished compositions which provide such ions to the enzymes. Suitable enzyme stabilizers and levels of use are described in U.S. Pat. No. 5,576,282.

Other Detergent Ingredients—The bleaching compositions herein may also optionally contain one or more of the following: polymeric dispersing agents, clay soil removal/anti-redeposition agents, brighteners, suds suppressors, dyes, perfumes, structure elasticizing agents, fabric softeners, carriers, hydrotropes, processing aids and/or pigments. Suitable examples of such other detergent ingredients and levels of use are found in U.S. Pat. No. 5,576,282.

Methods for Laundering Fabrics

The organic catalysts and compositions containing same of the present invention may be used in essentially any washing or cleaning methods, including soaking methods, pretreatment methods and methods with rinsing steps for which a separate rinse aid composition may be added.

The method for laundering fabrics described herein preferably comprises contacting fabrics with a laundering solution comprising an organic catalyst (in neat or in bleaching composition form) which becomes available in the laundering solution by a controlled availability method as defined in Test Protocols I, II and/or III. Optionally, but preferably the laundering solution comprises a peroxygen source.

The method of the invention is conveniently carried out in the course of the cleaning process. The method of cleaning is preferably carried out at 5° C. to 95° C., especially between 10° C. and 60° C. The pH of the laundering solution is preferably from 7 to 11.

Organic Catalyst Product

The organic catalysts and/or bleaching compositions of the present invention may be employed in various products for use in the laundering process.

In a preferred embodiment, a product comprising the organic catalyst and/or bleaching compositions containing the organic catalyst of the present invention wherein the organic catalyst becomes available in a wash solution containing the product by a controlled availability method as defined in Test Protocols I, II and/or III, as disclosed hereinafter, is provided. The product further includes instructions for using the organic catalyst and/or bleaching composition to clean a fabric in need of cleaning, preferably a stained fabric. The instructions include the step of delivering an amount of the product comprising the organic catalyst and/or bleaching composition, in conjunction with or without a peroxygen source, to a wash solution containing the fabric such that the organic catalyst becomes available in the wash solution by a controlled availability method as defined in Test Protocols I, II and/or III, as disclosed hereinafter.

Determination of Controlled Availability of Organic Catalyst

To facilitate the determination of whether an organic catalyst or a bleaching composition of the present invention or a product comprising an organic catalyst or bleaching composition of the present invention falls within the scope of this invention, three test protocols, Test Protocols I, II and III are provided below.

Only if Case $I_1$ for Protocol I, Case $II_1$ for Protocol II and Case $III_1$ for Protocol III are satisfied, does the organic catalyst-containing product (OCCP) not fall within the boundaries of this invention.

OCCP

Test Protocol I

General/Parameters: All solutions are maintained at 25° C. Adjustments of pH as required are accomplished using either sodium carbonate or sulfuric acid as appropriate. All solutions are continuously stirred at 250 rpm, except small (1–5 mL) dye bleaching solution (DBS) aliquots removed to measure absorbance. Absorbance values are measures at the $\lambda_{max}$ of the reference dye solution (RDS).

A test run is performed to determine if either of the parameters, $d_{bleach}$ or $w_{OCCP}$, need to be reset from their default values.

$d_{bleach}$ is a parameter in the final test protocol describing the time that elapses between the formation of the dye bleaching solution (DBS) and data acquisition. The default value of the parameter $d_{bleach}$ is 1 min, but may be defined as a longer time according to Case I below.

$w_{OCCP}$ is a parameter in the final test protocol describing the weight of organic catalyst-containing product (OCCP) used to form the organic catalyst-containing product solution (OCCPS). The default value of the parameter is 1.00 grams, but may be defined as a lesser quantity or weight according to Case II below.

CDS is the concentrated dye solution, defined as a 300 ppm solution of Amaranth dye (Aldrich) in deionized water at pH 10.

OCCP is a fully formulated organic catalyst-containing product (as defined hereinabove) in which the organic catalyst may be present with various adjunct ingredients.

OCCPS is the organic catalyst-containing product solution prepared by dissolving 1.00 g of an organic catalyst-containing product (OCCP) in 1.0 L of 25° C. deionized water, the pH of which has been previously adjusted such that the final solution has a pH between 9.9 and 10.1.

DBS is the dye bleaching solution formed from the addition of a 100 mL aliquot of the OCCPS to 10 mL of CDS.

Determination of $A_{max}$. 100 mL of deionized water at pH 10 is added to 10 mL of CDS. The absorbance of the resulting homogeneous reference dye solution (RDS) determined by UV-Visible Spectroscopy at the $\lambda_{max}$ (approximately 518 nm) is $A_{max}$.

Aliquot removal times: the times for aliquot removal from the OCCPS include both fixed ($t_f$) and duration defined ($t_{dd}$). The values of $t_f$ are 0.5, 1.5, 2.5 and 3.5 minutes. The values of $t_{dd}$ are 0.25D, 0.50D and 0.75D, wherein D is the recommended duration of the wash. Duration defined aliquots for which $t_{dd}$ is less than 5 minutes need not be taken. For the purposes of this test, D can be no less than 5 minutes nor no greater than 16 hours. If no wash duration is recommended by the manufacturer of the OCCP, then D is set to 20 minutes. For example, if the wash period is 60 minutes, the $t_{dd}$ required in addition to the $t_f$ are 15, 30 and 45 minutes. For a 12 minute wash period, the data points required are those associated with aliquot removals at 0.5, 1.5, 2.5, 3.5, 6 and 9 minutes.

The test is performed vide infra using the default values of $d_{bleach}$ and $w_{OCCp}$. From among all fixed and duration defined aliquots, identify the one aliquot, Q, which gives rise to the smallest measured absorbance, $A_{min}$. The time ($t_f$ or $t_{dd}$) at which Q is removed from the OCCPS is defined as $t_Q$. Note by definition that this is the same point that shows the greatest $\delta A$ ($A_{max}-A_{min}$). Three cases exist, depending upon the value of $A_{min}$.

Case 1: If $A_{min}>0.9\ A_{max}$, rerun the test to reset the value of $d_{bleach}$. In this new test, the aliquot removed at $t_Q$ is treated as before except it is stirred for additional 1 min increments until such time as the absorbance $A_{min}\leqq 0.9\ A_{max}$. The minimum number of minutes of DBS stirring required to satisfy the absorbance condition defines the new $d_{bleach}$ for the final test protocol implementation. If, however, a $d_{bleach}$ greater than 30 minutes is required [i.e., if 10% bleaching is not achieved in 30 minutes, even at the point where $\delta A$ is greatest (when the organic catalyst is present in its highest concentration)], the OCCP is not shown by Protocol I to be within the boundaries of this invention, however, the OCCP may be found to fall within the boundaries of this invention by Protocol II and/or Protocol III.

Case 2: If $A_{min}<0.25\ A_{max}$, rerun the test to reset the value of $w_{OCCp}$. The OCCPS is prepared from 50% of the default quantity of the OCCP. This process is repeated only until the absorbance condition described in Case 3 is met (e.g., reduce OCCP from 1.0 g to 0.5 g, then if necessary from 0.5 g to 0.25 g, etc.).

Case 3: If $0.25\ A_{max}\leqq A_{min}\leqq 0.9\ A_{max}$, the test run serves as the final test protocol implementation. Under these conditions, $d_{bleach}$ and $w_{OCCP}$ do not need to be changed from the default values used.

Test protocol 1: The initial step is the preparation of the OCCPS as described. The time at which the OCCP is added to the deionized water to form the OCCPS is set to t=0. At each of the aliquot removal times ($t_f$ or $t_{dd}$), a 100 mL aliquot of the OCCPS is withdrawn, immediately filtered during the period from t=($t_f$ or $t_{dd}$) to t=($t_f$ or $t_{dd}$+0.25 min) to remove undissolved OCCP, and the filtrate added all at once at t=($t_f$ or $t_{dd}$+0.50 min) to 10.0 mL of CDS. A 1–5 mL aliquot, C, of the resulting DBS is withdrawn immediately prior to the absorbance determination (data acquisition). Absorbance of C is measured at the $\lambda_{max}$ at the conclusion of $d_{bleach}$.

The time at which the absorbance determination (data acquisition) of aliquot C is measured is defined as $t_C$. Therefore, it is required that $t_C$=($t_f$ or $t_{dd}$)+0.50 min+$d_{bleach}$. The absorbance value measured at $t_C$ is defined as $A_{t(C)}$. The symbol $\delta A_{t(C)}$ is defined as $A_{max}-A_{t(C)}$. For example, if the wash period is 12 minutes, the value of $d_{bleach}$ is 1 minute, and the aliquot removals times are 0.5, 1.5, 2.5, 3.5, 6 and 9 minutes, then the data acquisition times ($t_C$) are 2, 3, 4, 5, 7.5 and 10.5 minutes.

The value $t_{C\alpha}$ is any data acquisition time, $t_C$, acquired prior to any other data acquisition time, $t_{C\beta}$. Therefore, $t_{C\alpha}<t_{C\beta}$. The absorbance at $t_{C\alpha\ is\ At(C)\alpha}$; the absorbance at $t_{C\beta}$ is $A_{t(C)\beta}$. Two cases exist, depending upon the values of $A_{t(C)\alpha}$ and $A_{t(C)\beta}$.

Case $I_1$: If any $A_{t(C)\beta}$<any $A_{t(C)\alpha}$, and by definition $\delta A_{t(C)\beta}>\delta A_{t(C)\alpha}$, then a controlled availability organic catalyst-containing product (OCCP) is indicated, and thus the controlled availability organic catalyst-containing product falls within the boundaries of this invention.

FIGS. 1 and 2 are examples of Case $I_1$ for a 20 minute wash cycle.

Case $I_2$: If each $A_{t(C)\beta}\geqq$each $A_{t(C)\alpha}$, and by definition $\delta A_{t(C)\alpha}$, then a controlled availability organic catalyst-containing product (OCCP) is not indicated by Protocol I, however, the OCCP may be found to fall within the boundaries of this invention by Test Protocol II and/or Test Protocol III. By way of example, this can occur for a non-controlled availability organic catalyst-containing product (OCCP), in which the OCCP fully dissolves in the OCCPS prior to the first $t_f$, such that subsequent values of $A_{t(C)}$ will remain constant. Decomposition of the organic catalyst over time in the OCCPS (which leads to less dye consumption in the DBS over time) results in each $A_{t(C)\beta}$ being>each $A_{t(C)\alpha}$.

Figure 3:
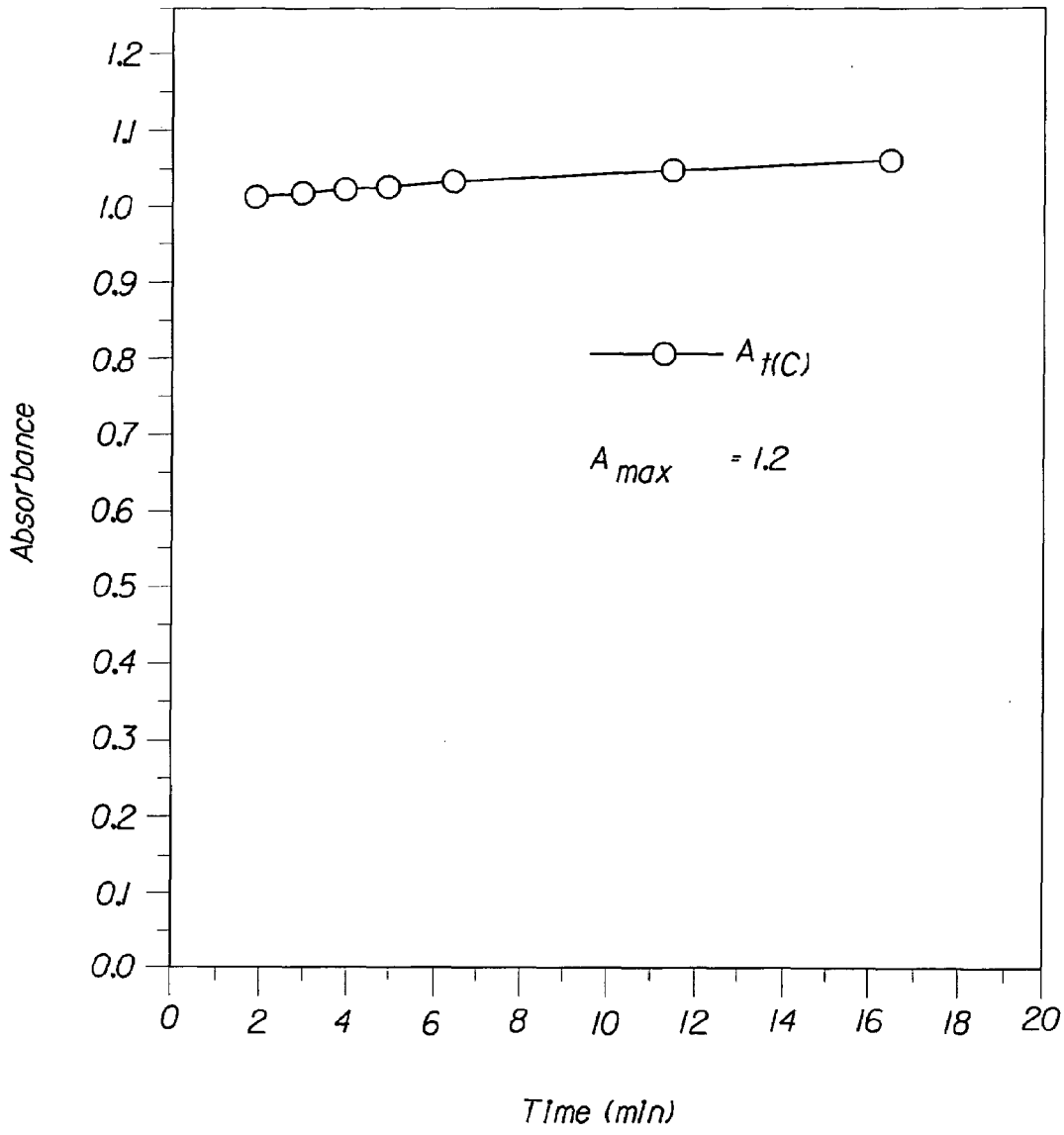
FIG. 3 is an example of Case $I_2$ for a 20 minute wash cycle.

FIG. 3 is an example of Case $I_2$ for a 20 minute wash cycle.

Test Protocol II

General/Parameters/Protocol: Same as defined from Test Protocol I with the following additions.

OCSP is the organic catalyst-segregated product prepared by reformulating the OCCP without the organic catalyst and then adding the organic catalyst to the reformulated product, such that the overall composition of the OCSP is the same as the OCCP.

OCSPS is the organic catalyst-segregated product solution prepared by dissolving 1.00 g of an organic catalyst-segregated product (OCSP) in 1 L of 25° C. deionized water, the pH of which has been previously adjusted such that the final solution has a pH between 9.9 and 10.1.

$^{w}$OCSP is a parameter in the final test protocol describing the weight of organic catalyst-segregated product (OCSP) used to form the organic catalyst-segregated product solution (OCSPS). The default value of the parameter is 1.00 grams, but may be defined as a lesser quantity or weight according to Case II below.

DBS2 is the dye bleaching solution formed from the addition of a 100 mL aliquot of the OCSPS to 10 mL of CDS.

Aliquot removal times from the OCSPS are the same as from the OCCPS, as described earlier. Test protocol II: The initial step is the completion of Protocol I as described. The same procedure is repeated (except that OCSP replaces OCCP) using the same $d_{bleach}$ as defined in Protocol I. The time at which the OCSP is added to the deionized water to form the OCSPS is set to t=0. At each of the aliquot removal times ($t_f$ or $t_{dd}$), a 100 mL aliquot of the OCSPS is withdrawn, immediately filtered during the period from t=($t_f$ or $t_{dd}$) to t=($t_f$ or $t_{dd}$+0.25 min) to remove undissolved OCSP, and the filtrate added all at once at t=($t_f$ or $t_{dd}$+0.50 min) to 10.0 mL of CDS. A 1–5 mL aliquot, S, of the resulting DBS2 is withdrawn immediately prior to the absorbance determination (data acquisition). Absorbance of S is measured at the $\lambda_{max}$ at the conclusion of $d_{bleach}$.

The time at which the absorbance determination (data acquisition) of aliquot S is measured is defined as $t_S$. Therefore, it is required that $t_S$=($t_f$ or $t_{dd}$)+0.50 min+$d_{bleach}$=$t_C$. The absorbance value measured at $t_S$ is defined as $\delta A_{t(S)}$. The symbol $\delta A_{t(S)}$ is defined as $A_{max}-A_{t(S)}$. For example, if the wash period is 12 minute, the value of $d_{bleach}$ is 1 minute, and the aliquot removals times are 0.5, 1.5, 2.5, 3.5, 6 and 9 minutes, then the data acquisition times ($t_S$) are 2, 3, 4, 5, 7.5 and 10.5 minutes.

Two cases exist, depending upon the values of $A_{t(C)}$ and $A_{t(S)}$for $t_S$=$t_C$:

Case $II_1$: If at least one $A_{t(s)}<A_{t(C)}$, and by definition $\delta A_{t(S)}>\delta A_{t(C)}$, then a controlled availability organic catalyst-containing product (OCCP) is indicated, and the OCCP falls within the boundaries of this invention.

Figure 4:
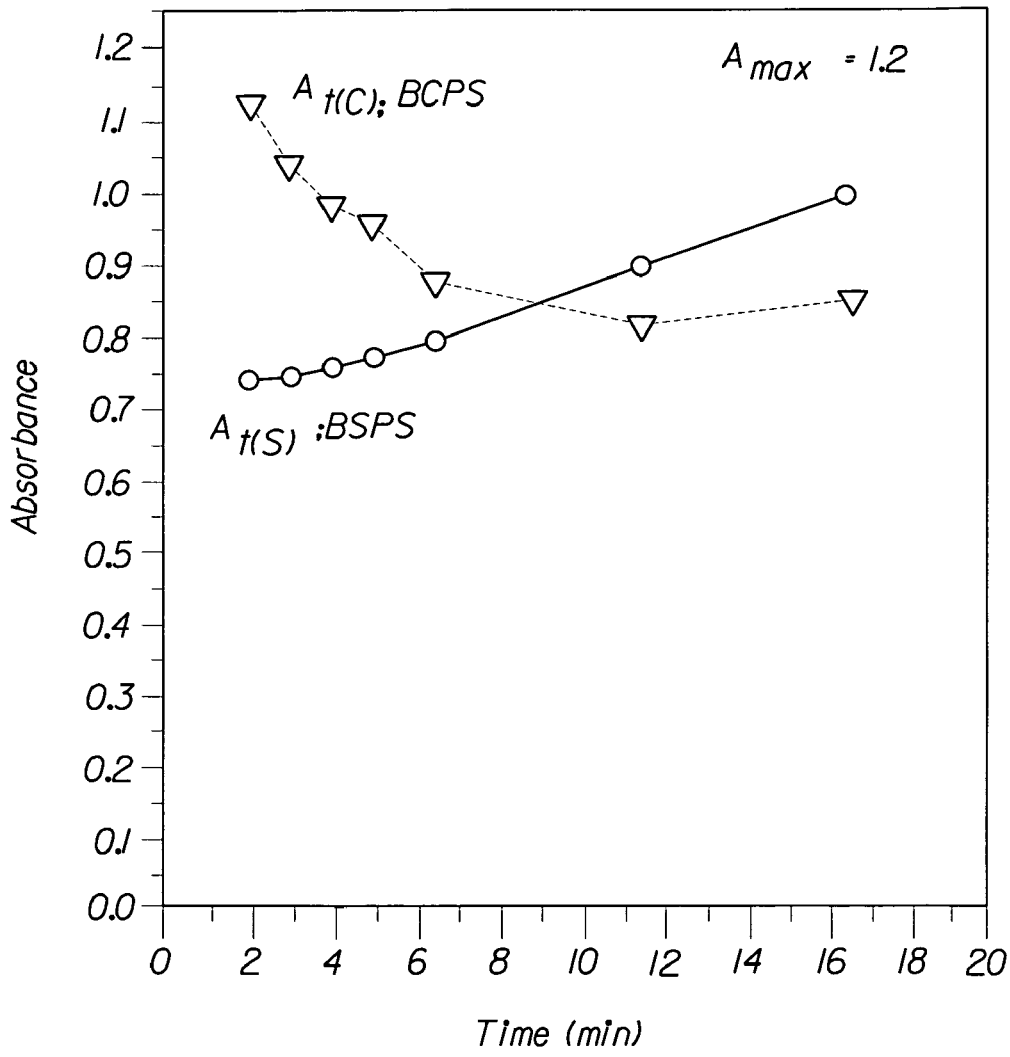
FIG. 4 is an example of Case $II_1$ for a 20 minute wash cycle.

FIG. 4 is an example of Case $II_1$ for a 20 minute wash cycle.

More preferably, for Protocol II, even if in at least one instance, $1.2\times A_{t(S)}<A_{t(C)}$, then a controlled availability organic catalyst-containing product (OCCP) is indicated, and the OCCP falls within the boundaries of this invention.

Case $II_2$: If each $A_{t(s)}\geqq A_{t(C)}$, and by definition $\delta A_{t(S)}\leqq\delta A_{t(C)}$, then a controlled availability organic catalyst-containing product (OCCP) is not indicated by Protocol II, however, the OCCP may be found to fall within the boundaries of this invention by Test Protocol I and/or Test Protocol III.OCCP Test Protocol III General/Parameters/Protocol: Same as defined from Test Protocol I with the following additions. Peracetic acid, 32 wt % solution in dilute acetic acid available from Aldrich.

OCCPS' in Protocol III is the organic catalyst-containing product solution prepared by dissolving 1.00 g of an organic catalyst-containing product (OCCP) in 1 L of 25° C. deionized water containing 100 mg of peracetic acid (based on 100% activity), the pH of which has been previously adjusted such that the final solution has a pH between 9.9 and 10.1.

Test protocol III: All steps are as in Protocol I except that OCCPS' is used in place of OCCPS.

Case $III_1$: If any $A_{t(C)\beta}$<any $A_{t(C)\alpha}$, and by definition $\delta A_{t(C)\beta}>\delta A_{t(C)\alpha}$, then a controlled availability organic catalyst-containing product (OCCP) is indicated, and thus the controlled availability organic catalyst-containing product falls within the boundaries of this invention.

Case $III_2$: If each $A_{t(C)\beta}\geqq$ each $A_{t(C)\alpha}$, and by definition $\delta A_{t(C)\beta}\leqq\delta A_{t(C)\alpha}$, then a controlled availability organic catalyst-containing product (OCCP) is not indicated by Protocol III, however, the OCCP may be found to fall within the boundaries of this invention by Test Protocol I and/or Test Protocol II.

The compositions of the present invention can be suitably prepared by any process chosen by the formulator, non-limiting examples of which are described in U.S. Pat. No. 5,691,297 Nassano et al., issued Nov. 11, 1997; U.S. Pat. No. 5,574,005 Welch et al., issued Nov. 12, 1996; U.S. Pat. No. 5,569,645 Dinniwell et al., issued Oct. 29, 1996; U.S. Pat. No. 5,565,422 Del Greco et al., issued Oct. 15, 1996; U.S. Pat. No. 5,516,448 Capeci et al., issued May 14, 1996; U.S. Pat. No. 5,489,392 Capeci et al., issued Feb. 6, 1996; U.S. Pat. No. 5,486,303 Capeci et al., issued Jan. 23, 1996 all of which are incorporated herein by reference.

In addition to the above embodiments, the organic catalysts of the present invention can be formulated into any suitable laundry detergent composition, non-limiting examples of which are described in U.S. Pat. No. 5,679,630 Baeck et al., issued Oct. 21, 1997; U.S. Pat. No. 5,565,145 Watson et al., issued Oct. 15, 1996; U.S. Pat. No. 5,478,489 Fredj et al., issued Dec. 26, 1995; U.S. Pat. No. 5,470,507 Fredj et al., issued Nov. 28, 1995; U.S. Pat. No. 5,466,802 Panandiker et al., issued Nov. 14, 1995; U.S. Pat. No. 5,460,752 Fredj et al., issued Oct. 24, 1995; U.S. Pat. No. 5,458,810 Fredj et al., issued Oct. 17, 1995; U.S. Pat. No. 5,458,809 Fredj et al., issued Oct. 17, 1995; U.S. Pat. No. 5,288,431 Huber et al., issued Feb. 22, 1994 all of which are incorporated herein by reference.

Having described the present invention in detail with reference to preferred embodiments, it will be clear to those skilled in the art that various changes and modifications may be made without departing from the scope of the invention, and the invention is not to be considered limited to what is described in the specification.

SEQUENCE LISTING

<160> NUMBER OF SEQ ID NOS: 18

<210> SEQ ID NO 1
<211> LENGTH: 21
<212> TYPE: DNA
<213> ORGANISM: Aspergillus aculeatus

<400> SEQUENCE: 1 ttcatttgt ggacagtgga c 21

<210> SEQ ID NO 2
<211> LENGTH: 20
<212> TYPE: DNA
<213> ORGANISM: Aspergillus aculeatus

<400> SEQUENCE: 2 gttgatcgca cattgaacca 20

<210> SEQ ID NO 3
<211> LENGTH: 20
<212> TYPE: DNA
<213> ORGANISM: Aspergillus aculeatus

<400> SEQUENCE: 3 accccagccg accgattgtc 20

<210> SEQ ID NO 4
<211> LENGTH: 20
<212> TYPE: DNA
<213> ORGANISM: Aspergillus aculeatus

<400> SEQUENCE: 4 cttccttacc tcaccatcat 20

<210> SEQ ID NO 5
<211> LENGTH: 20
<212> TYPE: DNA
<213> ORGANISM: Aspergillus aculeatus

<400> SEQUENCE: 5 ttaacatctt ttcaccatga 20

<210> SEQ ID NO 6
<211> LENGTH: 20
<212> TYPE: DNA
<213> ORGANISM: Aspergillus aculeatus

<400> SEQUENCE: 6 agctttccct tctctccctt 20

<210> SEQ ID NO 7
<211> LENGTH: 28
<212> TYPE: DNA
<213> ORGANISM: Aspergillus aculeatus

<400> SEQUENCE: 7 gccaccctgg cttccgctgc cagcctcc 28

<210> SEQ ID NO 8
<211> LENGTH: 20
<212> TYPE: DNA
<213> ORGANISM: Aspergillus aculeatus -continued

<400> SEQUENCE: 8 gacagtagca atccagcatt 20

<210> SEQ ID NO 9
<211> LENGTH: 20
<212> TYPE: DNA
<213> ORGANISM: Aspergillus aculeatus

<400> SEQUENCE: 9 agcatcagcc gctttgtaca 20

<210> SEQ ID NO 10
<211> LENGTH: 20
<212> TYPE: DNA
<213> ORGANISM: Aspergillus aculeatus

<400> SEQUENCE: 10 ccatgaagtt caccgtattg 20

<210> SEQ ID NO 11
<211> LENGTH: 20
<212> TYPE: DNA
<213> ORGANISM: Aspergillus aculeatus

<400> SEQUENCE: 11 gcactgcttc tctcccaggt 20

<210> SEQ ID NO 12
<211> LENGTH: 20
<212> TYPE: DNA
<213> ORGANISM: Aspergillus aculeatus

<400> SEQUENCE: 12 gtgggcggcc cctcaggcaa 20

<210> SEQ ID NO 13
<211> LENGTH: 20
<212> TYPE: DNA
<213> ORGANISM: Aspergillus aculeatus

<400> SEQUENCE: 13 acgctcctcc aattttctct 20

<210> SEQ ID NO 14
<211> LENGTH: 19
<212> TYPE: DNA
<213> ORGANISM: Aspergillus aculeatus

<400> SEQUENCE: 14 ggctggtagt aatgagtct 19

<210> SEQ ID NO 15
<211> LENGTH: 20
<212> TYPE: DNA
<213> ORGANISM: Aspergillus aculeatus

<400> SEQUENCE: 15 ggcgcagagt ttggccaggc 20

<210> SEQ ID NO 16
<211> LENGTH: 21
<212> TYPE: DNA

-continued

```
<213> ORGANISM: Aspergillus aculeatus

<400> SEQUENCE: 16

caacatcccc ggtgttctgg g                                                21


<210> SEQ ID NO 17
<211> LENGTH: 347
<212> TYPE: DNA
<213> ORGANISM: Aspergillus aculeatus

<400> SEQUENCE: 17

aaagattcat ttgtggacag tggacgttga tcgcacattg aaccaacccc agccgaccga      60

ttgtccttcc ttacctcacc atcatttaac atcttttcac catgaagctt tcccttctct     120

cccttgccac cctggcttcc gctgccagcc tccagcgccg cacacttctg cggtcagtgg     180

gataccgcca ccgccggtga cttcaccctg tacaacgacc tttggggcga gacggccggc     240

accggctccc agtgcactgg agtcgactcc tacagcggcg acaccatcgc ttgtcacacc     300

agcaggtcct ggtcggagta gcagcagcgt caagagctat gccaacg                   347


<210> SEQ ID NO 18
<211> LENGTH: 294
<212> TYPE: DNA
<213> ORGANISM: Aspergillus aculeatus

<400> SEQUENCE: 18

cagcatctcc attgagtaat cacgttggtg ttcggtggcc cgccgtgttg cgtggcggag      60

gctgccggga gacgggtggg gatggtggtg ggagagaatg tagggcgccg tgtttcagtc     120

cctaggcagg ataccggaaa accgtgtggt aggaggttta taggtttcca ggagacgctg     180

tataggggat aaatgagatt gaatggtggc cacactcaaa ccaaccaggt cctgtacata     240

caatgcatat accaattata cctaccaaaa aaaaaaaaaa aaaaaaaaaa aaaa           294
```

What is claimed is:

1. A bleaching composition in granular, powder, bar, paste, gel, pill, tablet, or gelcap form comprising (a) a peroxygen source; and (b) an encapsulated or agglomerated organic catalyst selected from the group consisting of aryliminium cations and aryliminium polyions, which have a net charge of from about +3 to about −3, that are represented by the formula [I]:

[I]

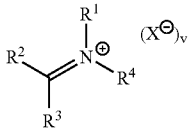

where $R^2$ and $R^3$ are independently selected from substituted or unsubstituted radicals selected from the group consisting of H, alkyl, cycloalkyl, aryl, alkaryl, aralkyl, heterocyclic ring, silyl, nitro, halo, cyano, sulfonato, alkoxy, keto, carboxylic, and carboalkoxy radicals; $R^1$ and $R^4$ are selected from substituted or unsubstituted, saturated or unsaturated radicals selected from the group consisting of H, alkyl, cycloalkyl, aryl, alkaryl, aralkyl, heterocyclic ring, silyl, nitro, halo, cyano, alkoxy, keto and carboalkoxy radicals; and $X^-$ is a suitable charge-balancing counterion; and v is an integer from 1 to 3;

wherein the organic catalyst becomes available in a wash solution containing said bleaching composition by a controlled availability method, the availability of said catalyst being delayed until after said peroxygen source has been released, such that said organic catalyst is made available by said controlled availability method.

2. The bleaching composition according to claim 1 wherein said peroxygen source is selected from the group consisting of:

(i) preformed peracid compounds selected from the group consisting of percarboxylic acids and salts, percarbonic acids and salts, perimidic acids and salts, peroxymonosulfuric acids and salts, and mixtures thereof, and (ii) hydrogen peroxide sources selected from the group consisting of perborate compounds, percarbonate compounds, perphosphate compounds and mixtures thereof, and a bleach activator.

3. The bleaching composition according to claim 2 wherein said peroxygen source is selected from hydrogen peroxide sources selected from the group consisting of perborate compounds, percarbonate compounds, perphosphate compounds and mixtures thereof, and a bleach activator.

4. The bleaching composition according to claim 3 wherein said bleach activator is selected from the group consisting of hydrophobic bleach activators.

5. The bleaching composition according to claim 3 wherein said bleach activator is selected from the group consisting of tetraacetyl ethylene diamine (TAED), benzoylcaprolactam (BzCL), 4-nitrobenzoylcaprolactam, 3-chlorobenzoylcaprolactam, benzoyloxybenzenesulphonate (BOBS), nonanoyloxybenzenesulphonate (NOBS), phenyl benzoate (PhBz), decanoyloxybenzenesulphonate ($C_{10}$-OBS), benzoylvalerolactam (BZVL), octanoyloxybenzenesulphonate ($C_8$-OBS), perhydrolyzable esters, 4-[N-(nonanoyl) amino hexanoyloxy]-benzene sulfonate sodium salt (NACA-OBS), lauryloxybenzenesulphonate (LOBS or $C_{12}$-OBS), 10-undecenoyloxybenzenesulfonate (UDOBS or $C_{11}$-OBS with unsaturation in the 10 position), decanoyloxybenzoic acid (DOBA) and mixtures thereof.

6. The bleaching composition according to claim 1 wherein the organic catalyst is selected from the group consisting of aryliminium cations and aryliminium polyions, which have a net charge of from about +3 to about −3, that are represented by the formula [XI]:

[XI]

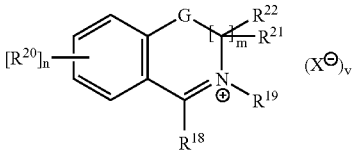

where m is 1 to 3 when G is present and m is 1 to 4 when G is not present; and n is an integer from 0 to 4; each $R^{20}$ is independently selected from a substituted or unsubstituted radical selected from the group consisting of H, alkyl, cycloalkyl, aryl, fused aryl, heterocyclic ring, fused heterocyclic ring, nitro, halo, cyano, sulfonato, alkoxy, keto, carboxylic, and carboalkoxy radicals, and any two vicinal $R^{20}$ substituents may combine to form a fused aryl, fused carbocyclic or fused heterocyclic ring; $R^{18}$ may be a substituted or unsubstituted radical selected from the group consisting of H, alkyl, cycloalkyl, alkaryl, aryl, aralkyl, heterocyclic ring, silyl, nitro, halo, cyano, sulfonato, alkoxy, keto, carboxylic, and carboalkoxy radicals; $R^{19}$ is a radical selected from the group consisting of substituted or unsubstituted, saturated or unsaturated, H, alkyl, cycloalkyl, alkaryl, aryl, aralkyl and heterocyclic ring; G is selected from the group consisting of: (1) —O—; (2) —N($R^{23}$)—; and (3) —N($R^{23}R^{24}$)—; $R^{21}$—$R^{24}$ are substituted or unsubstituted radicals independently selected from the group consisting of H, oxygen, linear or branched $C_1$–$C_{12}$ alkyls, alkylenes, alkoxys, aryls, alkaryls, aralkyls, cycloalkyls, and heterocyclic rings; provided that any of $R^{18}$, $R^{19}$, $R^{20}$, $R^{21}$–$R^{24}$ may be joined together with any other of $R^{18}$, $R^{19}$, $R^{20}$, $R^{21}$–$R^{24}$ to form part of a common ring; any geminal $R^{21}$–$R^{22}$ may combine to form a carbonyl; any vicinal $R^{21}$–$R^{24}$ may join to form unsaturation; and wherein any one group of substituents $R^{21}$–$R^{24}$ may combine to form a substituted or unsubstituted fused unsaturated moiety; $X^-$ is a suitable charge-balancing counterion; and v is an integer from 1 to 3.

7. The bleaching composition according to claim 1 wherein said bleaching composition further comprises one or more of the following detergent components selected from the group consisting of: surfactants, solvents, buffers, enzymes, soil release agents, clay soil removal agents, dispersing agents, brighteners, suds suppressors, fabric softeners, suds organic catalysts, enzyme stabilizers, builders, chelants, other bleaching agents, including metal catalysts, other organic catalysts, dyes, dye transfer inhibiting agents, perfumes and mixtures thereof.

8. A product comprising a bleaching composition according to claim 1, the product further including instructions for using said compound to clean a fabric in need of cleaning, the instructions including the step of contacting said fabric with a wash solution comprising the product.

9. The product according to claim 8 wherein said product is a laundry detergent.

10. The product according to claim 8 wherein said product is a laundry additive.

11. A method for laundering comprising contacting a fabric in need of cleaning with a bleaching composition according to claim 1.

12. The method according to claim 11 wherein the organic catalyst is selected from the group consisting of aryliminium cations and aryliminium polyions, which have a net charge of from about +3 to about −3, that are represented by the formula [XI]:

[XI]

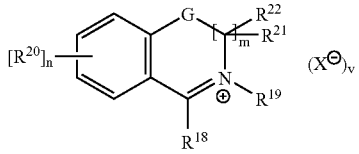

where m is 1 to 3 when G is present and m is 1 to 4 when G is not present; and n is an integer from 0 to 4; each $R^{20}$ is independently selected from a substituted or unsubstituted radical selected from the group consisting of H, alkyl, cycloalkyl, aryl, fused aryl, heterocyclic ring, fused heterocyclic ring, nitro, halo, cyano, sulfonato, alkoxy, keto, carboxylic, and carboalkoxy radicals, and any two vicinal $R^{20}$ substituents may combine to form a fused aryl, fused carbocyclic or fused heterocyclic ring; $R^{18}$ may be a substituted or unsubstituted radical selected from the group consisting of H, alkyl, cycloalkyl, alkaryl, aryl, aralkyl, heterocyclic ring, silyl, nitro, halo, cyano, sulfonato, alkoxy, keto, carboxylic, and carboalkoxy radicals; $R^{19}$ is a radical selected from the group consisting of substituted or unsubstituted, saturated or unsaturated, H, alkyl, cycloalkyl, alkaryl, aryl, aralkyl and heterocyclic ring; G is selected from the group consisting of: (1) —O—; (2) —N($R^{23}$)—; and (3) —N($R^{23}R^{24}$)—; $R^{21}$–$R^{24}$ are substituted or unsubstituted radicals independently selected from the group consisting of H, oxygen, linear or branched $C_1$–$C_{12}$ alkyls, alkylenes, alkoxys, aryls, alkaryls, aralkyls, cycloalkyls, and heterocyclic rings; provided that any of $R^{18}$, $R^{19}$, $R^{20}$, $R^{21}$–$R^{24}$ may be joined together with any other of $R^{18}$, $R^{19}$, $R^{20}$, $R^{21}$–$R^{24}$ to form part of a common ring; any geminal $R^{21}$–$R^{22}$ may combine to form a carbonyl; any vicinal $R^{21}$–$R^{24}$ may join to form unsaturation; and wherein any one group of substituents $R^{21}$–$R^{24}$ may combine to form a substituted or unsubstituted fused unsaturated moiety; $X^-$ is a suitable charge-balancing counterion; and v is an integer from 1 to 3.

13. The method according to claim 11 wherein said fabric comprises a stain.

* * * * *